US009741286B2

(12) United States Patent
Sakariya et al.

(10) Patent No.: US 9,741,286 B2
(45) Date of Patent: Aug. 22, 2017

(54) INTERACTIVE DISPLAY PANEL WITH EMITTING AND SENSING DIODES

(71) Applicant: LuxVue Technology Corporation, Santa Clara, CA (US)

(72) Inventors: Kapil V. Sakariya, Sunnyvale, CA (US); Mohammad Hendijanifard, Santa Clara, CA (US); Tore Nauta, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 370 days.

(21) Appl. No.: 14/294,494

(22) Filed: Jun. 3, 2014

(65) Prior Publication Data

US 2015/0348504 A1 Dec. 3, 2015

(51) Int. Cl.

| | |
|---|---|
| ***G09G 5/10*** | (2006.01) |
| ***G09G 3/3233*** | (2016.01) |
| ***G09G 3/20*** | (2006.01) |

(52) U.S. Cl.

CPC ..... *G09G 3/3233* (2013.01); *G09G 3/2092* (2013.01); *G09G 2300/0814* (2013.01); *G09G 2300/0819* (2013.01); *G09G 2300/0842* (2013.01); *G09G 2320/0626* (2013.01); *G09G 2360/141* (2013.01); *G09G 2360/142* (2013.01); *G09G 2360/144* (2013.01); *G09G 2360/145* (2013.01); *G09G 2360/148* (2013.01)

(58) Field of Classification Search

CPC . G09G 5/10; G09G 3/32; H01L 33/52; H01L 33/44

See application file for complete search history.

(56) References Cited

U.S. PATENT DOCUMENTS

| | | | |
|---|---|---|---|
| 3,717,743 | A | 2/1973 | Costello |
| 3,935,986 | A | 2/1976 | Lattari et al. |
| 4,618,814 | A | 10/1986 | Kato et al. |
| 5,131,582 | A | 7/1992 | Kaplan et al. |
| 5,378,926 | A | 1/1995 | Chi et al. |
| 5,435,857 | A | 7/1995 | Han et al. |
| 5,448,082 | A | 9/1995 | Kim |
| 5,592,358 | A | 1/1997 | Shamouilian et al. |
| 5,740,956 | A | 4/1998 | Seo et al. |
| 5,794,839 | A | 8/1998 | Kimura et al. |
| 5,839,187 | A | 11/1998 | Sato et al. |

(Continued)

FOREIGN PATENT DOCUMENTS

| | | |
|---|---|---|
| EP | 1 694 099 A2 | 8/2006 |
| JP | 07-060675 A | 3/1995 |

(Continued)

OTHER PUBLICATIONS

Asano, Kazutoshi, et al., "Fundamental Study of an Electrostatic Chuck for Silicon Wafer Handling" IEEE Transactions on Industry Applications, vol. 38, No. 3, May/Jun. 2002, pp. 840-845.

(Continued)

*Primary Examiner* — Tony N Ngo

(74) *Attorney, Agent, or Firm* — Blakely Sokoloff Taylor & Zafman LLP

(57) ABSTRACT

Exemplary methods and systems use a micro light emitting diode (LED) in an active matrix display to emit and sense light. Display panels, systems, and methods of operation are described in which LEDs may be used for both emission and sensing.

18 Claims, 34 Drawing Sheets

(56) References Cited

U.S. PATENT DOCUMENTS 5,851,664 A 12/1998 Bennett et al.
5,888,847 A 3/1999 Rostoker et al.
5,903,428 A 5/1999 Grimard et al.
5,996,218 A 12/1999 Shamouilian et al.
6,071,795 A 6/2000 Cheung et al.
6,080,650 A 6/2000 Edwards
6,081,414 A 6/2000 Flanigan et al.
6,335,263 B1 1/2002 Cheung et al.
6,403,985 B1 6/2002 Fan et al.
6,420,242 B1 7/2002 Cheung et al.
6,521,511 B1 2/2003 Inoue et al.
6,558,109 B2 5/2003 Gibbel
6,613,610 B2 9/2003 Iwafuchi et al.
6,629,553 B2 10/2003 Odashima et al.
6,670,038 B2 12/2003 Sun et al.
6,683,368 B1 1/2004 Mostafazadeh
6,786,390 B2 9/2004 Yang et al.
6,788,109 B2 9/2004 Kitagawa
6,878,607 B2 4/2005 Inoue et al.
6,918,530 B2 7/2005 Shinkai et al.
7,015,825 B2 3/2006 Callahan
7,033,842 B2 4/2006 Haji et al.
7,079,205 B2 7/2006 Kuji
7,148,127 B2 12/2006 Oohata et al.
7,208,337 B2 4/2007 Eisert et al.
7,353,596 B2 4/2008 Shida et al.
7,358,158 B2 4/2008 Aihara et al.
7,439,549 B2 10/2008 Marchl et al.
7,585,703 B2 9/2009 Matsumura et al.
7,628,309 B1 12/2009 Erikssen et al.
7,642,710 B2 1/2010 Yao et al.
7,714,336 B2 5/2010 Imai
7,723,764 B2 5/2010 Oohata et al.
7,795,629 B2 9/2010 Watanabe et al.
7,797,820 B2 9/2010 Shida et al.
7,838,410 B2 11/2010 Hirao et al.
7,854,365 B2 12/2010 Li et al.
7,880,184 B2 2/2011 Iwafuchi et al.
7,884,543 B2 2/2011 Doi
7,888,690 B2 2/2011 Iwafuchi et al.
7,906,787 B2 3/2011 Kang
7,910,945 B2 3/2011 Donofrio et al.
7,927,976 B2 4/2011 Menard
7,928,465 B2 4/2011 Lee et al.
7,972,875 B2 7/2011 Rogers et al.
7,989,266 B2 8/2011 Borthakur et al.
7,999,454 B2 8/2011 Winters et al.
8,023,248 B2 9/2011 Yonekura et al.
8,076,670 B2 12/2011 Slater et al.
8,186,568 B2 5/2012 Coronel et al.
8,333,860 B1 12/2012 Bibl et al.
8,349,116 B1 1/2013 Bibl et al.
8,390,582 B2 3/2013 Hotelling et al.
8,426,227 B1 4/2013 Bibl et al.
8,518,204 B2 8/2013 Hu et al.
8,552,436 B2 10/2013 Bibl et al.
8,558,243 B2 10/2013 Bibl et al.
8,573,469 B2 11/2013 Hu et al.
8,614,693 B2 12/2013 King et al.
8,646,505 B2 2/2014 Bibl et al.
8,730,196 B2 5/2014 Hotelling et al.
8,730,197 B2 5/2014 Hamaguchi et al.
2001/0029088 A1 10/2001 Odajima et al.
2002/0076848 A1 6/2002 Spooner et al.
2002/0140713 A1* 10/2002 Klompenhouwer . G09G 3/2003 345/690
2003/0010975 A1 1/2003 Gibb et al.
2003/0177633 A1 9/2003 Haji et al.
2003/0197664 A1 10/2003 Koyama
2004/0100164 A1 5/2004 Murata et al.
2004/0227704 A1 11/2004 Wang et al.
2004/0232439 A1 11/2004 Gibb et al.
2004/0266048 A1 12/2004 Platt et al.
2005/0185113 A1 8/2005 Weindorf et al.
2005/0224822 A1 10/2005 Liu
2005/0232728 A1 10/2005 Rice et al.
2005/0243039 A1 11/2005 Kwak
2006/0038291 A1 2/2006 Chung et al.
2006/0055035 A1 3/2006 Lin et al.
2006/0065905 A1 3/2006 Eisert et al.
2006/0157721 A1 7/2006 Tran et al.
2006/0160276 A1 7/2006 Brown et al.
2006/0214299 A1 9/2006 Fairchild et al.
2006/0244693 A1* 11/2006 Yamaguchi ..... G02F 1/13338 345/76
2007/0048902 A1 3/2007 Hiatt et al.
2007/0166851 A1 7/2007 Tran et al.
2007/0194330 A1 8/2007 Ibbetson et al.
2007/0284604 A1 12/2007 Slater et al.
2008/0018830 A1 1/2008 Negley
2008/0048206 A1 2/2008 Lee et al.
2008/0074401 A1 3/2008 Chung et al.
2008/0150134 A1 6/2008 Shinkai et al.
2008/0163481 A1 7/2008 Shida et al.
2008/0194054 A1 8/2008 Lin et al.
2008/0196237 A1 8/2008 Shinya et al.
2008/0205027 A1 8/2008 Coronel et al.
2008/0283190 A1 11/2008 Papworth et al.
2008/0283849 A1 11/2008 Imai
2008/0303038 A1 12/2008 Grotsch et al.
2009/0033604 A1 2/2009 Silzars et al.
2009/0068774 A1 3/2009 Slater et al.
2009/0072382 A1 3/2009 Guzek
2009/0146303 A1 6/2009 Kwon
2009/0167644 A1 7/2009 White et al.
2009/0242918 A1 10/2009 Edmond et al.
2009/0289910 A1 11/2009 Hattori
2009/0303713 A1 12/2009 Chang et al.
2009/0314991 A1 12/2009 Cho et al.
2010/0039030 A1 2/2010 Winters et al.
2010/0052004 A1 3/2010 Slater et al.
2010/0105172 A1 4/2010 Li et al.
2010/0123164 A1 5/2010 Suehiro et al.
2010/0176415 A1 7/2010 Lee et al.
2010/0188794 A1 7/2010 Park et al.
2010/0200884 A1 8/2010 Lee et al.
2010/0203659 A1 8/2010 Akaike et al.
2010/0203661 A1 8/2010 Hodota
2010/0213471 A1 8/2010 Fukasawa et al.
2010/0214777 A1 8/2010 Suehiro et al.
2010/0248484 A1 9/2010 Bower et al.
2010/0276726 A1 11/2010 Cho et al.
2011/0001145 A1 1/2011 Park
2011/0003410 A1 1/2011 Tsay et al.
2011/0049540 A1 3/2011 Wang et al.
2011/0069096 A1 3/2011 Li et al.
2011/0132655 A1 6/2011 Horiguchi et al.
2011/0132656 A1 6/2011 Horiguchi et al.
2011/0143467 A1 6/2011 Xiong et al.
2011/0147760 A1 6/2011 Ogihara et al.
2011/0151602 A1 6/2011 Speier
2011/0159615 A1 6/2011 Lai
2011/0187653 A1 8/2011 Ko et al.
2011/0210357 A1 9/2011 Kaiser et al.
2011/0244611 A1 10/2011 Kim
2011/0291134 A1 12/2011 Kang
2011/0297914 A1 12/2011 Zheng et al.
2011/0312131 A1 12/2011 Renavikar et al.
2012/0018494 A1 1/2012 Jang et al.
2012/0064642 A1 3/2012 Huang et al.
2012/0134065 A1 5/2012 Furuya et al.
2012/0250323 A1 10/2012 Velu
2013/0019996 A1 1/2013 Routledge
2013/0038416 A1 2/2013 Arai et al.
2013/0130440 A1 5/2013 Hu et al.
2013/0134591 A1 5/2013 Sakamoto et al.
2013/0161682 A1 6/2013 Liang et al.
2013/0181949 A1 7/2013 Setlak
2013/0221856 A1* 8/2013 Soto ..... G06F 3/0412 315/152
2013/0234175 A1 9/2013 Okada et al.
2013/0300953 A1 11/2013 Hotelling et al.
2014/0028575 A1 1/2014 Parivar et al.

(56) References Cited

U.S. PATENT DOCUMENTS

| | | | | |
|---|---|---|---|---|
| 2014/0092052 | A1 | 4/2014 | Grunthaner et al. | |
| 2014/0168037 | A1 | 6/2014 | Sakariya et al. | |
| 2015/0243220 | A1* | 8/2015 | Kim | H01L 27/1225 345/215 |

FOREIGN PATENT DOCUMENTS

| | | | |
|---|---|---|---|
| JP | 11-142878 | | 5/1999 |
| JP | 2001-298072 | A | 10/2001 |
| JP | 2001-353682 | A | 12/2001 |
| JP | 2002-134822 | A | 5/2002 |
| JP | 2002-164695 | A | 6/2002 |
| JP | 2002-176291 | A | 6/2002 |
| JP | 2002-240943 | A | 8/2002 |
| JP | 2004-095944 | A | 3/2004 |
| JP | 2008-200821 | A | 9/2008 |
| JP | 2010-056458 | A | 3/2010 |
| JP | 2010-161212 | A | 7/2010 |
| JP | 2010-186829 | A | 8/2010 |
| JP | 2011-181834 | A | 9/2011 |
| KR | 10-0610632 | B1 | 8/2006 |
| KR | 10-2007-0042214 | A | 4/2007 |
| KR | 10-2007-0093091 | A | 9/2007 |
| KR | 10-0973928 | B1 | 8/2010 |
| KR | 10-1001454 | B1 | 12/2010 |
| KR | 10-2007-0006885 | A | 1/2011 |
| KR | 10-2011-0084888 | A | 7/2011 |
| WO | WO 2005-099310 | A2 | 10/2005 |
| WO | WO 2011/123285 | | 10/2011 |

OTHER PUBLICATIONS

Bower, C.A., et al., "Active-Matrix OLED Display Backplanes Using Transfer-Printed Microscale Integrated Circuits", IEEE, 2010 Electronic Components and Technology Conference, pp. 1339-1343.

"Characteristics of electrostatic Chuck(ESC)" Advanced Materials Research Group, New Technology Research Laboratory, 2000, pp. 51-53 accessed at http://www.socnb.com/report/ptech_e/2000p51 _e.pdf.

Guerre, Roland, et al, "Selective Transfer Technology for Microdevice Distribution" Journal of Microelectromechanical Systems, vol. 17, No. 1, Feb. 2008, pp. 157-165.

Han, Min-Koo, "AM backplane for AMOLED" Proc. of ASID '06, 8-12, Oct., New Delhi, pp. 53-58.

Harris, Jonathan H., "Sintered Aluminum Nitride Ceramics for High-Power Electronic Applications" Journal of the Minerals, Metals and Materials Society, vol. 50, No. 6, Jun. 1998, p. 56.

Horwitz, Chris M., "Electrostatic Chucks: Frequently Asked Questions" Electrogrip, 2006, 10 pgs, accessed at www.electrogrip.com.

Hossick-Schott, Joachim, "Prospects for the ultimate energy density of oxide-based capacitor anodes" Proceedings of CARTS Europe, Barcelona, Spain, 2007, 10 pgs.

Lee, San Youl, et al., "Wafer-level fabrication of GAN-based vertical light-emitting diodes using a multi-functional bonding material system" Semicond. Sci. Technol. 24, 2009, 4 pgs.

"Major Research Thrust: Epitaxial Layer Transfer by Laser Lift-off" Purdue University, Heterogeneous Integration Research Group, accessed at https://engineering.purdue.edu/HetInt/project_epitaxial_layer_transfer_llo.htm, last updated Aug. 2003.

Mei, Zequn, et al., "Low-Temperature Solders" Hewlett-Packard Journal, Article 10, Aug. 1996, pp. 1-10.

Mercado, Lei, L., et al., "A Mechanical Approach to Overcome RF MEMS Switch Stiction Problem" 2003 Electronic Components and Technology Conference, pp. 377-384.

Miskys, Claudio R., et al., "Freestanding GaN-substrates and devices" phys. Stat. sol. © 0, No. 6, 2003, pp. 1627-1650.

"Principles of Electrostatic Chucks: 1—Techniques for High Performance Grip and Release" ElectroGrip, Principles1 rev3 May 2006, 2 pgs, accessed at www.electrogrip.com.

Steigerwald, Daniel, et al., "III-V Nitride Semiconductors for High-Performance Blue and Green Light-Emitting Devices" article appears in journal JOM 49 (9) 1997, pp. 18-23. Article accessed Nov. 2, 2011 at http://www.tms.org/pubs/journals/jom/9709/setigerwald-9709.html, 12 pgs.

Widas, Robert, "Electrostatic Substrate Clamping for Next Generation Semiconductor Devices" Apr. 21, 1999, 4 pgs.

"12-Bit High Bandwidth Multiplying DAC with Serial Interface: Data Sheet AD5452W," Rev. 0, Analog Devices, Inc., 2012, 24 pgs.

"Circuit Note CN-0139: Single Supply Low Noise LED Current Source Driver Using a Current Output DAC in the Reverse Mode" Rev. 0, Analog Devices, Inc., 2009, 2 pgs.

"LM3450: LM3450A LED Drivers with Active Power Factor Correction and Phase Dimming Decoder," Texas Instruments, Inc. SNVS681C, Nov. 2010—Revised Jun. 2011, 37 pgs.

"Application Guide: Driving LEDs," found at www.micropowerdirect.com, Jun. 21, 2011, 8 pgs.

Tsujimura, et al., "OLED Displays: Fundamentals and Applications" 4.3 Passive-Matrix OLED Display, pp. 91-109, 5.2 TFT Process, pp. 110-120, 7.2 OLED Lighting Requirement, pp. 191-196, 2012, John Wiley & Sons, Inc., Hoboken, New Jersey, USA.

Campbell, Mikey, "Apple details in-display fingerprint sensor tech in patent filing from AuthenTec cofounder" Jul. 18, 2013, Article accessed Jul. 19, 2013 at http://appleinsider.com/articles/13/07/18/apple-details-in-display-fingerprint-sensor-tech-in-patent-filing-from-authentec-cofounder, 4 pgs.

Lee, Hoy, "A low-droop sample-and-hold circuit" The Institute of Physics, J. Phys. E: Sci. Instrum., vol. 13, 1980, 2 pgs.

Sarariya, et al., U.S. Appl. No. 14/307,336, entitled, "Interactive Display Panel With IR Diodes," dated Jun. 17, 2014, 52 pgs.

* cited by examiner

INTERACTIVE DISPLAY PANEL WITH EMITTING AND SENSING DIODES

BACKGROUND

Field

The present invention relates to a display system. More particularly, embodiments of the present invention relate to interactive display panels.

Background Information

Interactive display systems are quickly becoming ubiquitous in modern electronic devices, such as cell phones, tablets, and laptop computers. A typical interactive flat panel display system includes an active matrix display panel and a separate sensor. For instance, an interactive flat panel display system typically includes an active matrix display panel and an interactive screen. The interactive screen includes a matrix of capacitors that are arranged at specific locations within the screen. The interactive screen is placed over the active matrix display panel such that the capacitors are arranged at strategic locations over the active matrix display panel. When a user interacts with the interactive screen, the capacitors output a corresponding signal to a processor. The signal is then processed as input signals and subsequently used to alter the active matrix display panel. Such interactive display systems require two separate devices to be layered together.

Other typical interactive display systems include an active matrix display panel with a separate sensor located near the active matrix display panel. These separate sensors are not layered over the active matrix display panel, but rather located adjacent to it to avoid obstructing a display region in the display panel. The sensor, such as a light sensor (e.g., a photodiode), detects intensity of light emissions and relays corresponding signals to a processor. In response, the processor calculates the received signals and controls the active matrix display panel according to the calculations. Accordingly, such interactive display systems require two separate components located adjacent one another.

DETAILED DESCRIPTION

Figure 1:
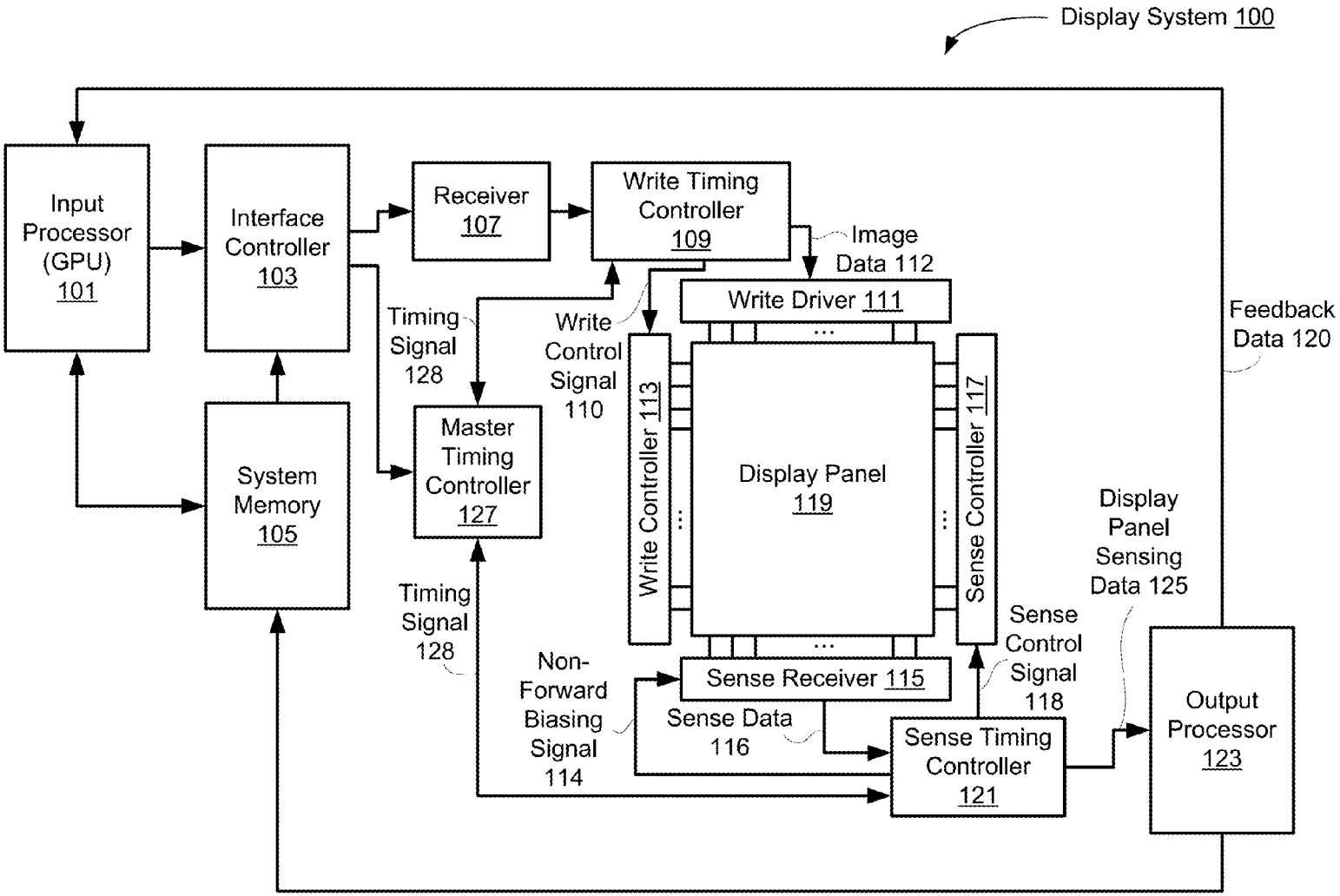
FIG. 1 is a block diagram of a display system according to an embodiment.

Embodiments of the invention relate to methods of operating interactive display panels with light emitting diodes (LEDs) that both emit and sense light. In an embodiment, an LED is operated in a light sensing mode by selecting a sensing output data line. The sensing output data line may be coupled to a sensing circuit located on or off the display panel. In the light sensing mode, the LED is non-forward biased by the sensing circuit. The LED is coupled to both the sensing output data line and a driving circuit through a selection device. The selection device may select and deselect the sensing circuit or the driving circuit. The driving circuit operates the LED in a light emission mode to emit light. During the light sensing mode, the LED generates an output signal corresponding to an intensity of detected light that is detected by the sensing circuit. In response to the output signal, light emitted from the interactive display panel, e.g., the LED, another LED in proximity to the LED, or a number of LEDs in a subarea of the display panel area, is altered. As a result, display systems that utilize methods described herein are able to sense with emissive LEDs, as opposed to separate sensing components. The omission of separate sensing components allows for thinner, less bulky display systems.

In accordance with some embodiments, the interactive display panel described herein is a micro LED active matrix display panel formed with inorganic or organic semiconductor-based micro LEDs. For example, a micro LED active matrix display panel utilizes the performance, efficiency, and reliability of inorganic semiconductor-based LEDs for both emitting and sensing light. Furthermore, the small size of micro LEDs enables a display panel to achieve high resolutions, pixel densities, and subpixel densities. In some embodiments, the high resolutions, pixel densities, and subpixel densities are achieved due to the small size of the micro LEDs and microchips. For example, the term "micro" as used herein, particularly with regard to LEDs and microchips, refers to the descriptive size of certain devices or structures in accordance with embodiments. For example, the term "micro" may refer to the scale of 1 to 300 μm or, more specifically, 1 to 100 μm. In some embodiments, "micro" may even refer to the scale of 1 to 50 μm, 1 to 20 μm, or 1 to 10 μm. However, it is to be appreciated that embodiments of the present invention are not necessarily so limited, and that certain aspects of the embodiments may be applicable to larger, and possibly smaller size scales. For example, a 55 inch interactive television panel with 1920×1080 resolution, and 40 pixels per inch (PPI) has an approximate RBG pixel pitch of (634 μm×634 μm) and subpixel pitch of (211 μm×634 μm). In this manner, each subpixel may contain one or more micro LEDs having a maximum width of no more than 211 μm. Furthermore, where real estate is reserved for microchips in addition to micro LEDs, the size of the micro LEDs may be further reduced. For example, a 5 inch interactive display panel with 1920×1080 resolution, and 440 pixels per inch (PPI) has an approximate RBG pixel pitch of (58 μm×58 μm) and subpixel pitch of (19 μm×58 μm). In such an embodiment, not only does each subpixel contain one or more micro LEDs having a maximum width of no more than 19 μm, in order to not disturb the pixel arrangement, each microchip may additionally be reduced below the pixel pitch of 58 μm. Microchips may be arranged between pixels, subpixels, or LEDs. For example, each microchip may be characterized with a length and/or width less than the pitch between subpixels, pixels, or LEDs. In an embodiment, each microchip has a length greater than the pitch between subpixels or pixels and a width less than the pitch between subpixels or LEDs. Accordingly, some embodiments combine with efficiencies of semiconductor-based LEDs (e.g. inorganic semiconductor-based LEDs) for both emitting and sensing light with the scalability of semiconductor-based LEDs, and optionally microchips, to the micro scale for implementation into high resolution and pixel density applications.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of embodiments of the present invention. In other instances, well-known semiconductor processes and manufacturing techniques have not been described in particular detail in order to not unnecessarily obscure embodiments of the present invention. Reference throughout this specification to "one embodiment," "an embodiment" or the like means that a particular feature, structure, configuration, or characteristic described in connection with the embodiment is included in at least one embodiment. Thus, the appearances of the phrase "in one embodiment," "an embodiment" or the like in various places throughout this specification are not necessarily referring to the same embodiment. Furthermore, the particular features, structures, configurations, or characteristics may be combined in any suitable manner in one or more embodiments.

In an embodiment, a display system includes a display panel with an array of LED pixels. Within each LED pixel is an array of LED subpixels. Each LED subpixel includes an LED that is coupled to a driving circuit and a sensing circuit through a sensing output data line. A selection device selects between the driving circuit and the sensing output data line to electrically couple to the LED. Accordingly, the LED is capable of being driven to emit light or sense light. In a particular embodiment, the LED is a micro LED. In some embodiments, the LED is a red, green, or blue emitting LED in a red, green, and blue (RGB) subpixel arrangement or a red, green, blue, or infrared emitting LED in a red, green, blue, and infrared (RGBIR) subpixel arrangement, although embodiments are not so limited. In an embodiment, the LED is only one color, such as a red or an infrared (IR) emitting LED that emits and senses light. Alternatively, in an embodiment, the LED is a red, green, or blue emitting LED that emits and senses light. In an embodiment, each subpixel includes a redundant pair of LEDs. Additionally, in an embodiment, each subpixel is electrically coupled with a write controller, a write driver, a sense controller, and a sense receiver. An arrangement of signals can be sent from the controllers and the drivers to each subpixel. The arrangement of signals determines what image is displayed on the display panel as well as whether the display panel is sensing light or emitting light. To sense light, an LED is operated in a light sensing mode. In an embodiment, when the LED is operated in the light sensing mode, the LED is not forward biased ("non-forward biased"). A non-forward biased LED may be driven in reverse bias with a reverse bias voltage applied by the sensing circuit, such as the sense receiver. A non-forward biased LED may be zero biased, e.g., not biased with a voltage although still operably coupled to the sensing circuit. As the LED is exposed to light during light sensing mode operation, it may generate a current or create a change in voltage or charge corresponding to an intensity of sensed light.

A write timing controller may be electrically coupled to the write controller and write driver to synchronize the data being sent to the display panel for displaying a cohesive image. In addition, a sense timing controller may be electrically coupled to the sense controller and sense receiver to synchronize reception of sensing data from the display panel for sensing with the interactive display panel. The sense receiver may receive sensing output data from each individual LED or a portion of the LEDs within the display panel.

In an embodiment, once the sense receiver receives the sensing output data from the LEDs, the sense receiver sends sense data to the sense timing controller, which then sends display panel sensing data to a processer in the form of a bitmap. The processor receives the bitmap and may use it to perform a useful operation. Using the display panel sensing data, the processor, or any other computing device, can perform a number of different operations including, but not limited to: (1) brightening or dimming a display panel in response to an amount of ambient light (ambient light detection), (2) turning the light emitting portion of a display panel on or off in response to an object's proximity to the display panel by sensing ambient light (ambient light proximity detection) or reflected light (reflected light proximity detection), (3) determine the location of an object relative to the dimensions of the display panel by sensing ambient light (ambient light object location detection) or by sensing reflected light (reflected light object location determination), (4) determining a surface profile of a target object by sensing reflected light (surface profile determination), and (5) calibrating display panel uniformity (display panel calibration). The details of each operation are discussed further below. It is to be appreciated that a processor may perform one or more of the operations in this list.

FIG. 1 is a block diagram depiction of a display system 100 that is used to perform a method of emitting and sensing light with an interactive display panel according to an embodiment. The display system 100 includes a display panel 119, which may be an active matrix display that includes a two-dimensional matrix of display elements. In one embodiment, each display element is an emissive device, which, for example, may include organic light emitting diodes (OLEDs), semiconductor-based LEDs, or other light-emissive devices. In accordance with some specific embodiments, the LEDs are inorganic semiconductor-based micro LEDs.

The display panel 119 may include a matrix of pixels. Each pixel may include multiple subpixels that emit different colors of lights. In a red-green-blue (RGB) subpixel arrangement, each pixel includes three subpixels that emit red, green, and blue light, respectively. In an alternative red-green-blue-infrared (RGBIR) arrangement, each pixel includes four subpixels that emit red, green, blue, and infrared light, respectively. It is to be appreciated that the RGB and RGBIR arrangements are exemplary and that embodiments are not so limited. Examples of other subpixel arrangements that can be utilized include, but are not limited to, red-green-blue-yellow (RGBY), red-green-blue-yellow-infrared (RGBYIR), red-green-blue-yellow-cyan (RGBYC), red-green-blue-yellow-cyan-infrared (RGBYCIR), red-green-blue-white (RGBW), red-green-blue-white-infrared (RGBWIR), or other subpixel matrix schemes in which the pixels have different numbers and/or colors of subpixels.

The display panel 119 may be driven by display driver integrated circuitry, which may include a write driver 111 and a write controller 113. The write controller 113 may select a row of the display panel 119 at a time by providing an ON voltage to the selected row. The selected row may be activated to receive pixel image data from the write driver 111 as will be discussed further below. In one embodiment, the write driver 111 and the write controller 113 are controlled by a write timing controller 109. The write timing controller 109 may provide the write controller 113 a write control signal 110 indicating which row is to be selected next for writing data. The write timing controller 109 may also provide the write driver 111 image data 112 in the form of a row of data voltages. Each data voltage may drive a corresponding subpixel in the selected row to emit a colored light at a specified intensity.

The display system 100 includes a receiver 107 to receive data to be displayed on the display panel 119. The receiver 107 may be configured to receive data wirelessly, by a wire connection, or by an optical interconnect. Wireless operation may be implemented in any of a number of wireless standards or protocols including, but not limited to, WiFi (IEEE 802.11 family), WiMAX (IEEE 802.16 family), IEEE 802.20, long term evolution (LTE), Ev-DO, HSPA+, HSDPA+, HSUPA+, EDGE, GSM, GPRSS, CDMA, TDMA, DECT, Bluetooth, derivatives thereof, as well as any other wireless protocols that are designated as 3G, 4G, 5G, and beyond.

The receiver 107 receives display data from an input processor 101 via an interface controller 103. In one embodiment, the input processor 101 is a graphics processing unit (GPU), a general-purpose processor having a GPU located therein, or a general-purpose processor with graphics processing capabilities. The interface controller 103 may provide display data and synchronization signals to the receiver 107, which in turn may provide the display data to the write timing controller 109. The display data may be generated in real time by the input processor 101 executing one or more instructions in a software program, retrieved from a system memory 105, or generated from local memory on the display panel 119. In an embodiment, the display panel 119 is in a "Panel Self-Refresh Mode" where the interface to the display panel is turned off and the image data is constantly generated from local memory on the display panel 119.

Depending on its applications, the display system 100 may include other components, such as a power supply, e.g., battery (not shown). In various implementations, the display system 100 may be a part of a television, tablet, phone, laptop, computer monitor, automotive heads-up display, kiosk, digital camera, handheld game console, media display, or ebook display.

According to an embodiment, in addition to being driven by the display driver integrated circuitry described above, the display panel 119 is also driven by display sensor integrated circuitry, which may include a sensing circuit (i.e., sense receiver 115) and a sense controller 117. In an embodiment, the sensing circuit is integrated into the write driver 111 such that only one data line is needed for the operation of both circuits. The sense controller 117 may select one row of the display panel 119 at a time by providing an ON voltage to the selected row. The selected row may then be operated in a light sensing mode, i.e., be non-forward biased, by the sense receiver 115 in order for the selected row to sense light. Output data from the selected row may be detected by the sense receiver 115 in the form of data voltage or current signals corresponding to the intensity of light sensed by each subpixel in the selected row. These signals may be calculated by a voltage or current calculator, such as, but not limited to, a digital to analog converter, a voltage sampler or comparator, a current sampler or comparator, and a charge amplifier located, in an embodiment, within the sense receiver 115. The sense receiver 115 may present sense data 116 to a sense timing controller 121. The sense receiver 115 and the sense controller 117 may be controlled by the sense timing controller 121. The sense timing controller 121 may provide the sense controller 117 a sense control signal 118 indicating which row is to be selected next for sensing light. The sense timing controller 121 may also present a non-forward biasing signal 114 to the sense receiver 115 to indicate a non-forward biasing voltage 228, such as no bias voltage or a reverse bias voltage, is to be applied to each subpixel in the selected row for sensing light.

In embodiments, a master timing controller 127 is connected to the write timing controller 109 and the sense timing controller 121. The master timing controller 127 may control the timing synchronization between the write timing controller 109 and the sense timing controller 121. In an embodiment, the master timing controller 127 sends and receives timing signals 128 to and from the write timing controller 109 and the sense timing controller 121. The timing signals 128 sent from the master timing controller 127 may indicate to the write and sense timing controllers when to send write and sense signals to the display panel 119. Additionally, timing signals 128 may be sent back to the master timing controller 127 to indicate when an operation has been completed. In an embodiment, the master timing controller 127 receives timing parameters from the interface controller 103. The master timing controller 127 may use the timing parameters to determine which timing scheme will be used to operate the display panel 119.

In an embodiment, the sense timing controller 121 consolidates the sense data 116 and sends the consolidated sense data 116 to an output processor 123 as display panel sensing data 125. The display panel sensing data 125 received by the output processor 123 may be in the form of one or more bitmaps where each bitmap corresponds to the consolidated sense data 116 from one color of subpixels, such as red subpixels, green subpixels, or blue subpixels in an RGB subpixel arrangement or red subpixels, green subpixels, blue subpixels, or IR subpixels in an RGBIR subpixel arrangement. The output processor 123 may then process the display panel sensing data 125 and optionally send feedback data 120 to the input processor 101 to alter the display properties of the display panel 119. The output processor 123 can be configured to perform a number of operations. For example, the output processor 123 can perform one or more of ambient light detection, ambient light proximity detection, reflected light proximity detection, ambient light object location determination, reflected light object location determination, surface profile determination, and display panel calibration as mentioned in the numbered list above. Although the output processor 123 is depicted as a separate processor, the input processor 101 and the output processor 123 can be a single processor that performs functions of both processors.

Figure 2:
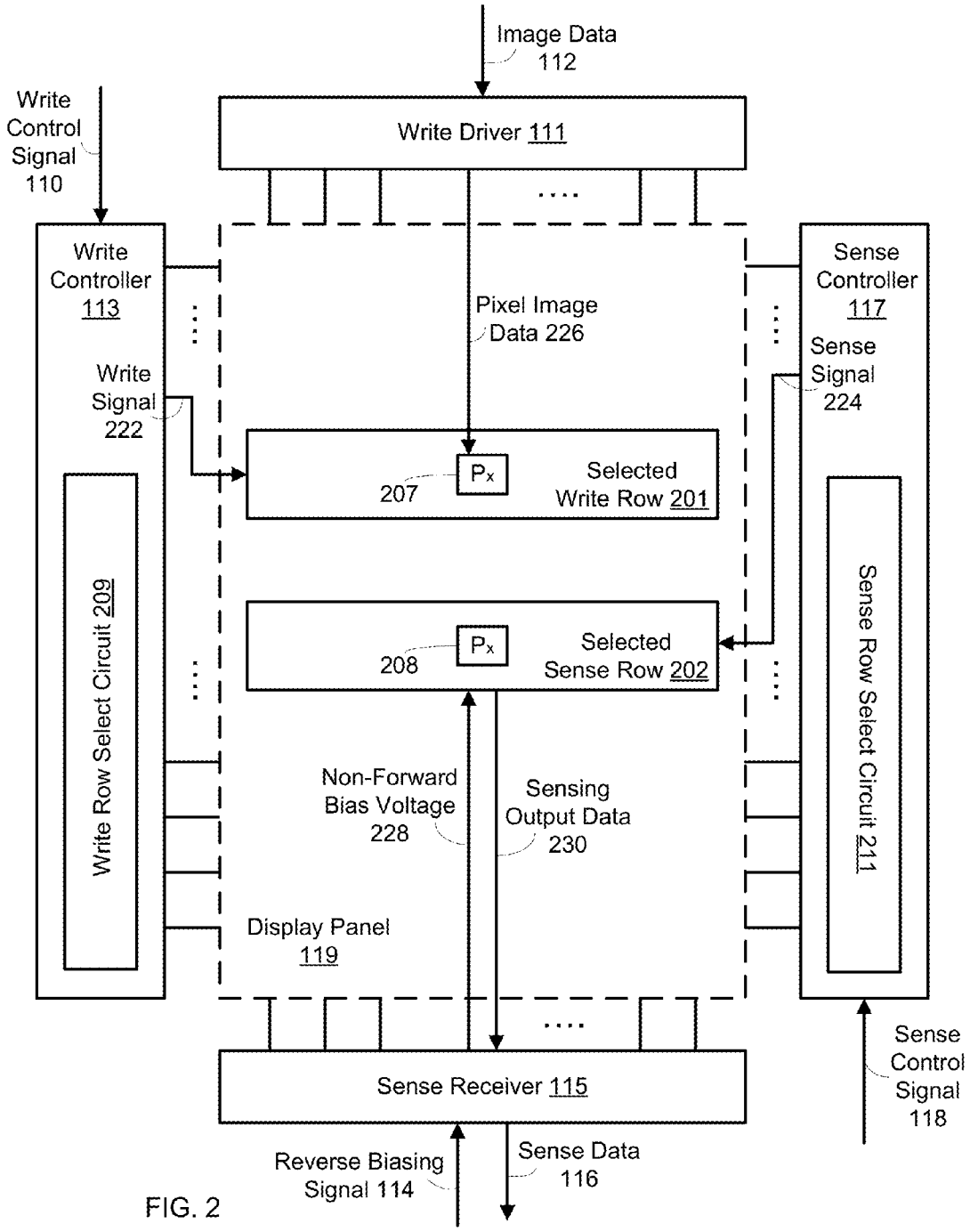
FIG. 2 is a block diagram of a display panel and its connection with the display driver integrated circuitry and sensing integrated circuitry in accordance with an embodiment.

FIG. 2 illustrates an example of the display panel 119 and its operation with the display driver integrated circuitry and display sensing integrated circuitry in further detail. In this example, the display panel 119 is in a decoupled sensing and emitting mode, in which a selected sense row 202 is sensing light and a selected write row 201 is being written with new data, while rows above and below the selected sense row 202 are emitting light. During typical sensing and emitting operation, the selected rows 201 and 202 scroll sequentially from the top row to the bottom row of the display panel 119, though embodiments are not intended to be limited to such scrolling sequences.

For the selected write row 201, the write timing controller 109 (shown in FIG. 1) sends a write control signal 110 to the write controller 113 and image data 112 to the write driver 111. The write control signal 110 may specify a row index to directly address a row in the display panel 119 for writing data, or may prompt the write controller 113 to select the next row in sequential order. To select a row to write data, the write controller 113 may use a write row select circuit 209 as shown in the illustrated embodiment. The write row select circuit 209 may be a demultiplexer, which, based on an input row index, outputs an ON voltage to directly select a row 201 of the display panel 119. The image data 112 may specify the brightness of each LED in the selected row 201 during emission. Once the write driver 111 receives the image data 112, the write driver 111 may divide the signal according to each pixel and drive pixel image data 226 to each corresponding pixel 207 in the selected write row 201. A write signal 222 may then be sent to each subpixel within pixel 207 to allow the pixel image data 226 to be stored on a storage capacitor within a subpixel driving circuit.

In order for the selected sense row 202 to be operated in the light sensing mode to sense light, the sense timing controller 121 (shown in FIG. 1) may send a sense control signal 118 to the sense controller 117 and a non-forward biasing signal 114 to the sense receiver 115. The sense control signal 118 may specify a row index to directly address a row in the display panel 119 for sensing light, or may prompt the sense controller 117 to select the next sensing row in sequential order. To select a row for sensing light, the sense controller 117 may use a sense row select circuit 211. The sense row select circuit 211 may be a demultiplexer, which, based on an input row index, outputs an ON voltage to directly select a selected sense row 202 of the display panel 119. Once the selected sense row 202 is selected, a sense signal 224 may be sent to each pixel in the selected sense row 202 to select a sensing circuit, such as the sense receiver 115. The sense receiver 115 may then operate the selected sense row 202 in the light sensing mode by applying a non-forward bias voltage 228 to an LED in each pixel 208 in the selected sense row 202 through a biasing and sensing line. In an embodiment, the sense receiver 115 operates the selected sense row 202 in the light sensing mode by applying a reverse biasing voltage or no biasing voltage (zero bias) to an LED in each pixel 208 in the selected sense row 202. The sense receiver 115 may determine the potential of the non-forward bias voltage 228 using the non-forward biasing signal 114 sent from the sense timing controller 121. Once the LED is not forward biased, light received by the LED may create a voltage change or a current flow back through the biasing and sensing line as sensing output data 230. In embodiments, the non-forward bias voltage 228 and sensing output data 230 flow through the same physical line. The sense receiver 115 may interpret the sensing output data 230 with sensing circuitry, such as, but not limited to, analog to digital converters, voltage samplers or comparators, current samplers or comparators, and charge amplifiers to form sense data 116. Thereafter, the sense receiver 115 relays corresponding sense data 116 to the sense timing controller 121.

Figure 3:
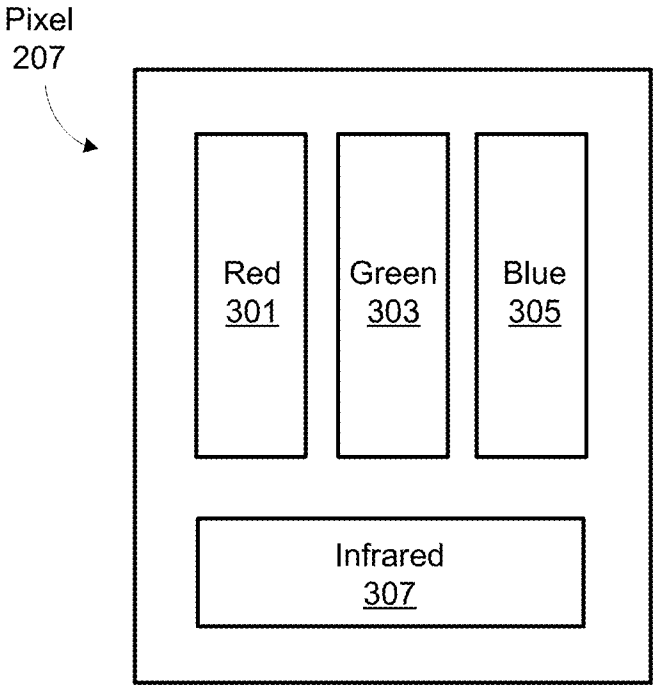
FIG. 3 is a block diagram of a pixel containing subpixels in accordance with embodiments.

FIG. 3 illustrates an exemplary subpixel arrangement within a pixel, such as pixel 207 from FIG. 2, of the display panel 119 according to an embodiment. The pixel 207 includes several subpixels, each with one or more LEDs capable of emitting a specific color of light. In an RGB subpixel arrangement, the pixel 207 includes a red 301, a green 303, and a blue 305 subpixel. In an RGBIR subpixel arrangement, such as the one illustrated in FIG. 3, the pixel 207 includes a red 301, a green 303, a blue 305, and an infrared (IR) 307 subpixel. Although the pixel 207 is illustrated as only having four subpixels, other embodiments are not so limited. For example, other subpixel arrangements that can be utilized include, but are not limited to, RGBY, RGBYIR, RGBYC, RGBYCIR, RGBW, RGBWIR, or other subpixel matrix schemes in which the pixels have different numbers and/or colors of subpixels. In an embodiment, the IR LED 307 is a sensing LED that does not emit IR light. For example, the IR LED 307 is not electrically coupled to a driving circuit so it is not possible to operate the IR LED 307 in a light emission mode by forward biasing the IR LED 307. The pixel 207 may have a redundancy scheme where, instead of having one LED for each color in each subpixel, each subpixel has two LEDs that are connected in parallel. In this example, if one LED is defective, the redundant LED may still emit and sense light. As such, the chances of having a non-emitting and non-sensing LED are significantly decreased. It is to be appreciated that the physical layout of the pixel 207 is but only one embodiment of the present invention to which other embodiments are not so limited. For example, rather than positioning the IR subpixel below the RGB pixels, the IR pixel may be located above or beside the RGB pixels. In some embodiments, each subpixel in the pixel 207 is driven by a subpixel circuit located in a subpixel microchip on the same substrate supporting the pixel 207 and within the display region of the display panel, or embedded within an embedded circuit located within the display substrate, as described further herein. Each subpixel may be individually controlled by the subpixel circuit. The subpixel circuit may include a driving circuit and a selection device, but may also contain other devices as well. For example, each subpixel circuit may include driving and selection devices, write drivers, and write and sense controllers and/or sense receivers that are used in emitting and sensing light as will be discussed further below. Additionally, in an alternative example, each subpixel circuit may include a driving circuit but not a selection device.

Figure 4:
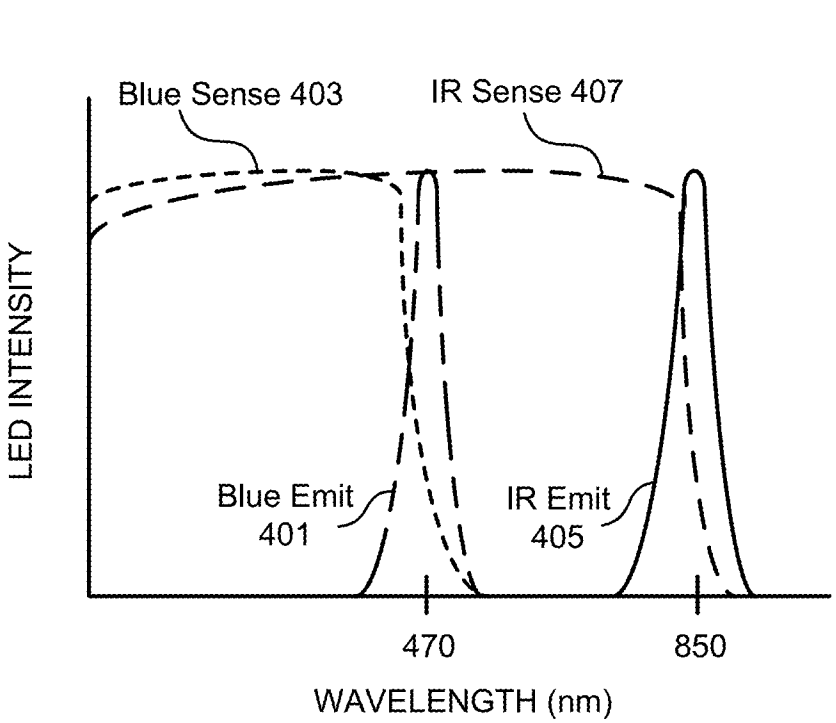
FIG. 4 is a chart plot illustrating the emission and sensing spectrum of a blue emitting light emitting diode (LED) and an infrared (IR) emitting LED in accordance with an embodiment.

FIG. 4 is a chart illustrating emitting and sensing intensity profiles of LEDs according to embodiments. A subpixel may include an LED that emits light at a wavelength corresponding to its color. The semiconductor material(s) used to form the LED may substantially determine its color emission. For example, a blue emitting LED may be formed from indium gallium nitride (InGaN), which emits light at a wavelength of around 450-495 nm. An IR emitting LED may be formed from gallium arsenide (GaAs), which emits light at a wavelength of around 700-1000 nm. As shown in the emission intensity profile of FIG. 4, peak emission intensity for blue and IR emitting LEDs occurs at approximately 470 and 850 nm, respectively. Sensing wavelength ranges of LEDs, however, differ from emission wavelength ranges. Rather than operating at a narrow wavelength, an LED can sense a wide range of light below its emission wavelength. However, an LED's ability to sense light significantly decreases at wavelengths at and higher than its own emissive wavelength. The two sense curves 403 and 407 represent the sensing intensities of blue and IR emitting LEDs, respectively. The emissive curve for a blue emitting LED, Blue Emit 401, is shown as a narrow peak that drastically increases and decreases around a wavelength of 470 nm. The sensing curve for a blue emitting LED (Blue Sense) 403, which is much wider than Blue Emit 401, covers wavelengths below its emissive wavelength. The blue emitting LED drastically decreases in sensing ability for wavelengths near the emissive wavelength of 470 nm and higher, as shown in FIG. 4. Ultimately, its sensing ability is very weak at the highest wavelength end of the emissive curve. Because the emissive wavelength of a blue emitting LED is near the lower wavelength end of the visible spectrum (which ranges from 400 to 700 nm), a blue emitting LED cannot sense much visible light. An IR emitting LED, on the other hand, can sense a much larger range of visible wavelengths than a blue emitting LED. The emissive spectrum of an IR emitting LED, IR Emit 405, peaks at approximately 850 nm, which is much higher than the wavelength of visible light. Furthermore, the dotted line representing the sensing intensity curve for the IR emitting LED, IR Sense 407, spans the whole wavelength range of visible light. As such, an IR emitting LED is able to sense substantially all wavelengths of visible light. FIG. 4 illustrates only IR and blue emitting LEDs to illustrate emission and sensing spectrums, however embodiments are not limited to IR or blue emitting LEDs for sensing. For instance, a red emitting LED, capable of emitting light at a wavelength of between 620-740 nm can sense a broad range of visible light that includes the blue and red emission spectrums. As such, a red emitting LED can sense a broader spectrum of visible light than a blue emitting LED and can be used to sense wavelengths below the red emission wavelength, including blue and green wavelengths. In an embodiment, an LED having the highest emission wavelength within a pixel is used for both emission and sensing while the other LEDs within the pixel are used for emission and not for sensing, though any number of possible configurations are envisioned. Furthermore, an IR emitting LED is capable of emitting light at a wavelength higher than the red emitting LED. As such, the IR emitting LED may sense red light more efficiently than the red, green, and blue emitting LEDs. The subpixel(s) included and used to sense light within a subpixel arrangement may be selected according to wavelengths of light sought to be detected. Accordingly, any combination of colored LEDs in a pixel used to sense light is envisioned in embodiments of the present invention.

Figure 5A:
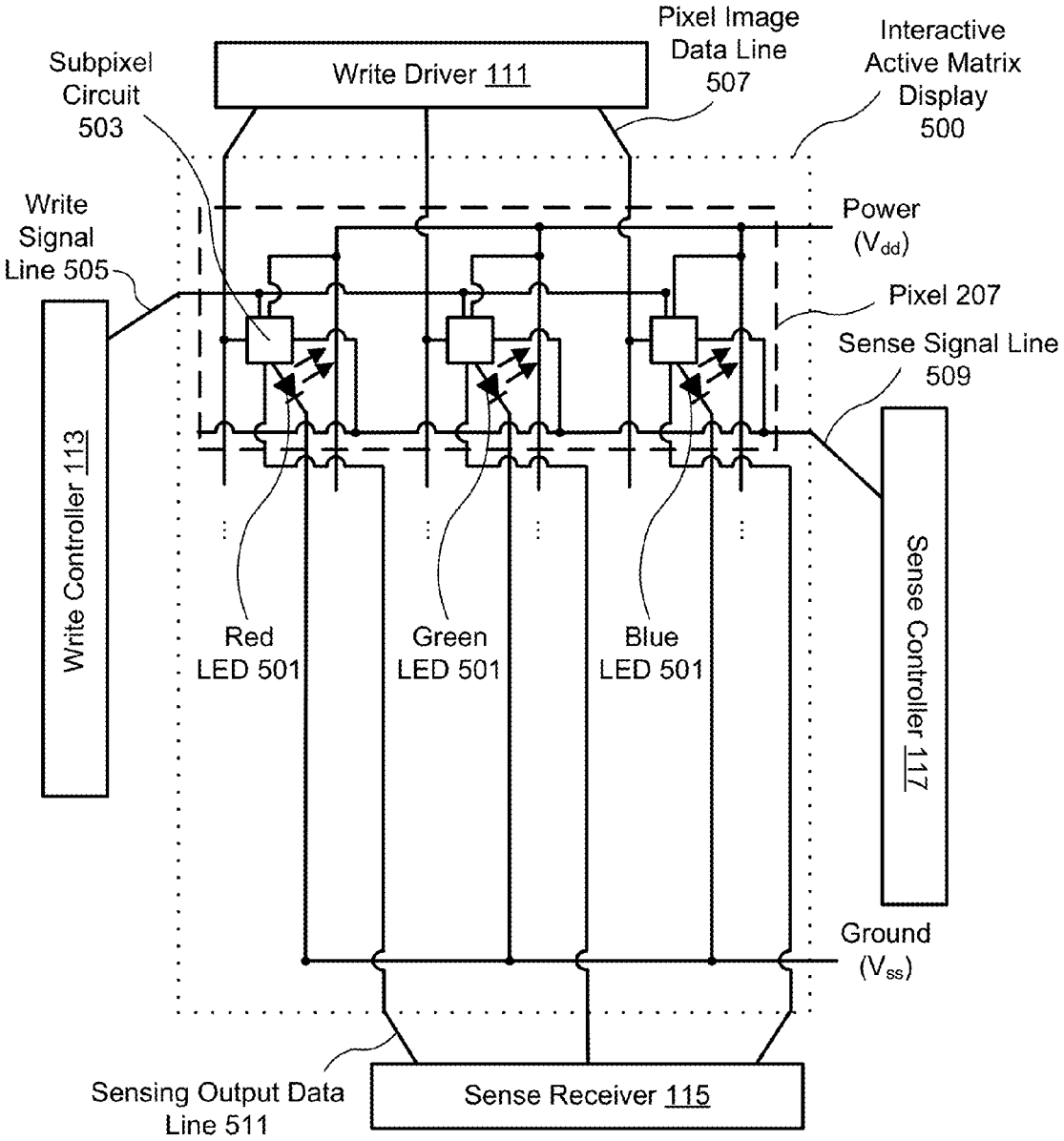
FIG. 5A is a circuit diagram of an interactive display panel having an RGB subpixel arrangement in accordance with an embodiment.
Figure 5C:
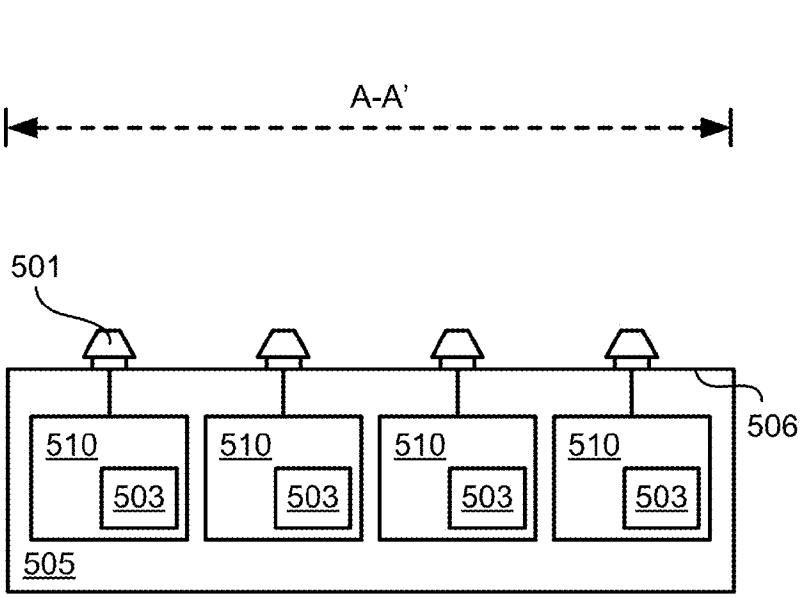
FIGS. 5B and 5C illustrate a perspective view and a schematic side view of an interactive active matrix display with embedded subpixel circuitry in accordance with an embodiment.
Figure 5B:
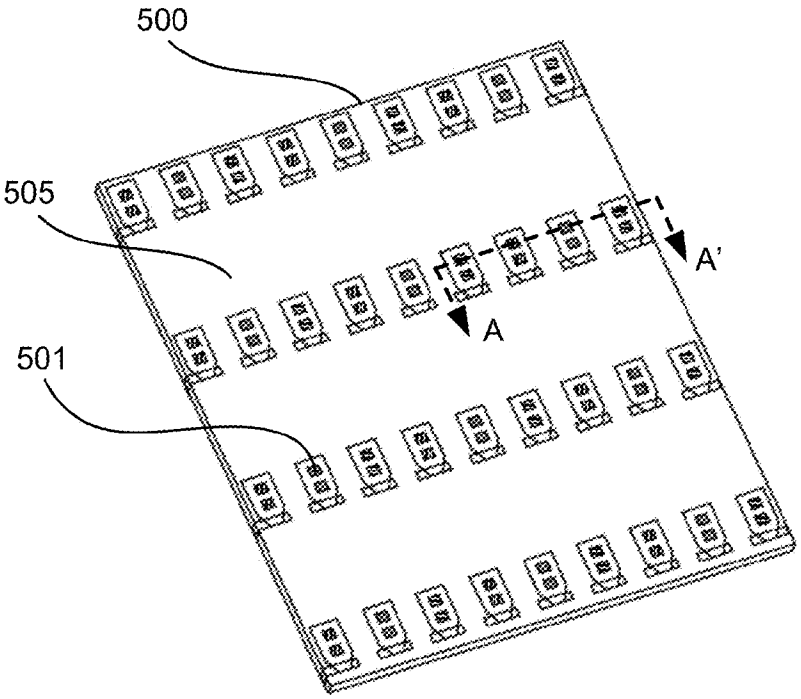
Figure 5D:
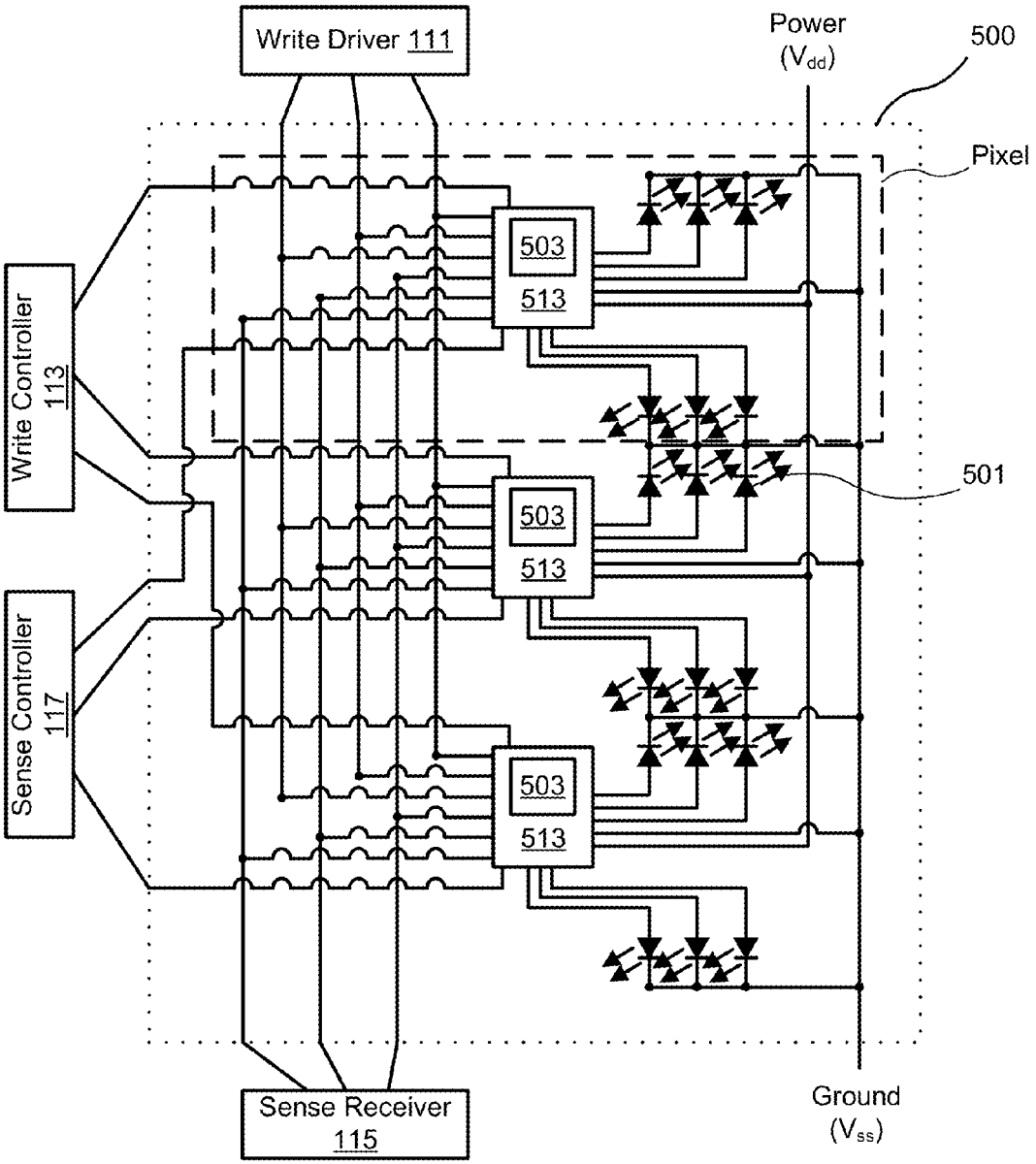
FIG. 5D is a circuit diagram of an interactive display panel with a subpixel microchip layout in accordance with an embodiment.
Figure 5E:
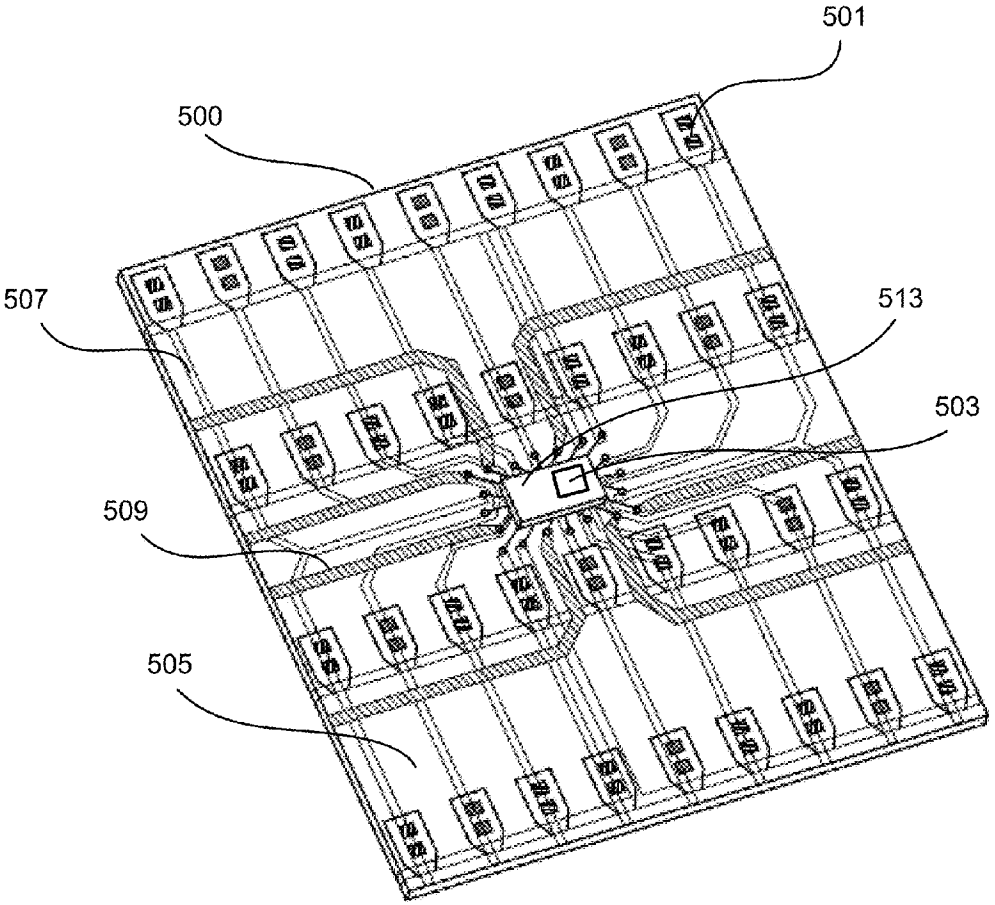
FIG. 5E illustrates a perspective view of an interactive active matrix display with a subpixel microchip containing subpixel circuitry in accordance with an embodiment.

FIGS. 5A-5E illustrate interactive display panels 500 in accordance with embodiments. More specifically, FIGS. 5B-5C illustrate an interactive display panel 500 with an embedded subpixel circuit layout in accordance with an embodiment. For example, in the embodiments illustrated and described with FIGS. 5A-5C micro LED devices may be integrated onto a display panel using existing backplane technologies, such as thin film transistor (TFT) processing technology to form the embedded subpixel circuit. FIGS. 5D-5E illustrate an interactive display 500 with a subpixel microchip layout in accordance with an embodiment. For example, in the embodiments illustrated and described with FIGS. 5D-5E micro LED devices may be integrated onto a display panel along with microchips including subpixel circuits. In this manner, the display panels can be formed using a variety of display substrates. In addition, the subpixel circuits within the microchips can be formed using a variety of processing techniques such as metal-oxide-semiconductor field-effect transistor (MOSFET) processing technology, which is well known for scalability and performance.

FIG. 5A is a circuit diagram of an interactive active matrix display 500 having an RGB subpixel arrangement in accordance with an embodiment. FIG. 5A depicts one pixel 207 in an array of pixels for ease of explanation. The interactive active matrix display 500 is meant to be one example of the display panel 119 shown in FIGS. 1 and 2, though other types of interactive active matrix displays are contemplated in accordance with embodiments. As illustrated, write signal lines 505 are oriented horizontally and driven by the write controller 113, while the image data lines 507 are oriented vertically and are driven by the write driver 111. Although the write signal lines 505 and image data lines 507 are oriented in horizontal and vertical orientations, other embodiments are not limited to such orientations. The write signal lines 505 and image data lines 507 are connected to each subpixel circuit 503 in the interactive active matrix display. In embodiments, the subpixel circuit 503 includes a driving circuit and a selection device, but may also include other devices such as, but not limited to, write and sense controllers. The write signal lines 505 may carry write signals 222 to each subpixel circuit 503, and the image data lines 507 may carry pixel image data 226 to each subpixel circuit 503. In addition, the sense signal lines 509 are oriented horizontally and driven by the sense controller 117, while the sensing output data lines 511 are vertically oriented and driven by the sense receiver 115. Although the sense signal lines 509 and sensing output data lines 511 are oriented in horizontal and vertical orientations, other embodiments are not limited to such orientations. The sense signal lines 509 and sensing output data lines 511 are connected to each subpixel circuit 503 in the interactive active matrix display 500. The sense signal lines 509 may carry sense signals 224 to each subpixel circuit 503 while the sensing output data line 511 may apply a non-forward biasing voltage 228 to allow sensing output data 230 to flow from each subpixel circuit 503. In one embodiment, the LEDs 501 are inorganic semiconductor-based LEDs. Alternatively, in an embodiment, the LEDs are OLEDs.

FIG. 5B is a perspective view of an interactive display 500 with embedded subpixel circuitry layout in accordance with an embodiment. LEDs 501 are exposed on a surface of a display substrate 505 so that emitted light can be seen and ambient or reflected light can be sensed. FIG. 5C illustrates an exemplary schematic side view of the interactive display 500 with embedded subpixel circuitry across line A-A' within FIG. 5B. The display substrate 505 contains embedded circuits 510 containing at least one subpixel circuit 503 that includes a driving circuit to drive the array of LEDs 501, and a selection device to select a sensing output data line that is coupled to a sensing circuit, which is used to sense from the array of LEDs 501 in a light sensing mode, as will be discussed further herein. The embedded circuits 510 are formed within the display substrate 505 below surface 506 of the display substrate 505. Embedded circuits 510 and subpixel circuits 503 are illustrated as boxes for clarity. Actual implementations of an embedded circuit 510 and a subpixel circuit 503 are not so structured. In an embodiment the display substrate 505 is a flexible or rigid substrate in which the embedded circuits are formed utilizing TFT processing technology, though other processing technologies may be used.

FIG. 5D is a circuit diagram of an interactive active matrix display 500 having an RGB subpixel arrangement in a subpixel microchip layout in accordance with another embodiment. In this embodiment, the embedded circuit 510 is replaced with a subpixel microchip 513. The subpixel microchip 513 may contain at least one subpixel circuit 503, with each subpixel circuit including a driving circuit and a selection device, as will be discussed further herein. In an embodiment, a write driver 111, write controller 113, sense receiver 115, and sense controller 117 are all coupled to the subpixel microchip 513. Alternatively, in an embodiment, at least one of the write driver 111, write controller 113, sense receiver 115, and sense controller 117 are included in the subpixel microchip 513. As illustrated, the LEDs 501 are coupled with a common ground (Vss) and power source (Vdd), but each may have a separate ground and power source. In this figure, each LED 501 may represent a single LED, or may represent multiple LEDs arranged in series, in parallel, or a combination of the two, such that multiple LEDs may be driven from the same control signal. While the exemplary circuit in FIG. 5D illustrates six LED outputs for each subpixel microchip 513, embodiments are not so limited. A single subpixel microchip 513 can control multiple pixels on a display, or multiple LED 501 groupings for a lighting device. In one embodiment, a single subpixel microchip 513 can control fifty to one hundred pixels.

FIG. 5E is a perspective view of an interactive display 500 with a subpixel microchip layout in accordance with an embodiment. In this embodiment, a subpixel microchip 513 containing at least one subpixel circuit 503 within the subpixel microchip 513 is disposed on top of a display substrate 505 with an array of LEDs 501. Wiring connections 507 and 509 may be formed within the display substrate 505, on the display substrate 505, or a combination of both, to electrically couple the subpixel microchip 513 to the array of LEDs 501. The subpixel microchip 513 may receive signals from the write and sense controllers and may control the LEDs 501 accordingly. LEDs 501 are exposed on a surface of a display substrate 505 so that emitted light can be seen and ambient or reflected light can be sensed. The display substrate 505 may be any suitable display substrate such as, but not limited to, a flexible or rigid substrate, a build-up structure, or a glass substrate. The build-up structure may include electrical interconnects that electrically couple a front surface to a back surface of the substrate 505. In an embodiment, the subpixel circuit 503 formed within the subpixel microchip 513 is formed using MOSFET processing technology, though other processing technologies may be used.

Figure 6B:
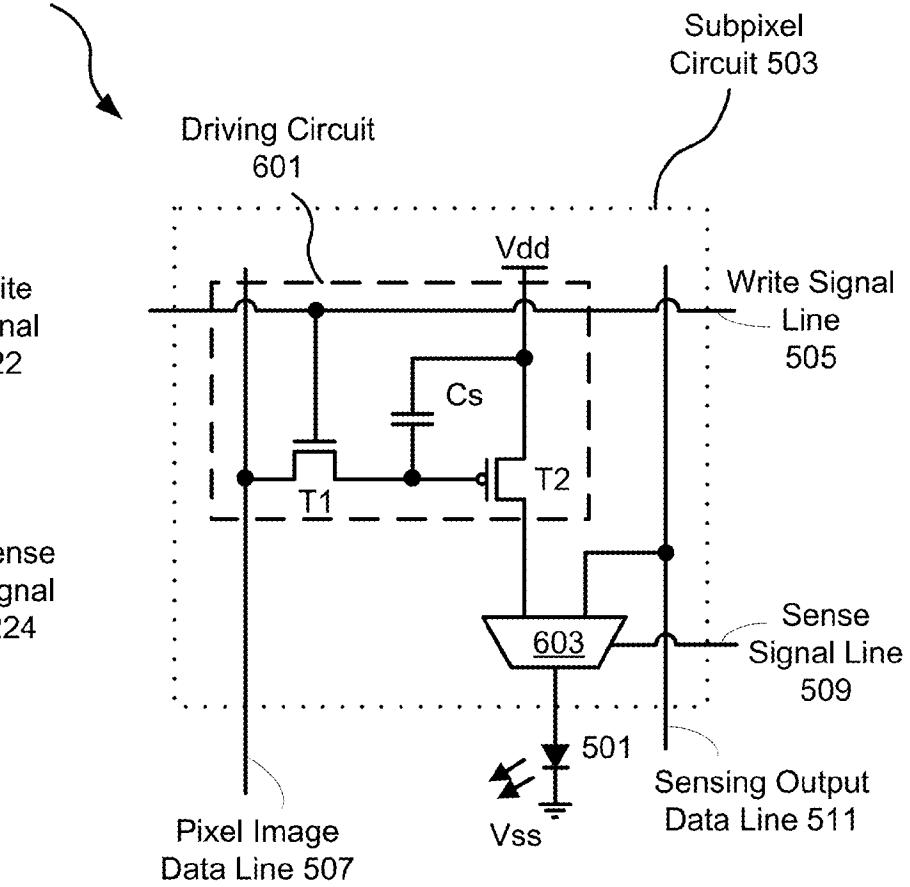
FIGS. 6B-6Q are circuit diagrams of a subpixel having various arrangements of a driving circuit, a selection device, a pixel image data/sensing output data line, and an exposure capacitor in accordance with embodiments.
Figure 6A:
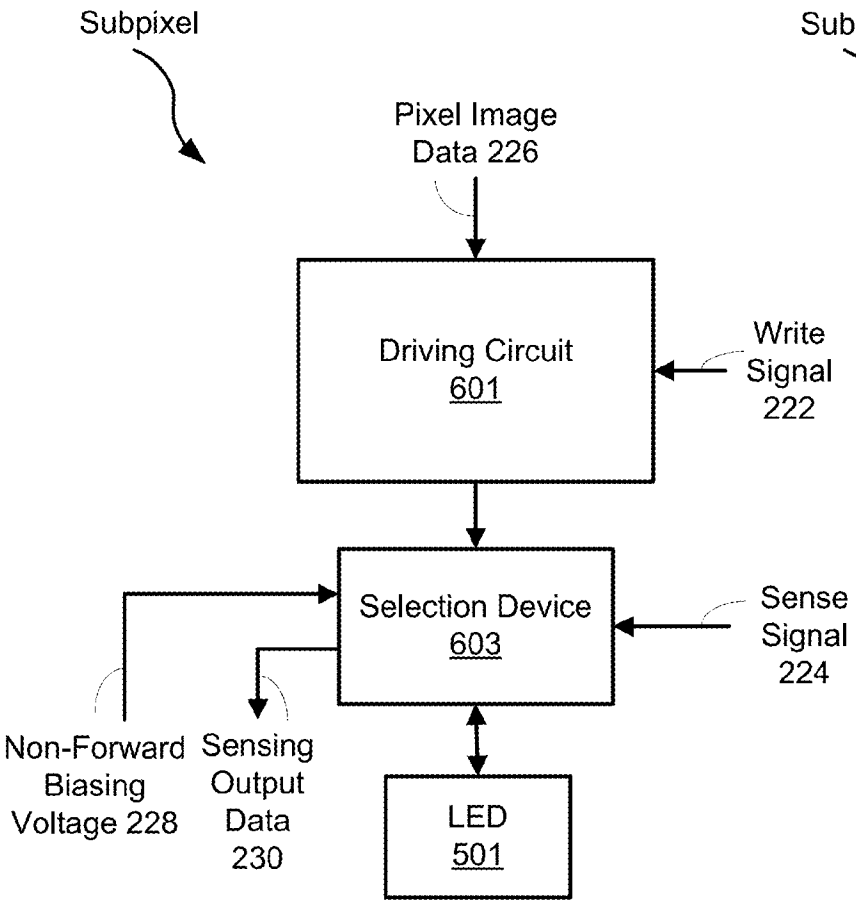
FIG. 6A is a block diagram of a subpixel in accordance with an embodiment.

FIGS. 6A and 6B depict a block diagram and a circuit diagram for a subpixel (e.g., 301, 303, 305, or 307 in FIG. 3 or a subpixel within pixels 207 and 208 in FIG. 2) according to an embodiment. FIG. 6A depicts a block diagram of a subpixel including a driving circuit 601 and a selection device 603 electrically coupled with an LED 501 according to an embodiment. FIG. 6B illustrates a circuit diagram of a subpixel circuit 503, e.g., the subpixel circuit 503 in the subpixel microchip 513 or embedded circuit 510, including an exemplary driving circuit and an exemplary selection device electrically coupled with an LED 501 according to an embodiment. FIG. 6B illustrates one exemplary driving circuit and selection device layout, to which other embodiments are not limited.

Referring to FIG. 6A, a driving circuit 601 receives a write signal 222 and pixel image data 226 from a write controller 113 and a write driver 111, respectively. The write signal 222 may indicate to the driving circuit 601 whether the pixel image data 226 will be stored for use in emitting light. The driving circuit 601 may be any suitable circuit capable of delivering a forward bias voltage at a specified magnitude to any suitable LED 501, such as an organic or inorganic semiconductor-based LED. For example, the driving circuit 601 may be a two-transistor-one-capacitor (2T1C) circuit, a six-transistor-two-capacitor circuit (6T2C), or any other suitable driving circuit. Furthermore, the transistors implemented in the driving circuit 601 may be any type of transistor, such as TFT or MOSFET. For example, the transistors can be p-type metal-oxide semiconductor (PMOS) transistors, n-type metal-oxide semiconductors (NMOS) transistors, or a combination thereof. Additionally, the transistors can be designed to be in any type of arrangement such as, but not limited to, a complementary metal-oxide semiconductor (CMOS) transistor arrangement. Alternatively, in some embodiments, the subpixel circuit 503, which may include the driving circuit 601 and the selection device 603, is contained within a subpixel microchip 513

(shown in FIGS. 5D-5E) disposed on top of the display substrate. As described above, each subpixel microchip 513 can be configured to control a single or multiple subpixels or pixels.

A selection device 603 is coupled to the driving circuit 601. The selection device 603 may be any conventional selection device, e.g., a multiplexer or a similar device that selects between more than one input circuit to connect to an output circuit. In an alternative example, the selection device 603 may be a transistor that turns ON to electrically connect and select a sensing output data line 511 coupled to the sensing circuit, such as sense receiver 115, to the LED 501, as will be discussed further below in FIGS. 6F-6Q. In embodiments, selecting the sensing output data line 511 electrically couples the sensing circuit to the LED 501. The sensing circuit, when coupled to the LED 501, may operate the LED in a light sensing mode in which the sensing circuit non-forward biases the LED 501 and detects a corresponding sensing current or a sensing voltage through the sensing output data line 511. In an embodiment, the selection device 603 may include multiple transistors to select the sensing output data line and the sensing circuit or deselect the driving circuit.

Figure 6D:
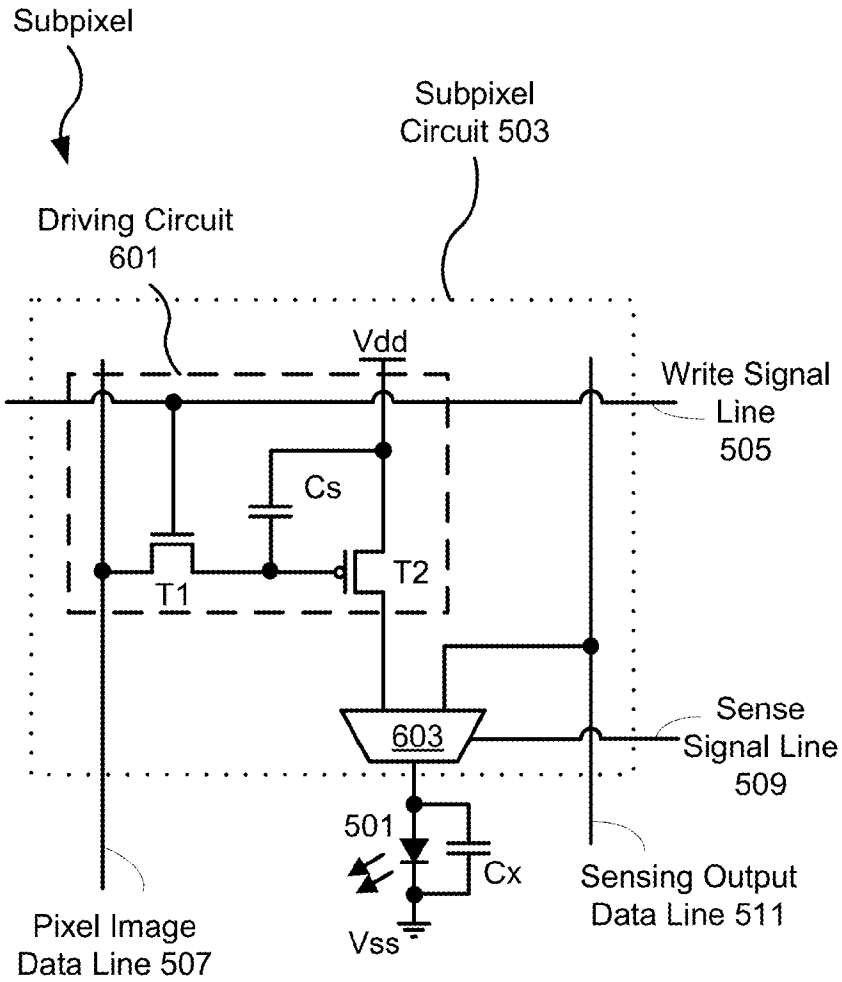
FIG. 6R is a flow chart of a method of sensing light with an emissive LED in an interactive display panel in accordance with an embodiment.
Figure 6C:
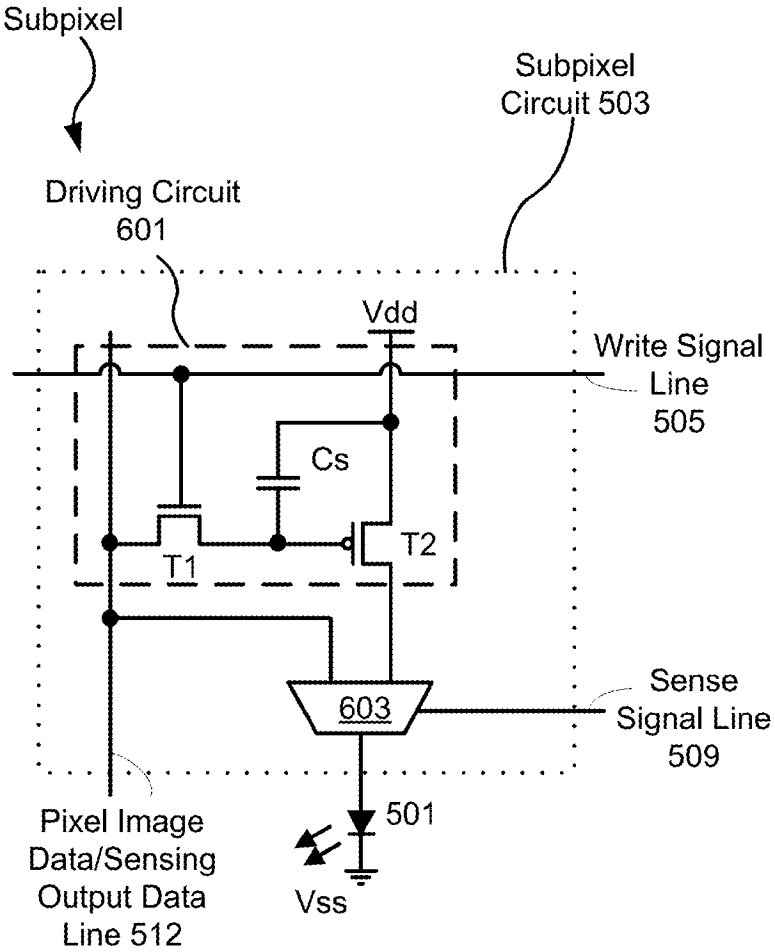
Figure 6F:
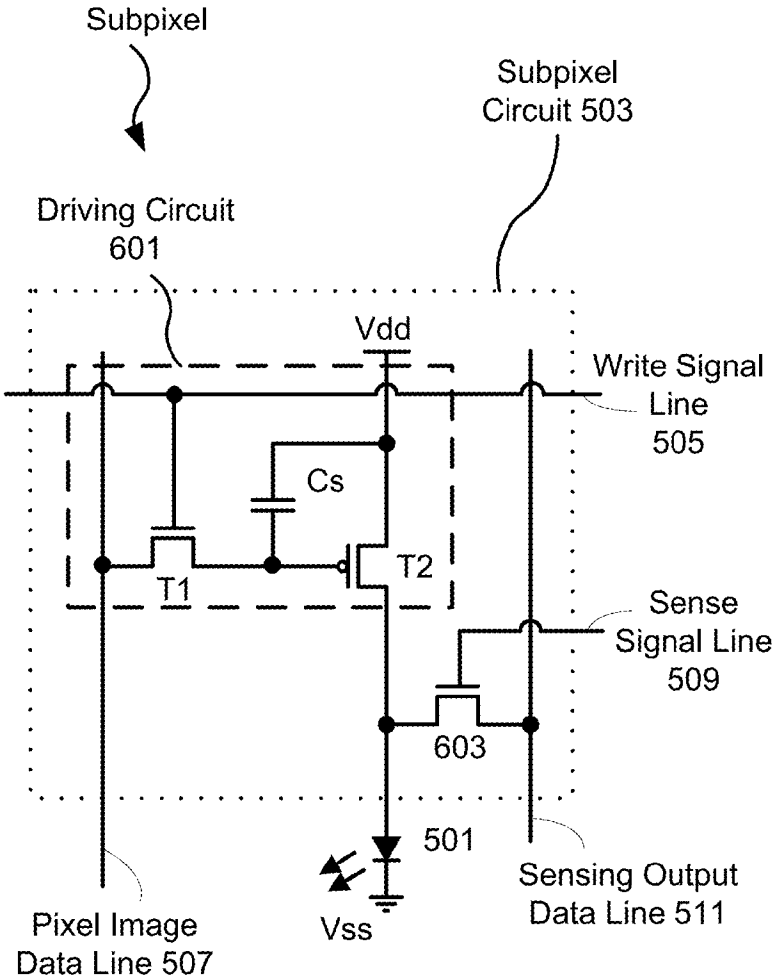
Figure 6E:
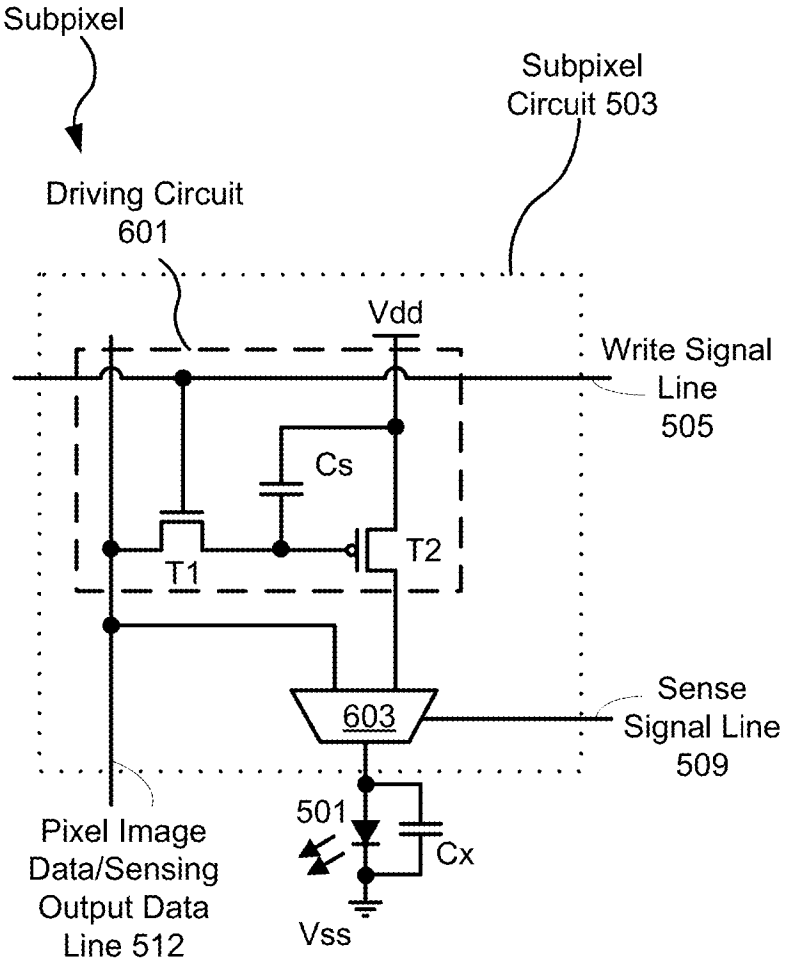
Figure 6H:
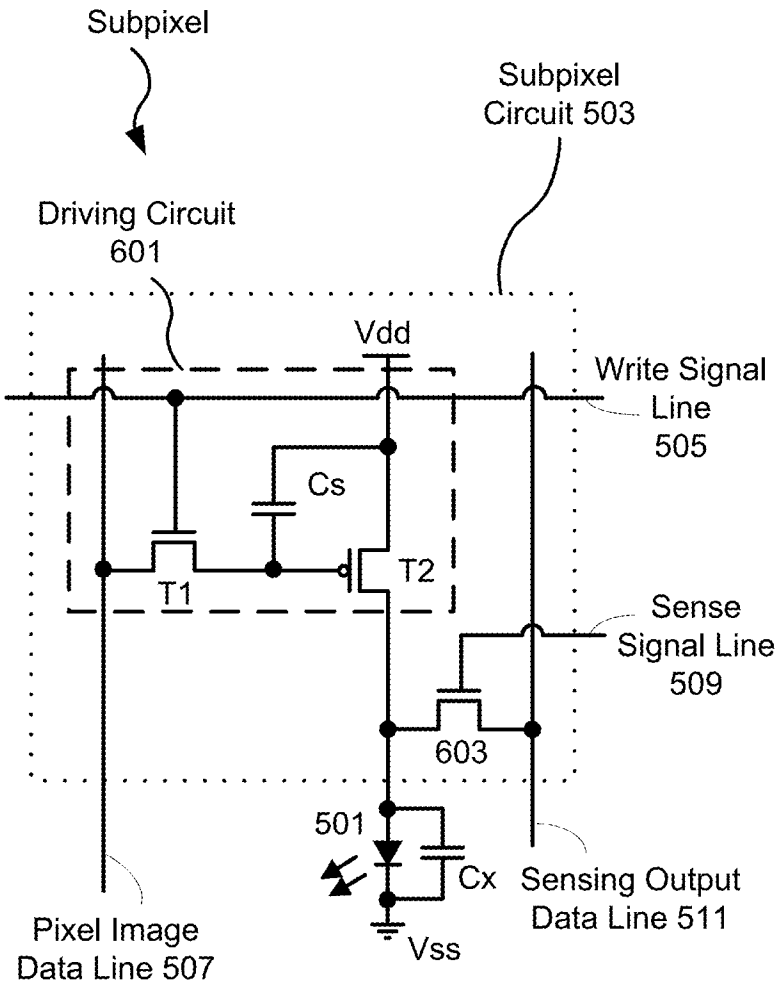
Figure 6G:
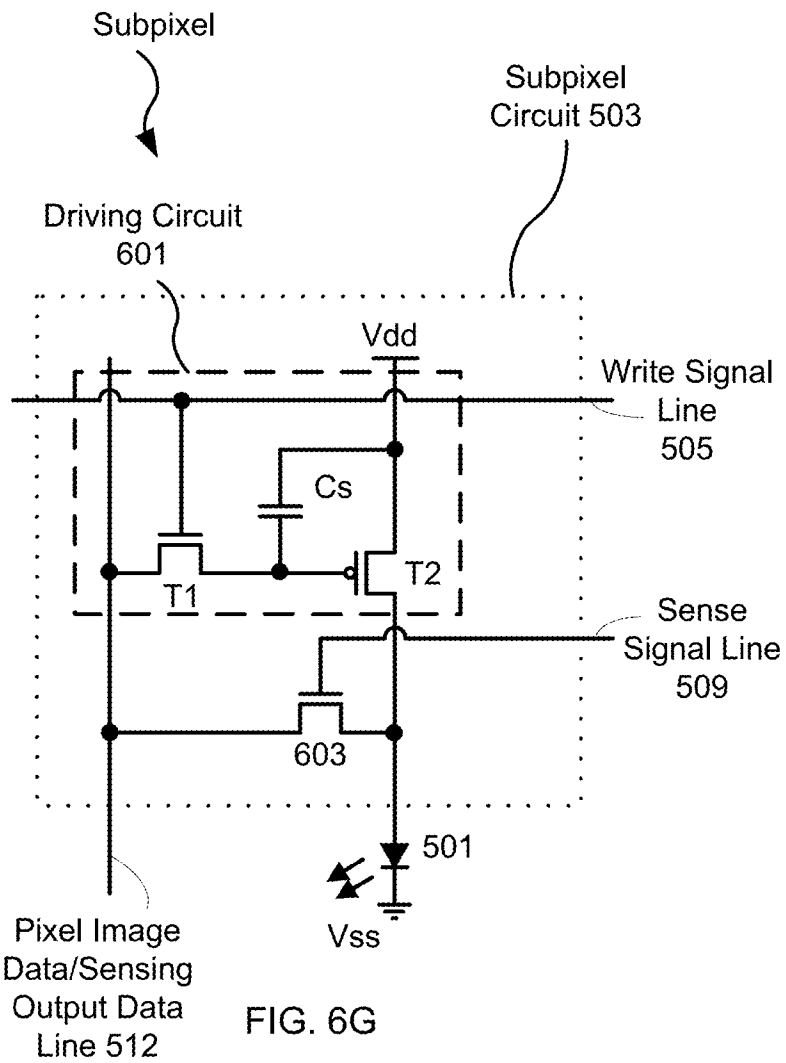
Figure 6J:
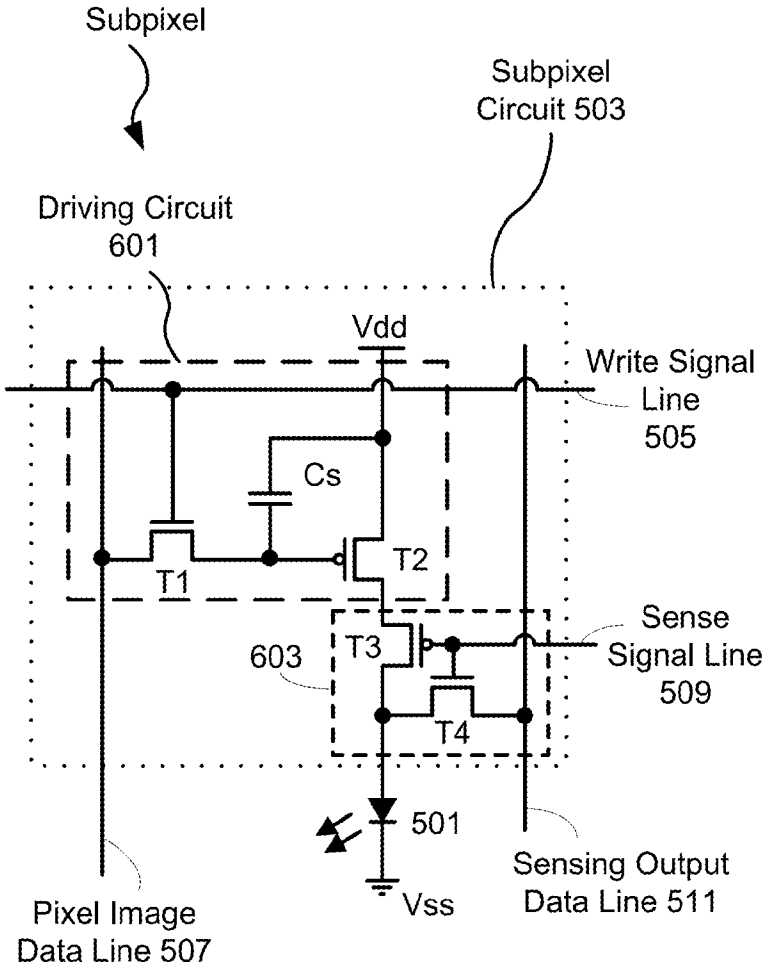
Figure 6I:
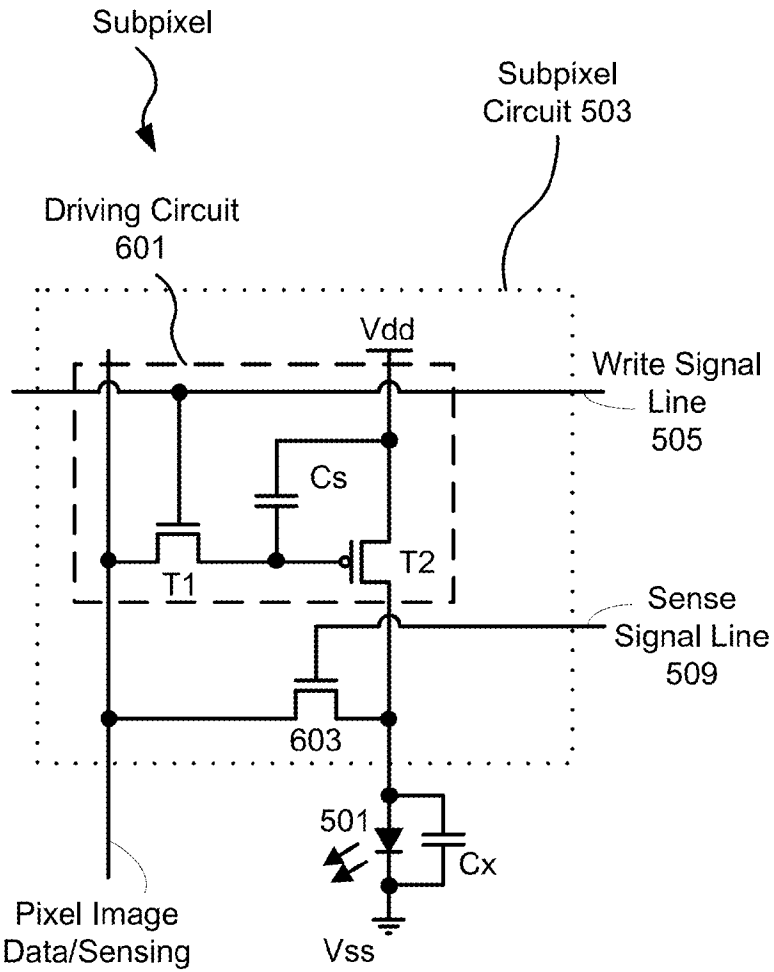
Figure 6L:
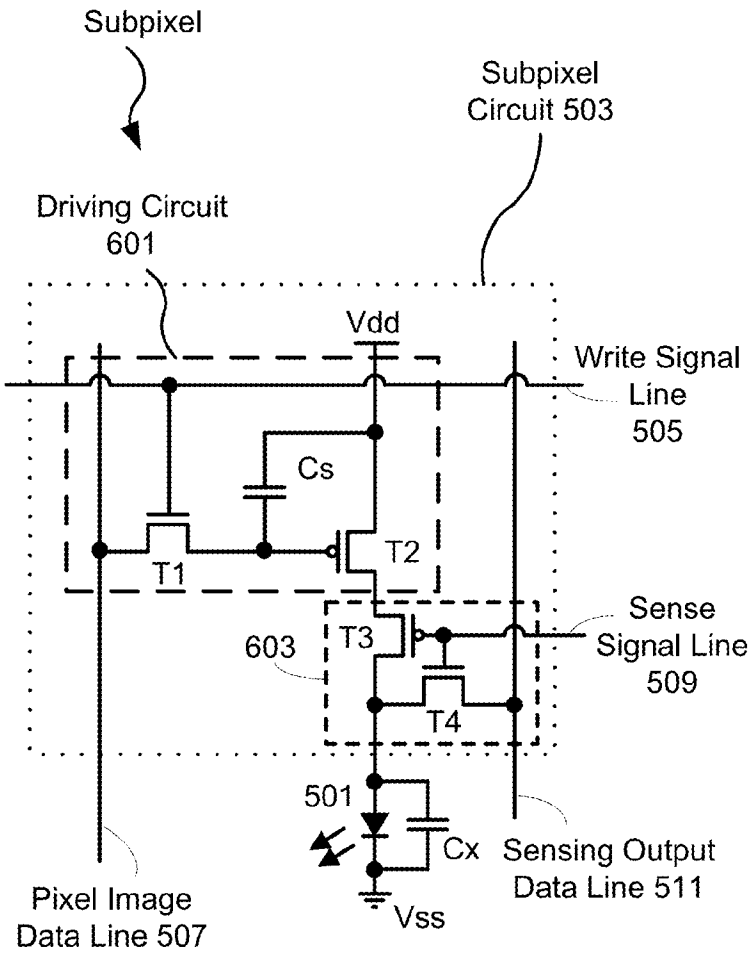
Figure 6K:
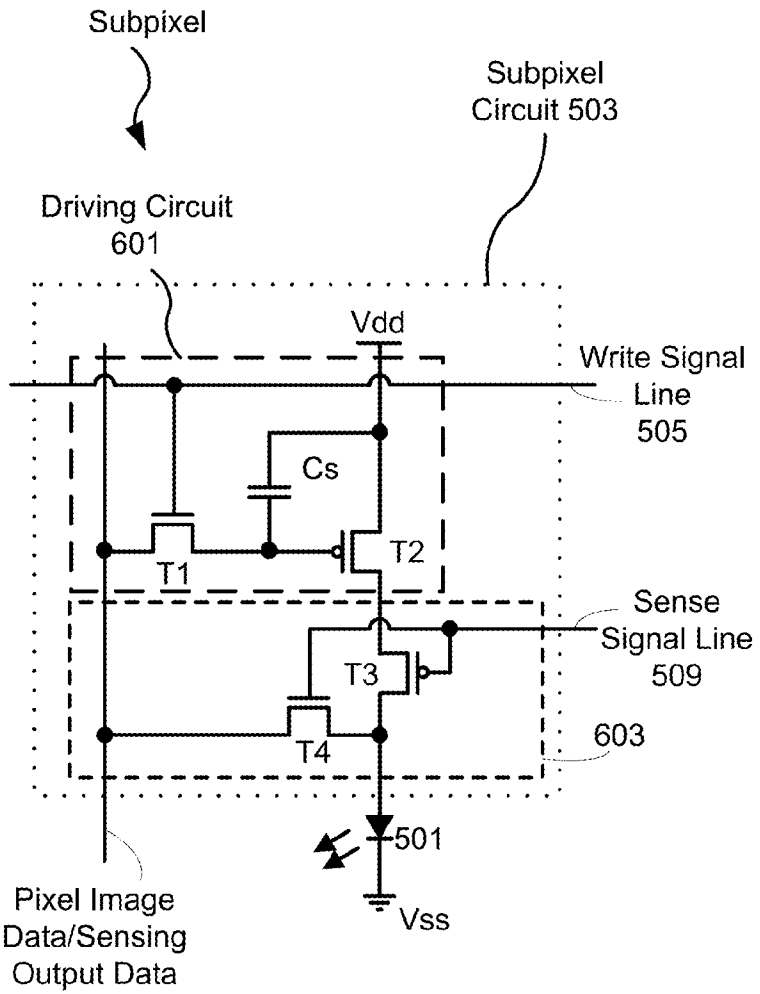
Figure 6N:
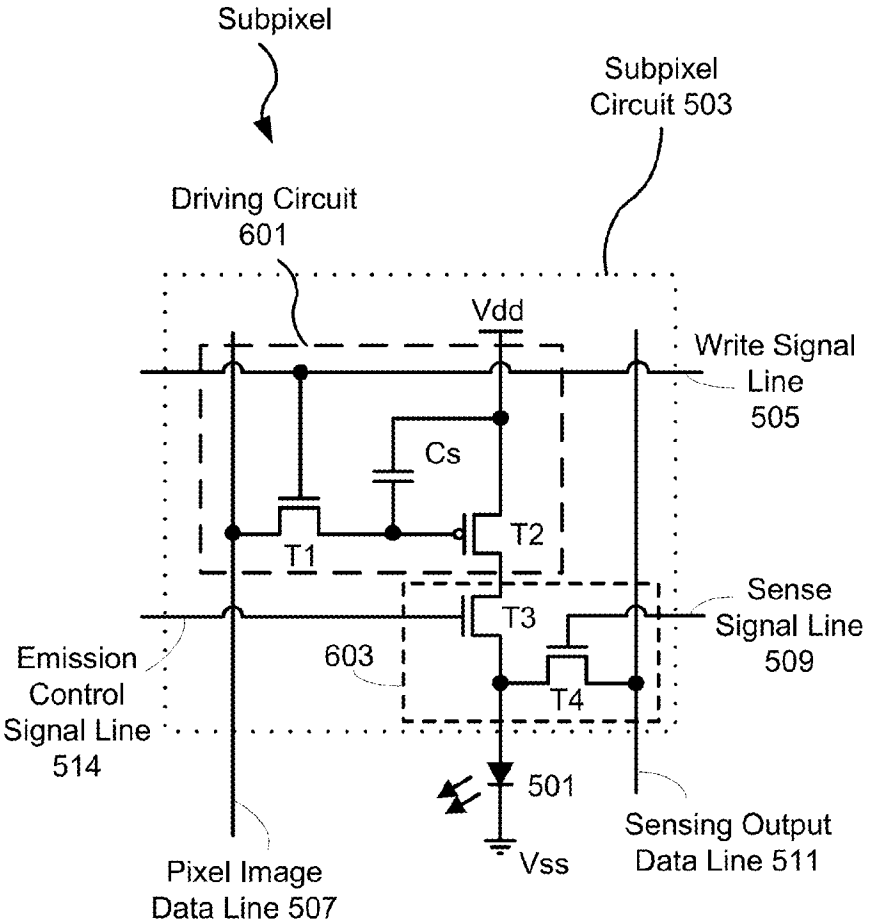
Figure 6M:
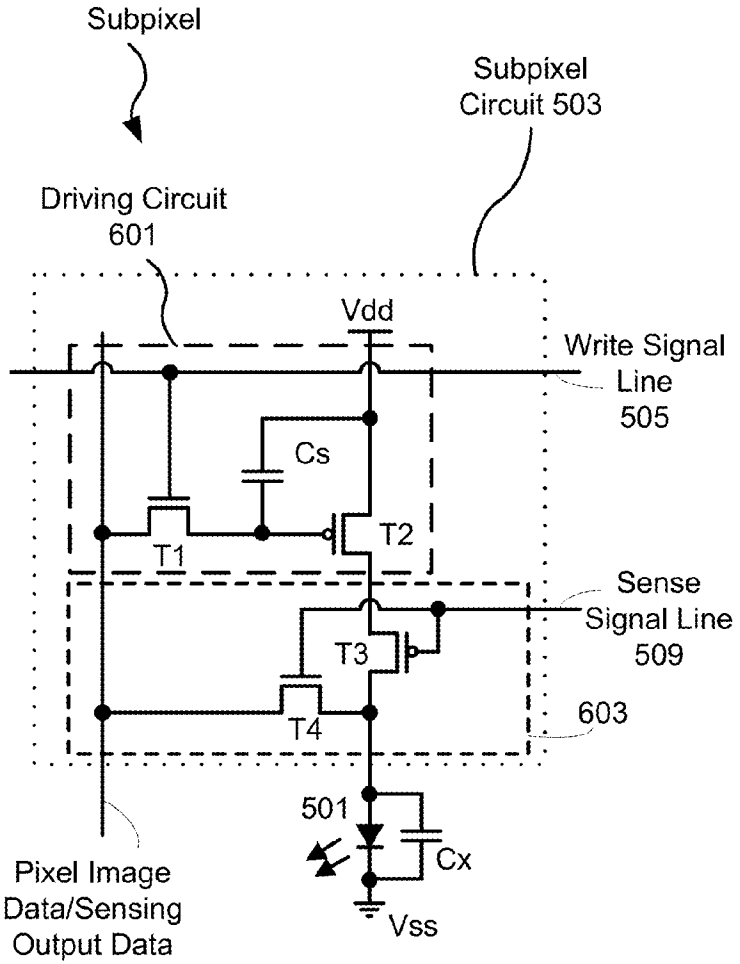
Figure 6P:
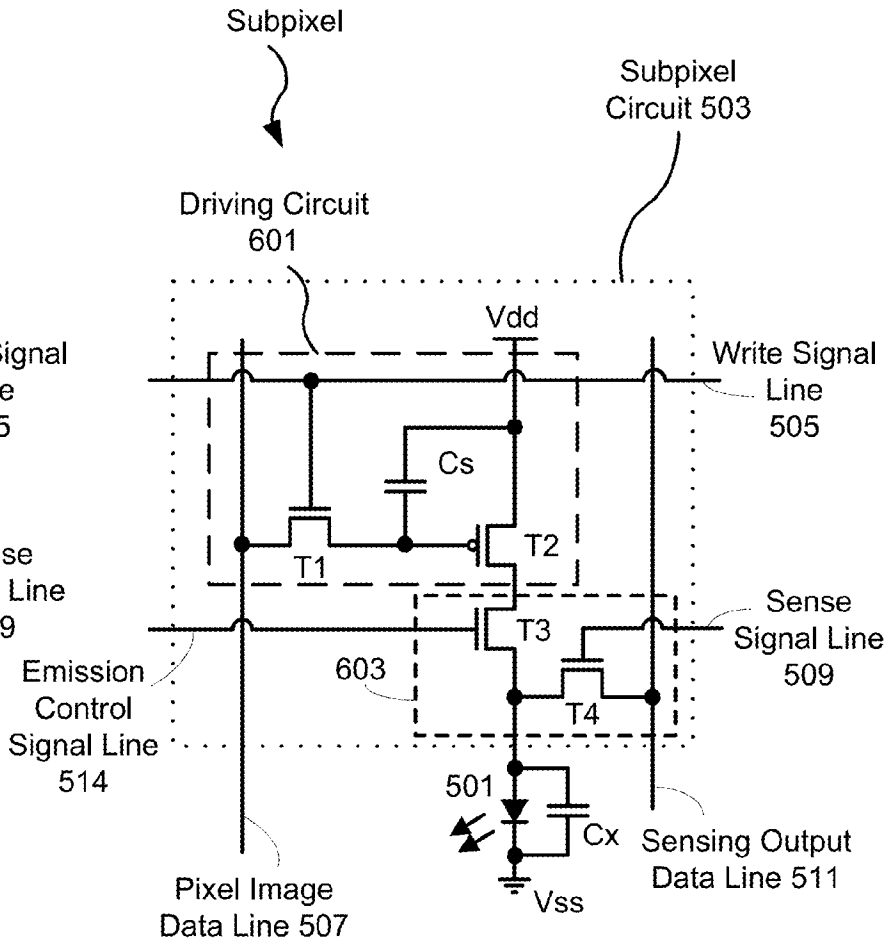
Figure 6O:
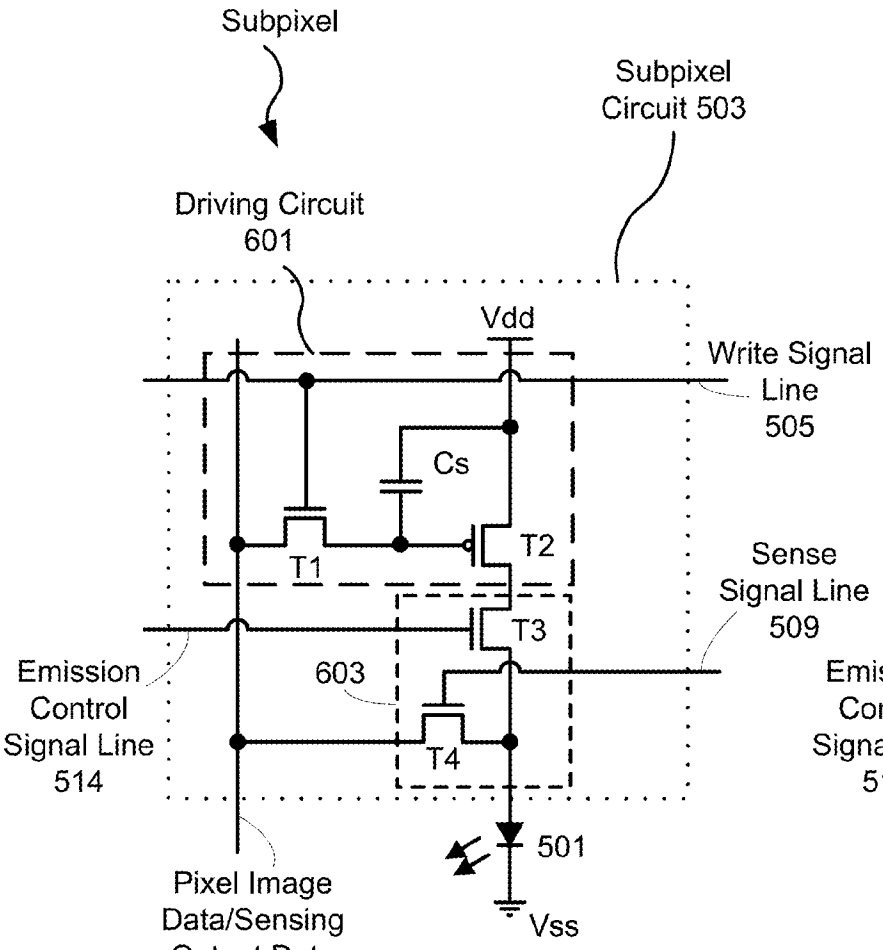
Figure 6Q:
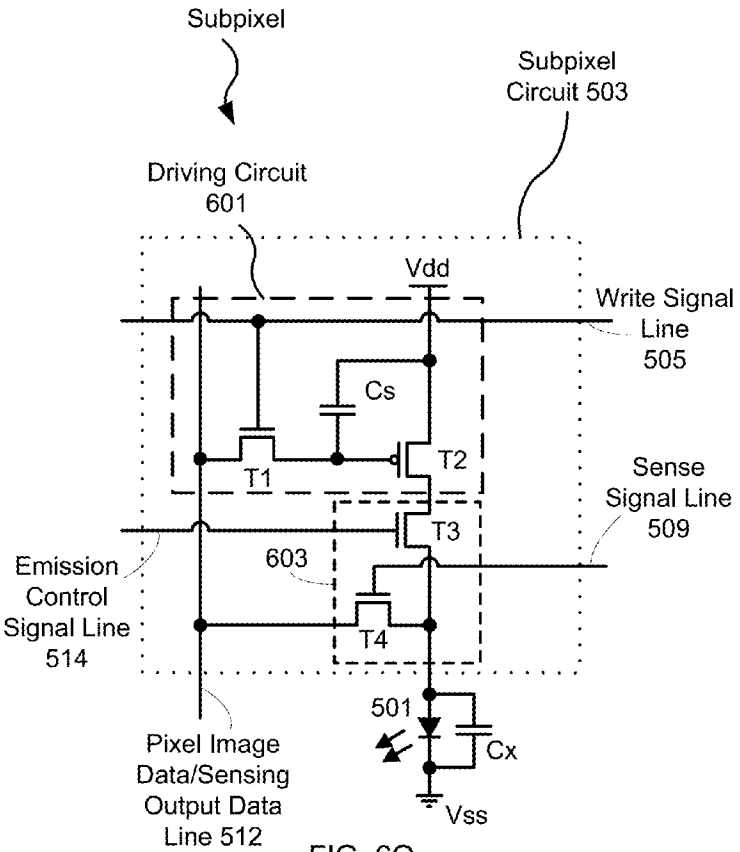

FIGS. 6B-6Q are circuit diagrams of embodiments of FIG. 6A having various arrangements of a driving circuit, a selection device, a pixel image data/sensing output data line, and an exposure capacitor in accordance with embodiments. The embodiments depicted in FIGS. 6B-6Q are illustrated to show exemplary designs of the driving circuit 601, selection device 603, and LED 501, but are not intended to limit embodiments of the present invention.

In FIG. 6B, an embodiment of FIG. 6A is illustrated with a subpixel circuit formed of a driving circuit 601 and a selection device 603. The driving circuit 601 is an exemplary 2T1C circuit for ease of explanation, as the 2T1C circuitry is basic and easily understandable. The 2T1C circuit includes a switching transistor T1, a driving transistor T2, and a storage capacitor Cs. Although the embodiment depicted in FIG. 6B illustrates the switching transistor T1 as an NMOS transistor and the driving transistor T2 as a PMOS transistor, embodiments are not limited to such transistor arrangements. The switching transistor T1 and the driving transistor T2 may each be an NMOS, PMOS, or any other transistor device. The switching transistor T1 has a gate electrode connected to a write signal line 505 and a first source/drain electrode connected to a pixel image data line 507. The driving transistor T2 has a gate electrode connected to a second source/drain electrode of the switching transistor T1 and a first source/drain electrode connected to a power source Vdd. The storage capacitor Cs is connected between the gate electrode of the driving transistor T2 and the first source/drain electrode of the driving transistor T2.

The selection device 603 is connected to a second source/drain electrode of the driving transistor T2, the sensing output data line 511, the sense signal line 509, and an anode electrode of the LED 501. A cathode of the LED 501 is connected to ground (Vss). In one embodiment, the selection device 603 is a multiplexer. Alternatively, the selection device 603 is another selection device that selects the sensing output data line 511 based upon an activated sense signal 224 applied through the sense signal line 509. In an embodiment, the write signal line 505 and the sense signal line 509 are activated for different subpixels in different rows within the display panel 119. For example, where the write signal line 505 is selected in row X, the sense signal line 509 may be selected in row X+1 (the row immediately below), X−1 (the row immediately above), or any other row within the display panel 119.

The driving transistor T2 may be connected to the LED 501 by a selection device 603, such as a multiplexer. The multiplexer can select between the driving transistor T2 and the sensing output data line 511 to electrically couple to the LED 501 depending upon the value of the sense signal 224 in the sense signal line 509. The transistors T1 and T2 can be any type of transistor, such as an NMOS or PMOS transistor. For example, as shown in FIG. 6B, the switching transistor T1 is an NMOS transistor and the driving transistor T2 is a PMOS transistor.

In an embodiment, the pixel image data line 507 and the sensing output data line 511 are merged into one pixel image data/sensing output data line 512, as shown in FIG. 6C. The pixel image data/sensing output data line 512 is one line that performs the operations of both the pixel image data line 507 and the sensing output data line 511. As such, the selection device, such as a multiplexer, can select between the driving transistor T2 or the pixel image data/sensing output data line 512 to electrically couple to the LED 501 depending upon the value of the sense signal 224 in the sense signal line 509. Combining the two metal lines decreases layout clutter and overlapping metal lines, which decreases an amount of parasitic capacitance created in the metal layers. As such, combining the metal lines reduces power consumption and decreases an amount of occupied real estate on the display panel. For example, in FIG. 6B, the overlapping metal lines at the intersection of the write signal line 505 and the sensing output data line 511, and at the intersection of the sense signal line 509 and the sensing output data line 511 may be eliminated with the use of the single pixel image data/sensing output data line 512, as illustrated in FIG. 6C.

In FIG. 6D, a driving circuit 601 is electrically coupled to a selection device 603, such as a multiplexer. In an embodiment, the driving circuit design illustrated in FIG. 6D is similar to the driving circuit 601 design described in FIG. 6A above. A sensing output data line 511 is also electrically coupled to the selection device 603. In an embodiment depicted in FIG. 6E, the sensing output data line 511 is merged with the pixel image data line 507 to form a single pixel image data/sensing output data line 512 for reasons disclosed above in FIG. 6C. Referring back to FIG. 6D, an LED 501 is connected to the selection device 603. In an embodiment illustrated in FIG. 6E, an exposure capacitor Cx is connected in parallel with the LED 501. The exposure capacitor Cx may be used to determine an intensity of light sensed by the LED 501, as will be discussed in more detail in FIGS. 7C-7E further below.

Furthermore, in FIG. 6F, an embodiment of FIG. 6A is illustrated with a selection device 603 formed of a selection transistor. The selection transistor may be one transistor such as an NMOS or PMOS transistor, or any other transistor device. The sense signal line 509 is electrically coupled to a gate electrode of the selection transistor. A first source/drain electrode of the selection transistor is electrically coupled to the second source/drain electrode of the driving transistor T2. Additionally, a second source/drain electrode of the selection transistor is electrically coupled to the sensing output data line 511. In embodiments, the selection transistor is turned ON when the sense signal 224 is activated. The selection transistor turns ON to select a sensing circuit, such as the sense receiver 115, to electrically couple an LED 501 to the sensing circuit through a sensing output data line 511. Once the selection transistor is turned ON, in an embodiment, current will flow from the LED 501 as well as the driving circuit 601 into the sense receiver 115 through the sensing output data line 511. Alternatively, in an embodiment, the driving circuit 601 may be turned OFF when the selection transistor is turned ON so that current flows from only the LED 501 into the sense receiver 115. In an embodiment depicted in FIG. 6G, the sensing output data line 511 is merged with the pixel image data line 507 to form a single pixel image data/sensing output data line 512 for reasons discussed above in FIG. 6C. Furthermore, in an embodiment depicted in FIG. 6H, an exposure capacitor Cx is connected in parallel to the LED 501 for reasons that will be discussed below. Even further, in an embodiment depicted in FIG. 6I, the sensing output data line 511 is merged with the pixel image data line 507 to form a single pixel image data/sensing output data line 512, and an exposure capacitor Cx is connected in parallel to the LED 501.

In FIG. 6J, an embodiment of FIG. 6A is illustrated with a selection device 603 formed of two selection transistors: an emission-selection transistor T3 and a sense-selection transistor T4. The second source/drain electrode of the driving transistor T2 is electrically coupled to a first source/drain electrode of the emission-selection transistor T3. A second source/drain electrode of the emission-selection transistor T3 is electrically coupled to a first source/drain electrode of the sense-selection transistor T4 and the anode electrode of the LED 501. A second source/drain electrode of the sense-selection transistor T4 is electrically coupled to the sensing output data line 511. The sense signal line 509 is electrically coupled to both gate electrodes of the transistors T3 and T4.

The emission-selection transistor T3 is formed of a type of transistor, such as NMOS or PMOS transistor, that is the opposite of the type of transistor of which the sense-selection transistor T4 is formed. For example, in an embodiment, the emission-selection transistor T3 is formed of an NMOS transistor and the sense-selection transistor T4 is formed of a PMOS transistor, and vice versa. As such, when the sense signal 224 is activated through the sense signal line 509, either the emission-selection transistor T3 or the sense-selection transistor T4 is turned ON, but not both. Turning the emission-selection transistor T3 ON selects the driving circuit 601 so that the driving circuit 601 is electrically coupled to the LED 501, whereas turning the emission-selection transistor T3 OFF deselects the driving circuit 601 so that the driving circuit 601 is not electrically coupled to the LED 501. Additionally, turning the sense-selection transistor T4 ON selects the sensing output data line coupled to the sensing circuit, such as sense receiver 115, so that the sensing circuit is electrically coupled to the LED 501, whereas turning the sense-selection transistor T4 OFF deselects the sensing circuit so that the sensing circuit is not electrically coupled to the LED 501. In an embodiment depicted in FIG. 6K, the sensing output data line 511 is merged with the pixel image data line 507 to form a single pixel image data/sensing output data line 512 for reasons discussed above in FIG. 6C. Furthermore, in an embodiment depicted in FIG. 6L, an exposure capacitor Cx is connected in parallel to the LED 501 for reasons that will be discussed below. Even further, in an embodiment depicted in FIG. 6M, the sensing output data line 511 is merged with the pixel image data line 507 to form a single pixel image data/sensing output data line 512, and an exposure capacitor Cx is connected in parallel to the LED 501.

In FIG. 6N, an embodiment of FIG. 6A is illustrated with a selection device 603 formed of two selection transistors: an emission-selection transistor T3 and a sense-selection transistor T4. The second source/drain electrode of the driving transistor T2 is electrically coupled to a first source/drain electrode of the emission-selection transistor T3. A second source/drain electrode of the emission-selection transistor T3 is electrically coupled to a first source/drain electrode of the sense-selection transistor T4 and the anode electrode of the LED 501. A second source/drain electrode of the sensing sense-selection T4 is electrically coupled to the sensing output data line 511. An emission control signal line 514 is electrically coupled to a gate electrode of the emission-selection transistor T3, and the sense signal line 509 is electrically coupled to a gate electrode of the sense-selection transistor T4. In an embodiment, the emission control signal line 514 is coupled to the write controller 113, which activates or deactivates emission control signals through the emission control signal line 514. In an embodiment, the selection device 603 is a pass multiplexer.

The transistors T3 and T4 may be formed of an NMOS or PMOS transistor, or any other type of transistor. In an embodiment, the emission-selection transistor T3 is formed of the same type of transistor as the sense-selection transistor T4. Alternatively, in an embodiment, emission-selection transistor T3 is formed of a different type of transistor as the sense-selection transistor T4. The emission-selection transistor T3 and the sense-selection transistor T4 are controlled by two separate control lines: the emission control line 514 and the sense signal line 509. As such, the emission-selection transistor T3 may be controlled independently from the sense-selection transistor T4 so that the sense-selection transistor T4 may be turned ON whether or not the emission-selection transistor T3 is turned ON or OFF. Turning the emission-selection transistor T3 and the sense-selection transistor T4 ON and OFF selects/deselects the driving circuit 601 and sensing circuit, respectively, according to the disclosure above in FIG. 6J. In an embodiment depicted in FIG. 6O, the sensing output data line 511 is merged with the pixel image data line 507 to form a single pixel image data/sensing output data line 512 for reasons discussed above in FIG. 6C. Furthermore, in an embodiment depicted in FIG. 6P, an exposure capacitor Cx is connected in parallel to the LED 501 for reasons that will be discussed below. Even further, in an embodiment depicted in FIG. 6Q, the sensing output data line 511 is merged with the pixel image data line 507 to form a single pixel image data/sensing output data line 512, and an exposure capacitor Cx is connected in parallel to the LED 501.

Figure 6R:
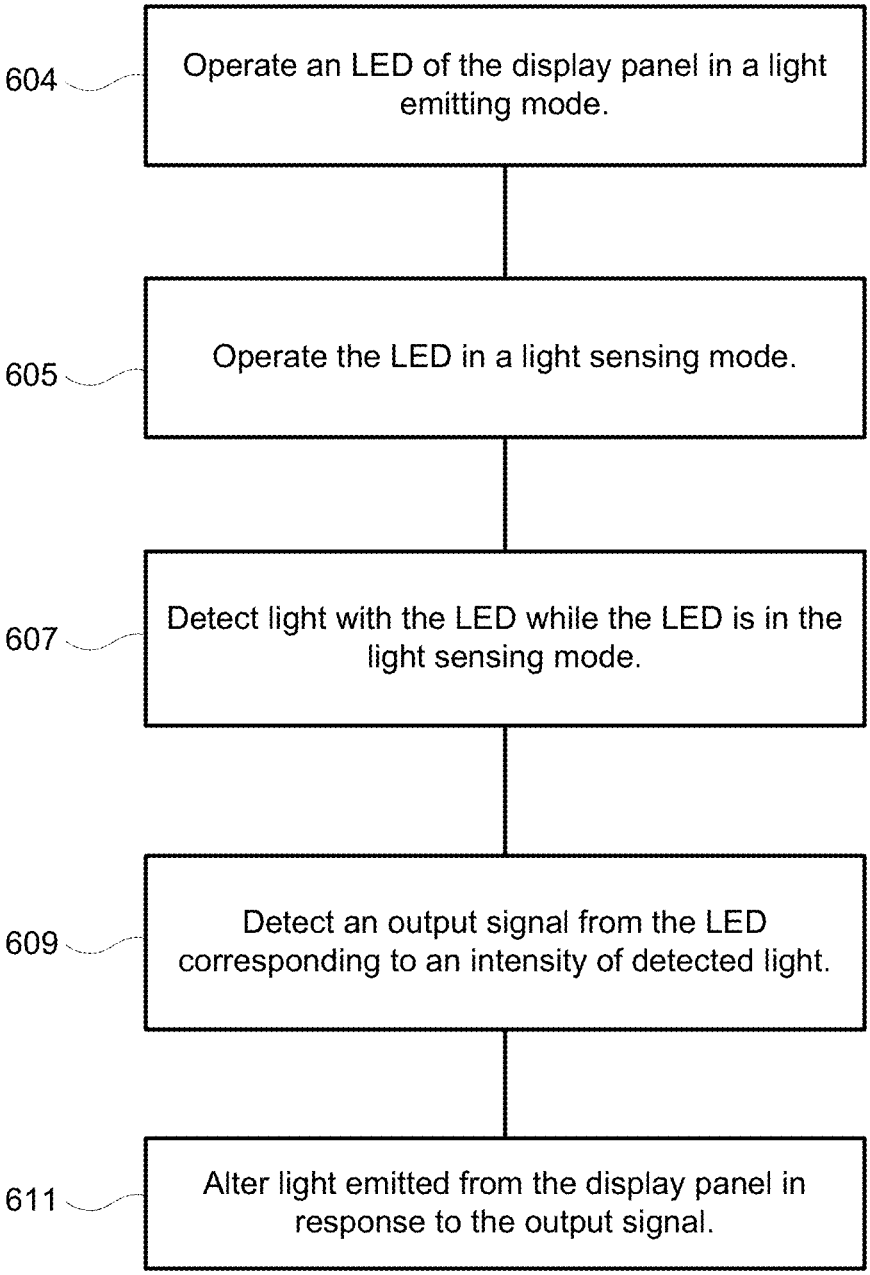

A method of sensing light with an emissive LED in an interactive display panel 119 according to an embodiment is illustrated in FIG. 6R. At 604, the LED is operated in a light emission mode. Operating the LED in the light emission mode includes forward biasing the LED to emit light. At 605, the LED is operated in a light sensing mode. Operating the LED in the light sensing mode does not have to occur immediately after operating the LED in the light emission mode. In an embodiment, the LED is operated in the light sensing mode after an occurrence where the LED is not emitting light, such as when the storage capacitor Cs is being written with pixel image data. Operating the LED in the light sensing mode includes non-forward biasing the LED, such as reverse or zero biasing the LED, to detect light. In an embodiment, the LED operates in a light sensing mode after a selection device 603 selects a sensing output data line to electrically couple a sensing circuit to the LED in response to a sense signal 224. In an embodiment, operating the LED in the light sensing mode includes writing to the storage capacitor Cs while the sensing circuit is electrically coupled to the LED. That is, the storage capacitor Cs can be written with image data at the same time the LED is non-forward biased to sense light.

In an embodiment, the selection device 603 is a multiplexer within a subpixel of the display panel 119 as shown above in FIGS. 6B-6E. The multiplexer performs the selection by selecting the sensing circuit, such as sense receiver 115, by selecting the sensing output data line, and deselecting the driving circuit 601 in response to the sense signal 224. In embodiments, selecting the sensing circuit electrically couples the sensing circuit to the LED. Additionally, deselecting the driving circuit 601 electrically uncouples the driving circuit 601 to the LED. In this embodiment, deselecting the driving circuit 601 occurs simultaneously with selecting the sensing circuit.

Alternatively, in an embodiment, the selection device 603 is a selection transistor within a subpixel of the display panel 119 as shown above in FIGS. 6F-6I. The selection transistor selects the sensing circuit by selecting the sensing output data line when the selection transistor is turned ON. The selection transistor is turned ON when the sense signal 224 is activated. As such, current flows into the sensing circuit from both the driving circuit, if turned ON, and the LED 501.

In an embodiment, the selection device 603 is a pair of opposite-type emission-selection and sense-selection transistors T3 and T4, respectively, within a subpixel of the display panel 119 as shown above in FIGS. 6J-6M. The selection device 603 selects the sensing circuit by selecting the sensing output data line when the sense signal 224 is activated to turn ON the sense-selection transistor T4 and turn OFF the emission-selection transistor T3, thus deselecting the driving circuit 601. As such, current only flows into the sensing circuit from either the driving circuit or the LED 501.

Furthermore, in an embodiment, the selection device 603 is a pair of independently controlled emission- and sense-selection transistors T3 and T4, respectively, within a subpixel of the display panel 119 as shown above in FIGS. 6N-6Q. The selection device 603 selects the sensing circuit by selecting the sensing output data line when the sense signal 224 is activated to turn ON the sense-selection transistor T4. In an embodiment, the sensing circuit is selected when the sense signal 224 is activated to turn ON the sense-selection transistor T4 while an emission control signal is deactivated to turn OFF the emission-selection transistor T3, thus deselecting the driving circuit 601. As such, current from only the LED 501 flows into the sensing circuit, such as sense receiver 115. Alternatively, in an embodiment, the sensing circuit is selected when the sense signal 224 is activated to turn ON the sense-selection transistor T4 while an emission control signal is activated to turn ON the emission-selection transistor T3. As such, current flows into the sensing circuit from both the LED 501 and the driving circuit 601, if turned ON.

Referring again to FIG. 6R, at 607, the non-forward biased LED detects light in the light sensing mode and generates an output signal corresponding to an intensity of the detected light as described herein. In an embodiment, the detected light is ambient light or light emitted from another LED located on the interactive display panel 119.

At 609, the sense receiver 115 detects the output signal from the LED within the sensing circuit. The output signal, in an embodiment, is a current flow with a magnitude corresponding to the intensity of light sensed by the first LED. Alternatively, in an embodiment, the output signal is a voltage with a magnitude corresponding to the intensity of light sensed by the first LED. The sense receiver 115 monitors the sensing output data line 511 and detects a change in current flow or a voltage amount from the LED when light is detected. For example, a greater intensity of sensed light results in a higher magnitude of current flow or voltage amount. In an embodiment, the sense receiver 115 sends the output signal to the output processor 123 through the sense timing controller 121.

At 611, the output processor 123 alters light emitted from the display panel 119 in response to the output signal received from the sense timing controller 121. In an embodiment, light emitted from the display panel 119, in whole or in part, increases or decreases. Alternatively, in an embodiment, the pattern of light emitted from the display panel 119 changes to display a different image. In embodiments, the output processor 123 is coupled to a system memory 105 carrying instructions that, when executed by the output processor, the output processor alters light emission for a number of operations. For example, the output processor 123 can alter light emission for one or more of ambient light detection, ambient light proximity detection, reflected light proximity detection, ambient light object location determination, reflected light object location determination, surface profile determination, and display panel calibration as mentioned above. Such operations are discussed in more detail below.

Figure 7A:
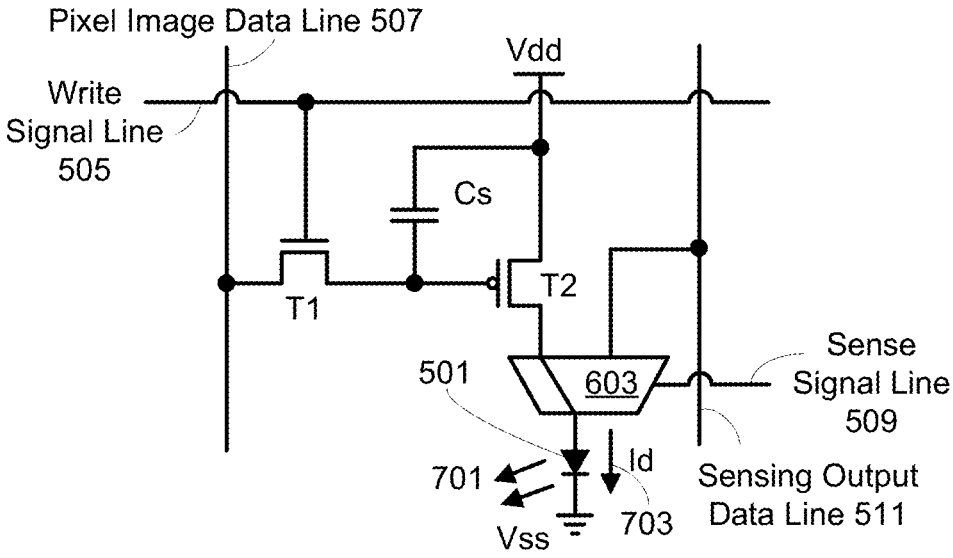
FIGS. 7A and 7B are circuit diagrams of different operational states of a subpixel in accordance with an embodiment.
Figure 7B:
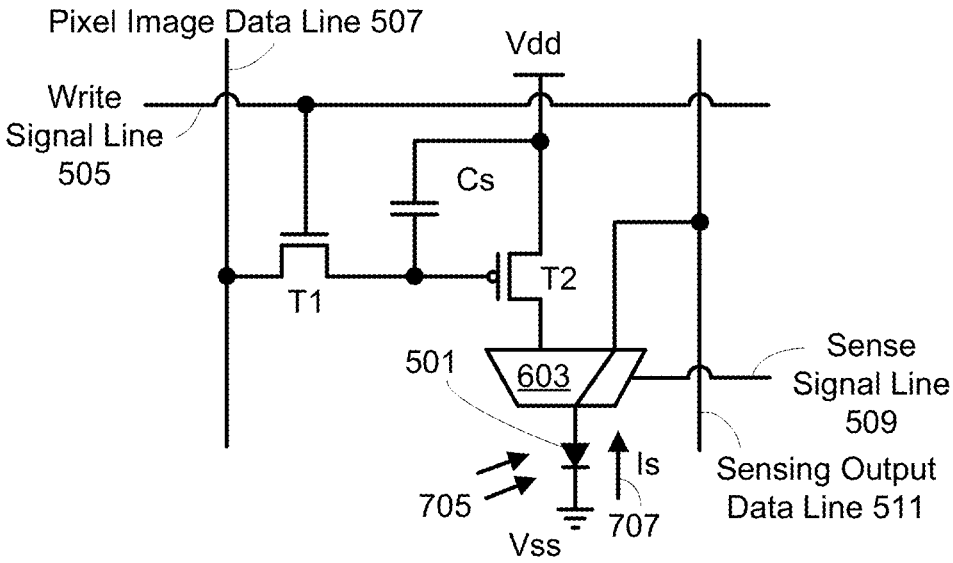
Figure 7C:
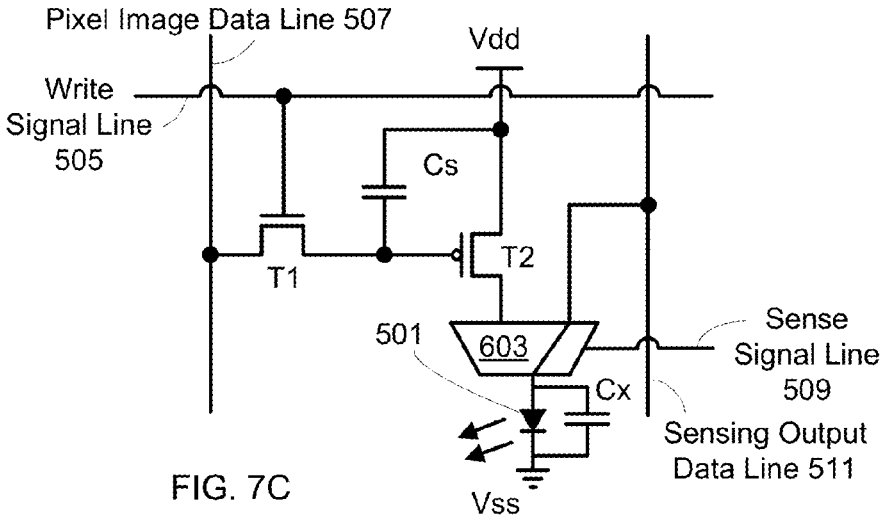
FIGS. 7C-7E are circuit diagrams of different operational states of a subpixel with an exposure capacitor in accordance with an embodiment.
Figure 7D:
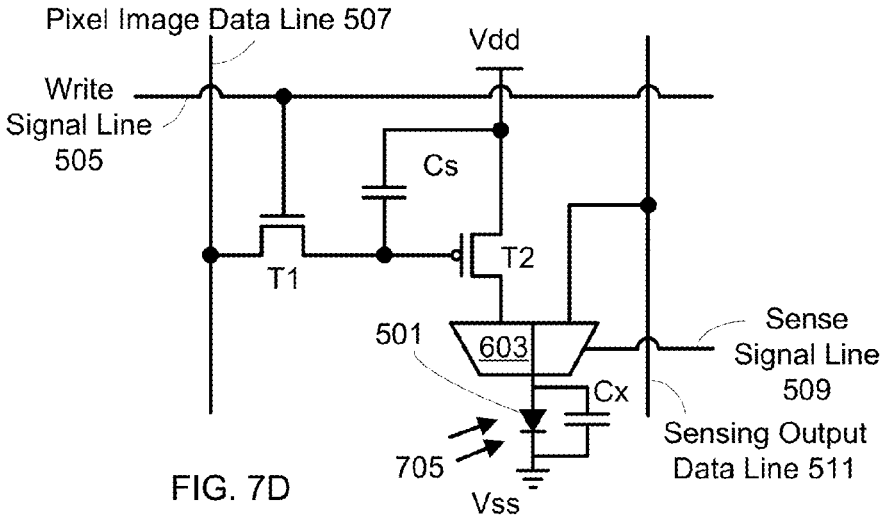
Figure 7E:
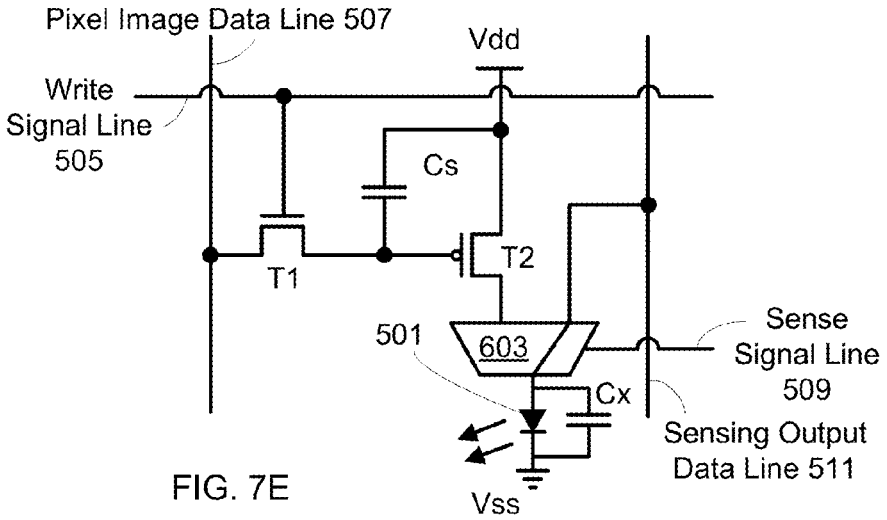

During operation, the LED 501 may be forward biased to emit light and non-forward biased to sense light depending upon the electrical connection made by the selection device 603. FIGS. 7A and 7B illustrate exemplary circuit diagrams for forward biasing and non-forward biasing an LED in accordance with an embodiment. FIGS. 7C-7E illustrate exemplary circuit diagrams for sensing light with an LED connected in parallel with an exposure capacitor in accordance with an embodiment. Similar to the description above, FIGS. 7A-7E illustrate basic 2T1C driving circuits to show how the driving and sensing circuits operate together in an easily understandable circuit arrangement. As such, embodiments are not so limited to such operations and circuit arrangements.

In FIG. 7A, a subpixel is written with pixel image data and the LED 501 is forward biased to emit light. Initially, a write signal from the write signal line 505 may be activated (ON) to apply a voltage to a gate electrode of a switching transistor T1. The activated write signal may turn on the switching transistor T1 to apply a pixel image data voltage from a pixel image data line 507 to a storage capacitor Cs, which then may store the image data voltage. Thereafter, the write signal may be deactivated (OFF) to turn off the switching transistor T1, which now completes writing to the subpixel. To emit light, a deactivated (OFF) sense signal may be sent to a selection device 603 to connect T2 of the driving circuit to an LED 501. The selection device 603, although depicted in the embodiment of FIG. 7A as a multiplexer, may be a selection transistor or a pair of transistors as disclosed above in FIGS. 6B-6Q, or any other selection device disclosed herein. The storage capacitor Cs may turn on the driving transistor T2 with the stored image data 112 voltage to allow a corresponding driving current, Id 703, to flow across the driving transistor T2 and through the LED 501. Accordingly, the driving current 703 causes the LED 501 to be operated in a light emission mode to emit light 701 with a brightness corresponding to the magnitude of the image data 112 voltage.

In FIG. 7B, the operation of driving an LED in non-forward bias and sensing light from the LED 501 is illustrated in accordance with an embodiment. The selection device 603 may select the sensing output data line 511 to select and electrically couple the LED 501 to the sensing circuit through the sensing output data line 511 in response to an activated (ON) sense signal from the sense signal line 509. A non-forward bias voltage 228, such as a reverse or zero bias voltage, may then be applied to the LED 501 from the sense receiver 115 through the sensing output data line 511 to operate the LED 501 in a light sensing mode. For example, sensing output data line 511 is driven with a negative potential, which results in a reverse biasing of LED 501. In reverse bias mode, charge accumulates on the anode and cathode of the LED 501 from the reverse bias voltage and causes the LED 501 to be sensitive to light. In zero bias mode, the sensing output data line 511 is not driven with any voltage such that charge accumulates on the anode and cathode of the LED 501 from exposure to light. As external light 705 is projected on the non-forward biased LED 501, a corresponding sensing signal in the form of a current, Is 707, is induced across the LED 501 and through the sensing output data line 511. As such, the sensing signal 707 may flow through the sensing output data line 511 with a magnitude corresponding to the intensity of light sensed by the LED 501.

With reference to FIGS. 7C-7E, the operation of sensing light with an LED 501 connected in parallel with an exposure capacitor Cx is illustrated. In FIG. 7C, the LED 501 is connected in parallel with the exposure capacitor Cx, both of which are coupled to the sensing output data line 511 through a selection device 603, such as a multiplexer. A non-forward bias voltage, such as a reverse bias voltage or zero bias voltage, may be applied through the sensing output data line 511 from the sense receiver 115. In FIG. 7D, the LED 501 and the exposure capacitor Cx are electrically disconnected from any circuit by the selection device 603. In an embodiment, a cathode of the LED 501 and a first plate of the exposure capacitor Cx are connected to ground Vss. Additionally, an anode of the LED 501 and a second plate of the exposure capacitor Cx are electrically isolated, thus floating the LED 501 and the exposure capacitor Cx. Due to the stored negative potential within the exposure capacitor Cx, the LED 501 is non-forward biased and therefore sensitive to light 705. When light 705 is sensed by the LED 501, current may be generated through the parallel circuit and cause the exposure capacitor Cx to lose a proportionate amount of charge. In an embodiment, the LED 501 senses for a set amount of exposure time. Generally, longer exposure times result in stronger, more accurate sensing output signals. In FIG. 7E, the LED 501 and the exposure capacitor Cx are reconnected to the sensing output data line 511. The sense receiver 115 may determine the remaining potential stored in the exposure capacitor and determine the intensity of light 705 sensed by the LED 501.

Figure 8A:
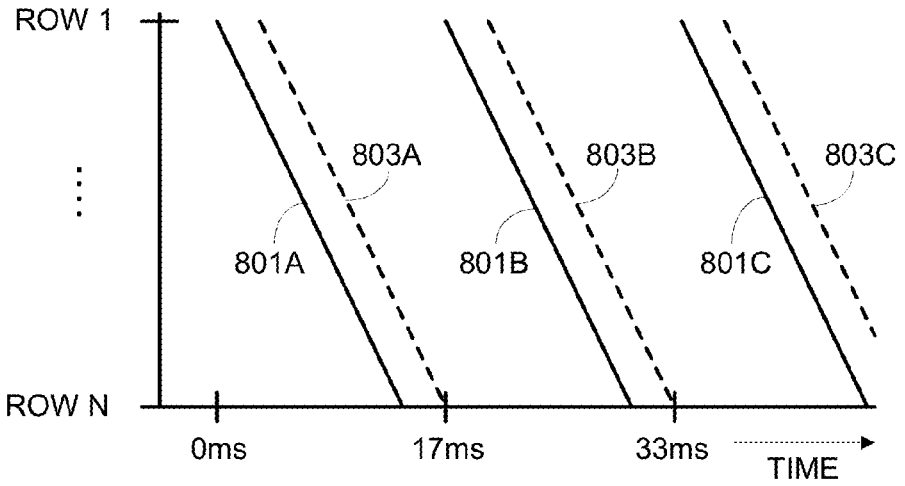
FIGS. 8A-8C are charts illustrating write and sense signal timing schemes in accordance with embodiments.
Figure 8B:
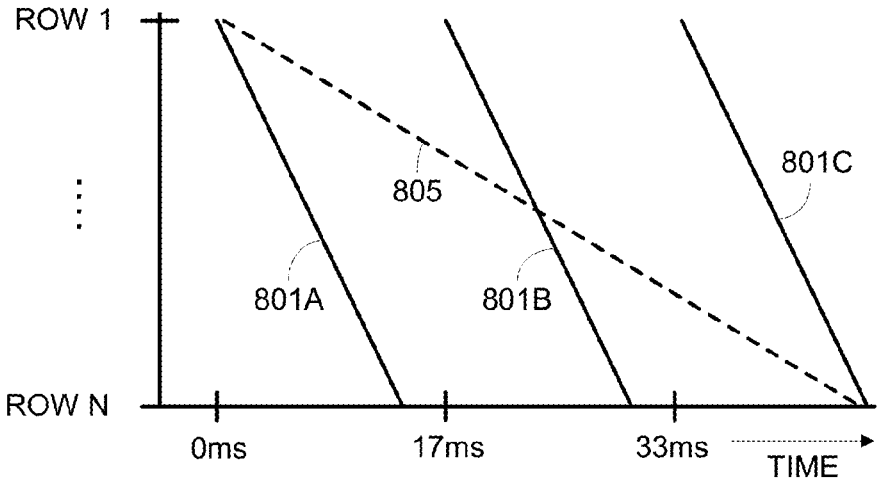
Figure 8C:
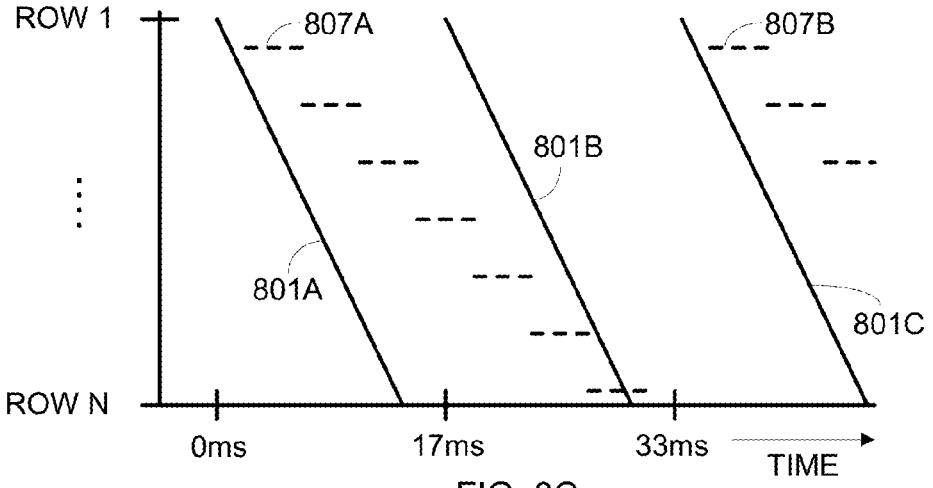
Figure 8D:
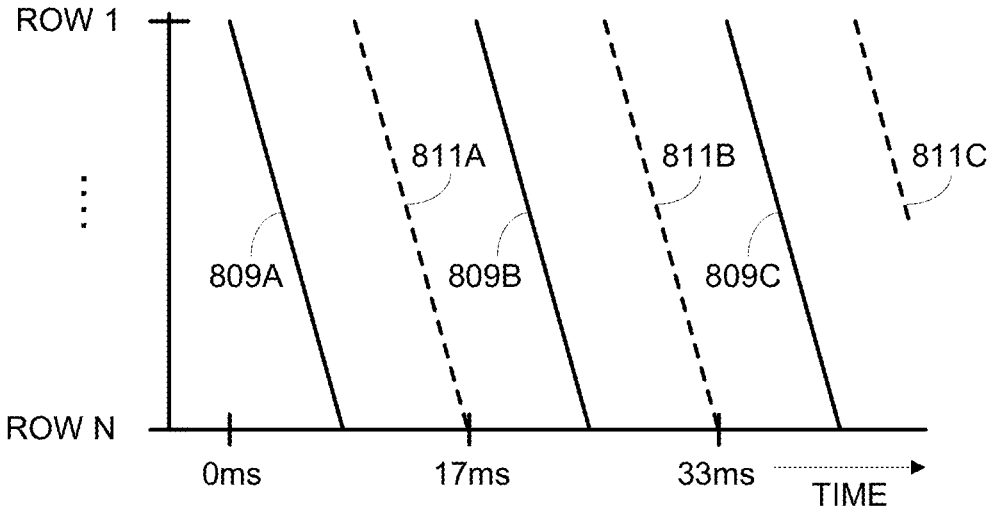
FIGS. 8D-8E are charts illustrating write and sense signal timing schemes for subpixels with a pixel image data/sensing output data line in accordance with embodiments.
Figure 8E:
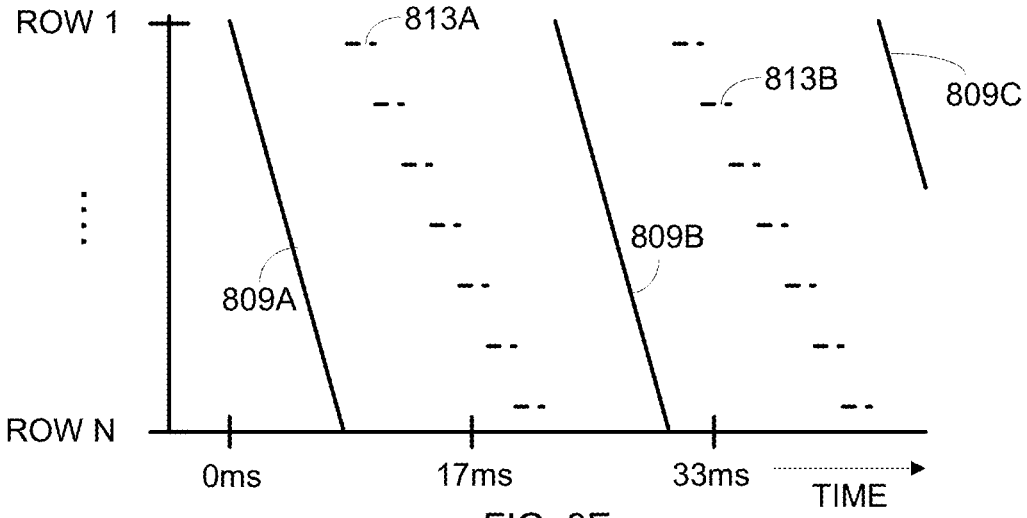

The frequency at which writing image data and reading sensing signals are performed may dictate the balance between sensing strength and display refresh rate. Generally, higher sensing strengths lead to more accurate sensing results whereas higher display refresh rates lead to smoother display operation. FIGS. 8A-8C depict exemplary charts of writing and reading timing schemes for display panels containing decoupled pixel image data lines 507 and sensing output data lines 511 during interactive operation (i.e., simultaneous sensing and emitting operation) according to embodiments. FIGS. 8D-8E illustrate exemplary charts of writing and reading timing schemes for display panels containing one pixel image data/sensing output data line 512 during interactive operation according to embodiments. The Y-axis represents rows of a display panel, such as display panel 119, in descending sequential order. The X-axis represents time in milliseconds in ascending sequential order.

FIG. 8A illustrates writing cycles 801 and reading cycles 803 for writing image data to and reading sensing signals from a display panel containing decoupled pixel image data lines 507 and sensing output data lines 511 at the same frequency. In an embodiment, the master timing controller 127, as discussed above, may control the timing synchronization of writing and reading cycles based on a timing scheme. Three writing cycles 801A-801C and reading cycles 803A-803C are illustrated for purposes of ease of explanation. It is to be appreciated that many more cycles are performed during typical interactive operation and that embodiments are not limited to only three cycles. In one embodiment, each writing cycle 801 writes image data (e.g., using write signal 222) to a display panel starting from ROW 1 to ROW N in sequential order. Similarly, each reading cycle 803 reads sensed light (e.g., using sense signal 224) from the display panel from ROW 1 to ROW N in sequential order. Accordingly, as illustrated in FIG. 8A, each writing and reading cycle 801 and 803 has a negative slope when plotted with respect to time. Writing and reading frequency may be determined by the speed at which each writing and reading cycle 801 and 803 is performed. Generally, higher frequencies result in steeper negative slopes. Therefore, as shown in FIG. 8A, writing and reading cycles 801 and 803 that are performed at the same frequency have the same negative slope. In one embodiment, both writing and reading cycles are performed at a frequency of 60 Hz. Both writing and reading cycles may also be performed at 120 Hz, 240 Hz, or a higher frequency. In this embodiment, because both frequencies are high, the display operation may be smooth and the sensing operation may be highly sensitive. One example where this may be beneficial is when the display panel is running a gaming application. In such instances, the display panel can display a smooth image while being highly responsive to input coordinates.

Although the writing and reading frequencies may be the same in some embodiments, the writing and reading frequencies may be different in other embodiments. That is, the writing frequency may be higher or lower than the reading frequency. FIG. 8B illustrates an embodiment where the writing frequency is higher than the reading frequency. Three writing cycles 801A-801C and one reading cycle 805 are illustrated for purposes of ease of explanation. It is to be appreciated that many more cycles are performed during typical interactive operation and that embodiments are not so limited. In the embodiment depicted in FIG. 8B, because the writing cycles 801 are performed at a higher frequency than the reading cycle 805, the slope of the writing cycles 801 is steeper than the slope of the reading cycle 805. The slope of the reading cycle 805 depicted in FIG. 8B is such that one reading cycle expands across three writing cycles 801A-801C. This means that in this particular embodiment the display panel is written three times before the display panel is read once. In one embodiment, at the instances when the reading and writing cycles intersect, the row is being written and read at the same time. For example, a storage capacitor for a red LED can be written with a new pixel image data value while the red LED is sensing light. In one embodiment, the writing cycle frequency is 60 Hz while the reading cycle frequency is 20 Hz. Reducing the frequency at which the display panel senses may achieve stronger sensing signals because each row is sensed for a longer period of time. However, the tradeoff may be a decrease in sensing responsiveness. As such, a lower reading frequency may be utilized when the display panel is constantly displaying images with minimal user interaction, such as when the display panel is playing a video.

While the display panel may write image data to and read sensing signals from all rows of the display panel in some embodiments, other embodiments may not read sense data from all rows of the display panel. FIG. 8C illustrates an embodiment where the display panel containing decoupled pixel image data lines 507 and sensing output data lines 511 writes to all rows of the display panel but reads sensing signals from only certain rows of the display panel. Three writing cycles 801A-801C and one full reading cycle 807 are illustrated for purposes of ease of explanation. It is to be appreciated that many more cycles are performed during typical interactive operation. As shown in FIG. 8C, each writing cycle is one single, continuous line as image data is written to rows 1 to N in sequential order. Accordingly, every row of the display panel is written with image data. On the other hand, the reading cycle 807 is a discontinuous set of horizontal lines because sensing signals are read from only certain rows of the display panel. Although not every row is read, an extended read-out time can be applied to each row that is read as illustrated by the horizontal lines. Sensing each row for an extended period of time may result in a stronger, more fully developed sensing signal. However, the resulting effect may be a tradeoff between sensing spatial resolution and signal strength. A possible further disadvantage of longer read-out times may be that the row emits dimmer light due to less emission time. In response to this shortcoming, higher driving currents may be applied to these rows to compensate for their short emission time. An instance when decreasing spatial resolution in exchange for stronger signal strength is desired includes when the display panel is used for touch applications in which high spatial resolution for sensing is not needed because the size of a human finger likely spans several rows.

Reading and writing operations for embodiments where the pixel image data line 507 and sensing output data line 511 are integrated into a pixel image data/sensing output data line 512, as discussed above, may have different timing schemes. FIG. 8D illustrates writing cycles 809 and reading cycles 911 for writing image data to and reading sensing signals from a display panel containing a pixel image data/sensing output data line 512 at a same frequency. In embodiments, the master timing controller 127 controls the timing synchronization of write cycles and read cycles. Three writing cycles 809A-809C and reading cycles 811A-811C are illustrated for purposes of ease of explanation. It is to be appreciated that many more cycles are performed during typical interactive operation and that embodiments are not limited to only three cycles. In this embodiment, the line used to write data, i.e., the pixel image data line 507, and the line used to read data, the sensing output data line 511, are merged into one pixel image data/sensing output data line 512. As such, a reading cycle 811 or writing cycle 809 cannot be performed at the same time due to the conflicting uses of the two operations. As shown in FIG. 8D, the writing cycles 809A-809C are not performed simultaneously with reading cycles 811A-811C. Thus, to perform one cycle of read and one cycle of write within the same amount of time as a decoupled pixel image data line 507 and sensing output data line 511, the negative slope of the reading and writing cycles 809 and 811 is greater than the slope of the reading and writing cycles 801 and 803 in FIG. 8A.

FIG. 8E illustrates an embodiment where the display panel containing a pixel image data/sensing output data line 512 writes to all rows of the display panel but reads from only certain rows of the display panel. Each writing cycle 809 is one single, continuous line and each reading cycle 813 is a discontinuous set of horizontal lines for reasons discussed above in FIG. 8C. An extended read-out time is applied to each row that is read as illustrated by the horizontal lines. Because the write and read cycles 809 and 813 cannot be performed at the same time, the write cycles 809 do not vertically overlap with the reading cycles 813. As such, the frequency at which the writing and reading cycles 809 and 813 are performed may be higher than the frequency at which the writing and reading cycles 801 and 803 of a display panel containing decoupled pixel image data lines 507 and sensing output data lines 511, e.g. as shown FIG. 8C, are performed.

A processor, such as the input processor 101 or output processor 123 from FIG. 1, may determine the frequency at which the display panel is written and read. Depending on what type of application is being run, the processor may indicate to the master timing controller to read and write at suitable frequencies according to a timing scheme. Additionally a user may have the ability to change the read and write speed.

Figure 8F:
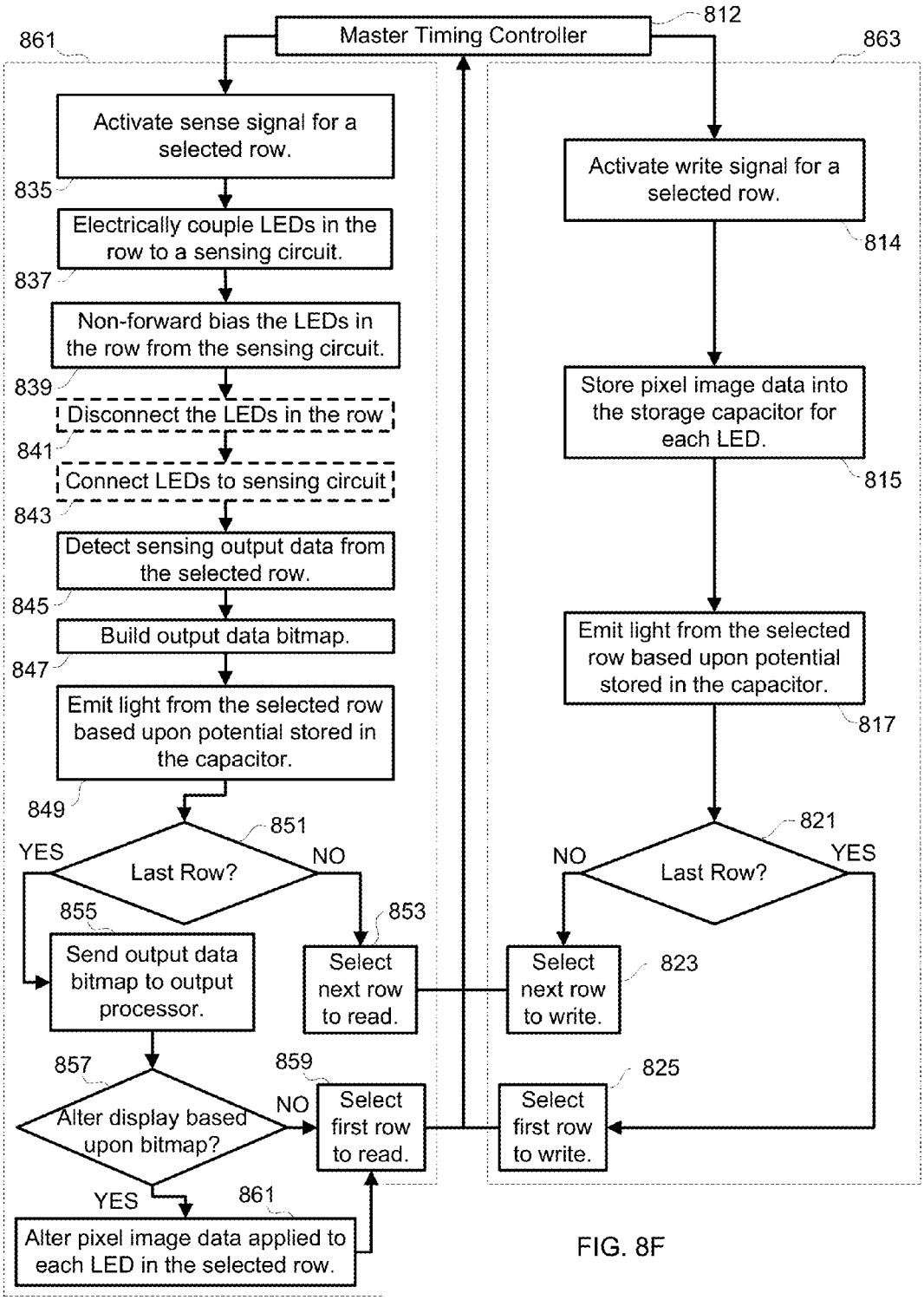
FIG. 8F is a flow chart of a method of operating an interactive display panel in accordance with an embodiment.

FIG. 8F is a flow chart that illustrates an exemplary method of operating the interactive display panel 119 from a high-level perspective. At 812, the master timing controller, e.g., 127 from FIG. 1, sends timing signals to the write and sense timing controllers, e.g., 113 and 117, respectively, from FIGS. 1 and 2, according to a timing scheme. As mentioned above, the timing scheme may be determined by the input or output processor 101 or 123, respectively. The write and sense timing controllers may operate the read operation 861 and the write operation 863 according to the timing signals received from the master timing controller. The read and write operations 861 and 863 can be performed according to the timing schemes illustrated above in FIGS. 8A-8D. As such, the read operation 861 can be performed simultaneously and independently of the write operation 863 as shown in FIGS. 8A-8C, or be performed independently but without any vertical overlap as shown in FIGS. 8D-8E.

For the read operation, at 835, the sense signal, e.g., 224 from FIG. 2, is activated for a selected row, e.g., the selected sense row 202 from FIG. 2. In an embodiment, the selected row is the next incremental row or the first row of the display panel, as determined by the sense controller 117. At 837, the selection device 603 selects a sensing output data line coupled with a sensing circuit such that the LED 501 is electrically couple to the sensing circuit, such as sense receiver 115.

At 839, the sense receiver 115 non-forward biases the selected row through the sensing output data lines 511 or 512 with a non-forward biasing voltage, such as a reverse or zero bias voltage, to operate the selected row in a light sensing mode. As the selected row is exposed to light, a voltage may be generated across the LED 501 or a current may be generated through the LED 501 and into the sensing output data line 511/512. In one embodiment, the LED 501 is connected in parallel with an exposure capacitor Cx as disclosed in FIGS. 6D-6E, 6H-6I, 6L-6M, and 6P-6Q above. In this embodiment, when the non-forward bias voltage, such as a reverse bias voltage, is applied to the LED 501 and the charge capacitor Cx, the applied reverse bias voltage is stored on the exposure capacitor Cx.

In the embodiment where the LED 501 is connected in parallel with a charge capacitor Cx, at 841, the selection device 603, such as a multiplexer, disconnects the LED and the exposure capacitor Cx in the selected row. The dotted lines indicate unique operations that are performed for display panels with pixels configured with an LED 501 connected in parallel with an exposure capacitor Cx. When the LED 501 is disconnected, the LED 501 may sense light and cause the stored charge within the exposure capacitor to leak out at a rate proportionate to the amount of light sensed by the LED 501. In an embodiment, an exposure time determines the amount of time that the LED 501 and exposure capacitor Cx are disconnected. Generally, longer exposure times result in stronger, more accurate output sense signals. Once the exposure time has passed, at 843, the LED 501 and exposure capacitor Cx are reconnected to the sensing circuit.

At 845, for display panels that do not have exposure capacitors Cx, the sense receiver 115 detects the change in current or voltage from one or more LEDs within the selected row through the respective sensing output data line 511 or 512. The change in current or voltage may be the sensing output data 230, as described above, which corresponds to the intensity of light sensed by the LED 501. At 847, the sense timing controller 121 receives the sensing output data from the sense receiver 115 and builds an output data bitmap, such as display panel sensing data 125. On the other hand, for display panels that do have exposure capacitors Cx, at 845, the sense receiver 115 may detect the change in voltage from one or more exposure capacitors Cx within the selected row through the respective sensing output data line 511 or 512 and builds an output data bitmap at 847. In embodiments, the change in voltage may be the sensing output data 230, as described above, which may correspond to the intensity of light sensed by the LED 501. The sense timing controller 121 may build an output data bitmap by storing the sensing output data in its position in the bitmap.

At 849, the selection device 603 selects a driving circuit 601 based upon the sense signal 224 within the sense signal line 509. In an embodiment, the anode electrode of the LED 501 electrically couples to a driving transistor in a driving circuit, e.g., 601 in FIG. 7A. The driving circuit 601 operates the LED 501 in a light emission mode by forward biasing the LED 501 to emit light. In an embodiment, the LED 501 emits light corresponding to a potential stored in the storage capacitor, e.g., pixel image data 226 from a write cycle.

At 851, the sense controller 117 determines whether the selected row is the last visible row in the current sense cycle. If the selected row is not the last visible row, at 853, the sense controller 117 selects the next visible row to sense light. Furthermore, the sense timing controller 121 may indicate to the master timing controller 127 that one sense operation has been completed. At 812, the master timing controller receives the indication that the sense operation has been completed and sends the next timing signal 128 to sense or write data depending on the timing scheme discussed above. If, however, the selected row is the last visible row in the display panel 119, at 855, the sense receiver 115 sends the completed output data bitmap representing the display panel sensing data 125 to the output processor 123. In an embodiment, if the selected row is the last visible row in the display panel 119, the write controller 113 can proceed to select dummy rows, if any, or to a vertical blanking phase, after which the sense receiver 115 sends the completed output data bitmap to the output processor 123.

At 857, the output processor 123 determines, based on the received display panel sensing data 125, whether or not the emission pattern or intensity of the display panel needs to be altered. Determining whether or not the emission pattern or intensity of the display panel needs to be altered can be based upon several different circumstances, as will be discussed in detail further below. If the output processor 123 determines that the display panel 119 needs to alter its emission pattern or intensity, at 861, the pixel image data 226 for one or more rows is altered. At 859, the first row of the display panel 119 is selected by the sense controller, and the method returns to the master timing controller at 812. If the output processor 123 determines that the display panel 119 does not need to alter its emission pattern or intensity, the first row is selected by the sense controller at 859, and the method returns to the master timing controller at 812.

For the write operation 863, at 814, the write signal, e.g., 222 from FIG. 2, is activated for a selected row, e.g., the selected write row 201 from FIG. 2. In an embodiment, the selected row is the next incremental row or the first row of the display panel, as determined by the write controller 113. At 815, the pixel image data 226 is stored by the driving circuit, e.g., on a storage capacitor Cs. The pixel image data 226 indicates the intensity at which the LED is to emit light.

At 817, the selection device 603 selects a driving circuit 601. In an embodiment, selecting the driving circuit 601 is performed simultaneously with deselecting the sensing circuit. In an embodiment, the anode electrode of the LED 501 electrically couples with a driving transistor in a driving circuit, e.g., 601 in FIG. 7A. The driving circuit 601 forward biases the LED 501 to operate the LED 501 in a light emission mode to emit light. In an embodiment, the LED 501 emits light corresponding to a potential stored in the storage capacitor, e.g., pixel image data 226 from a write cycle.

At 821, the write controller 113 determines whether the selected row is the last visible row in the current write cycle. If the selected row is not the last visible row, at 823, the write controller 113 selects the next row to sense light. Furthermore, the write timing controller 109 indicates to the master timing controller that one write operation has been completed. At 812, the master timing controller 127 receives the indication that the write operation has been completed and sends the next timing signal 128 to sense or write data depending on the timing scheme discussed above. If, however, the selected row is the last visible row in the display panel 119, at 825, the first row of the display panel 119 is selected by the write controller, and the method returns to the master timing controller at 812. In an embodiment, if the selected row is the last visible row in the display panel 119, the write controller 113 can proceed to select dummy rows, if any, or to a vertical blanking phase, after which the method selects the first row of the display panel at 825.

The output processor 123 may be configured to perform a number of operations by utilizing the display and sensing capabilities of the interactive display panel to alter the display based upon the display panel sensing data 125 according to embodiments. As mentioned above, the output processor 123 may be configured to perform a variety of operations, such as: (1) brighten or dim a display panel in response to an amount of ambient light (ambient light detection), (2) turn a display panel on or off in response to an object's proximity to the display panel by sensing ambient light (ambient light proximity detection) or reflected light (reflected light proximity detection), (3) determine the location of an object relative to the dimensions of the display panel by sensing ambient light (ambient light object location detection) or by sensing reflected light (reflected light object location determination), (4) determine a surface profile of a target object by sensing reflected light (surface profile determination), and (5) calibrate display panel uniformity (display panel calibration). Because such operations are not exclusive of one another, the output processor 123 may be configured to perform more than one operation.

Figure 9A:
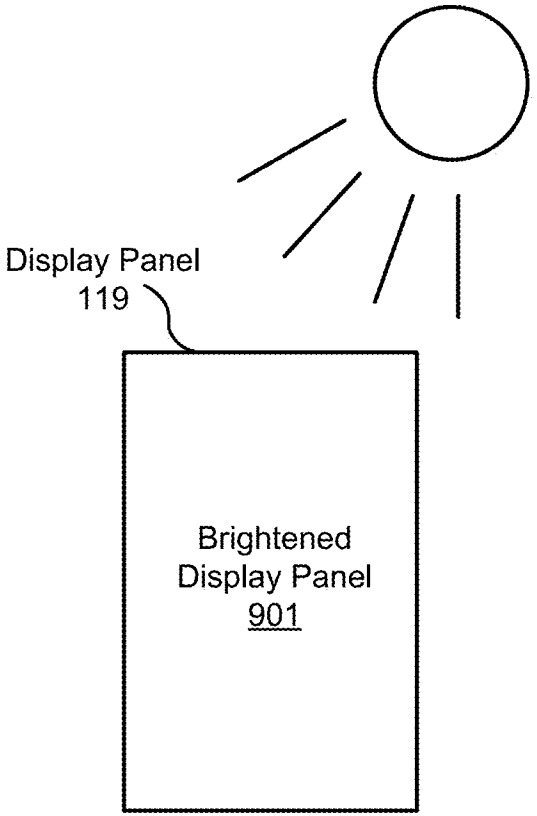
FIGS. 9A-9C illustrate an operation of an interactive display panel with a processor configured for ambient light detection in accordance with an embodiment.
Figure 9B:
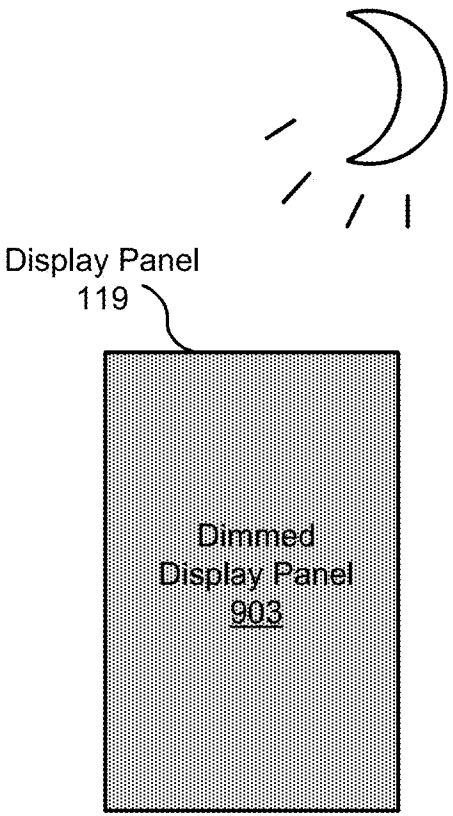
Figure 9C:
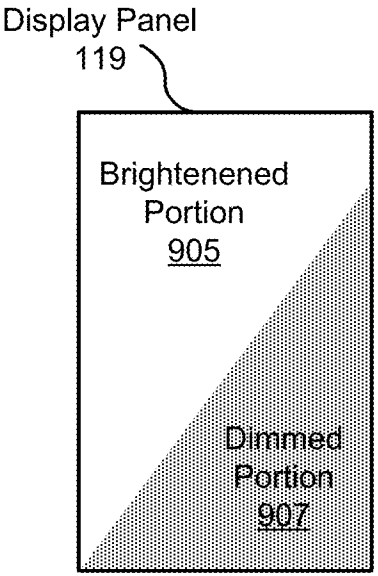

FIGS. 9A-9C illustrate exemplary operations performed by the interactive display system 100 with an output processor 123 configured for ambient light detection. The output processor 123 may be configured to increase or decrease the brightness of the display panel 119 in response to ambient light. The output processor 123 may receive a bitmap or other representation of light intensities sensed by LEDs, such as the LEDs 501 in the display panel 119. The sensed light intensities may represent every LED in the display panel 119 or only a portion of the LEDs within the display panel 119. For example, one row of LEDs may be sensing ambient light while another row of LEDs is emitting light, or one LED within a row may be sensing ambient light while surrounding LEDs within the same row are emitting light. With the bitmap of sensed light intensities, the output processor 123 may calculate the total ambient light intensity sensed by the LEDs. Thereafter, the output processor 123 may compare the total ambient light intensity to a control value and send feedback data to the input processor 101. In an embodiment, the control value is determined by an algorithm programmed by a designer. The algorithm may calculate the control value based upon a number of different variables established by the designer. Additionally, in an embodiment, the control value is a max value or a degree of change. If the total ambient light intensity is greater than the control value, then the feedback data includes a signal to increase the brightness of the entire display panel 119 or otherwise operate the LEDs of the display panel 119 at an intensity corresponding to the ambient light. If, however, the total brightness is less than the control value, then the feedback data includes a signal to decrease the brightness of the entire display panel 119 or otherwise operate the LEDs of the display panel 119 at an intensity corresponding to the ambient light. For example, as shown in FIG. 9A, if a display panel 119 is operating outside on a sunny day where ambient light is bright, the output processor 123 would send feedback data to the input processor 101 to increase the brightness of the display panel 119, resulting in a brightened display panel 901. On the other hand, as shown in FIG. 9B, if the display panel 119 is operating outside at night or indoors where it is relatively dark, the output processor 123 would send feedback data to the input processor 101 to decrease the brightness, resulting in a dimmed display panel 903. That way, the display panel 119 would not be too bright when used indoors or too dark on a bright, sunny day.

Rather than adjusting the brightness of the entire display panel 119, the output processor 123 may adjust the brightness of a portion of the display panel 119 as depicted in FIG. 9C. In one such embodiment, the output processor 123 is configured to compare each pixel's sensed light intensity with the control value and adjust the brightness of each pixel accordingly. If a portion 907 of the display panel 119 senses less ambient light while portion 905 of the display panel senses more ambient light 905 (e.g., a shadow cast across the portion 907, or glare on the portion 905 of display panel 119), the output processor 123 may be configured to increase the drive voltage for the portion 905 of pixels that are displaying under more light to increase light emission and brighten portion 905, or decrease the drive voltage for the portion 907 of pixels that are displaying under less light to decrease light emission and dim portion 907. As a result, the perceived display brightness may be substantially consistent across the display panel 119.

Figure 9D:
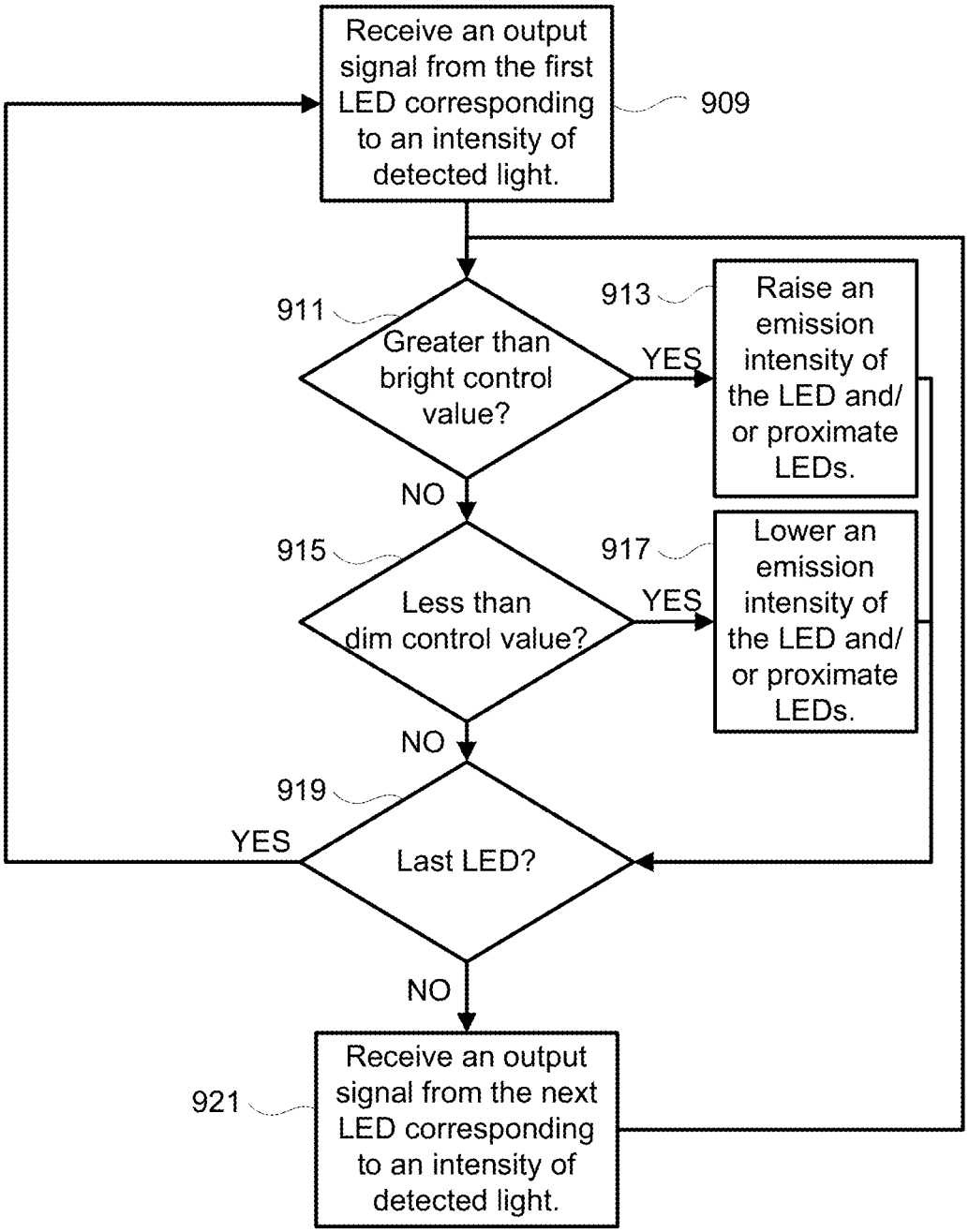
FIG. 9D is a flow chart of a method of performing ambient light detection with an interactive display panel in accordance with embodiments.

An exemplary method of performing ambient light detection with an interactive display panel 119 is illustrated in FIG. 9D. At 909, the output processor 123 receives an output signal from a first LED corresponding to an intensity of detected light. In this embodiment, the output signal is the sensing output data 230 of the first LED sensed by the sense receiver 115. In an embodiment, the sensing output data 230 is not incorporated within a bitmap, but gets relayed directly to the output processor 123 through the sense timing controller 121. Alternatively, output processor 123 may receive output signals from LEDs in the form of an output data bitmap, as described herein. In an embodiment, the first LED is the top left most LED in the display panel 119.

At 911, the output processor 123 determines whether the sensing output data 230 is greater than a bright control value. In an embodiment, the bright control value corresponds to a certain brightness of light determined by an algorithm programmed by a designer. The algorithm may calculate the bright control value based upon a number of different variables established by the designer. If the sensing output data 230 is greater than the bright control value, the output processor 123 determines that the ambient light sensed is too bright for the current emission intensity of an LED, such as the first LED, and/or one or more other LEDs in proximity to the LED or in a subarea of the display panel. At 913, the output processor 123 raises an emission intensity of the LED and/or one or more other LEDs in proximity to the LED to compensate for the bright ambient light. Accordingly, the display or portions thereof will be automatically adjusted to improve visibility in situations where there is bright ambient light. Alternatively, if the sensing output data 230 is not greater than the bright control value, at 915, the output processor 123 determines whether the sensing output data 230 is less than a dim control value. In an embodiment, the dim control value corresponds to a certain dimness of light determined by an algorithm programmed by the designer. The algorithm may calculate the dim control value based upon a number of different variables established by the designer. If the sensing output data 230 is dimmer than the dim control value, the output processor 123 may determine that the ambient light sensed is too dim for the current emission intensity of the LED and/or one or more other LEDs in proximity to the LED. At 917, the output processor 123 lowers an emission intensity of the LED and/or one or more other LEDs in proximity to the LED to compensate for the dim ambient light. Accordingly, the display or portions thereof will be automatically adjusted to improve visibility in situations where there is dim ambient light.

At 919, the output processor 123 determines whether the selected LED is the last LED in the display panel (or current output data bitmap). In an embodiment, the last LED is the bottom right most LED in the display panel 119. If the LED is the last LED in the display panel, then every LED in the display panel has been processed and the first LED in the display panel is selected again at 909. Alternatively, if the selected LED is not the last LED, at 921, the output processor 123 receives an output signal from the next LED corresponding to an intensity of detected light. In an embodiment, the next LED is an LED immediately to the right of the selected LED if possible, otherwise the next LED is the left most LED in the row below the selected row.

The exemplary method in FIG. 9D is performed for each LED sensing light to allow any portion of the display panel 119 to brighten or dim according to the ambient light profile. As such, the whole display panel 119 may brighten or dim as shown in FIGS. 9A and 9B, or a portion of the display panel 119 may brighten or dim as shown in FIG. 9C.

Figure 10A:
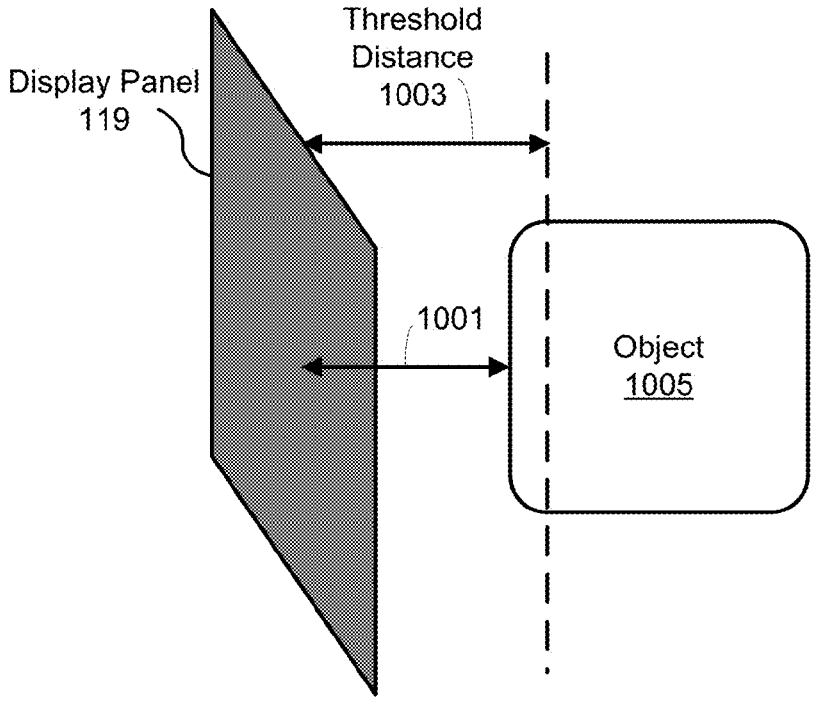
FIGS. 10A and 10B illustrate an operation of an interactive display panel with a processor configured for proximity detection in accordance with an embodiment.
Figure 10B:
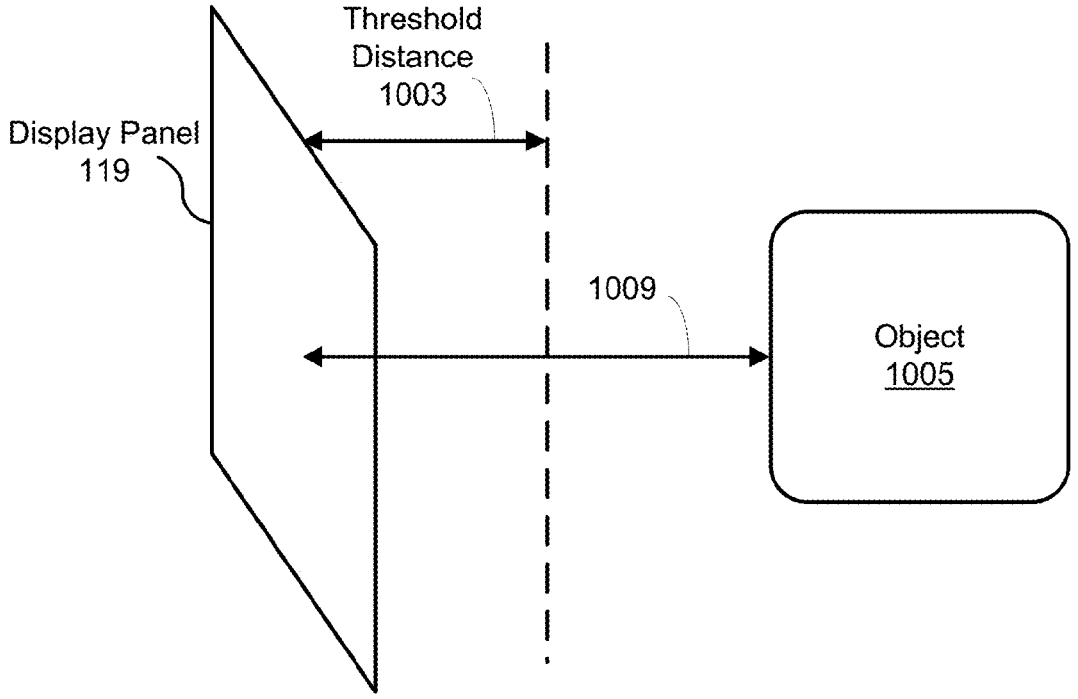

FIGS. 10A and 10B illustrate exemplary operations performed by the interactive display panel system 100 with an output processor 123 configured for proximity detection, such as ambient light proximity detection or reflected light proximity detection. FIG. 10A illustrates an exemplary instance in which a distance 1001 of an object 1005 is within the threshold distance 1003 to the display panel 119 and covers a threshold region of the display panel, thus causing the display panel 119 to cease emitting light. FIG. 10B illustrates an exemplary instance in which a distance 1009 of the object 1005 is not within the threshold distance 1003 to the display panel 119, thus causing the display panel 119 to begin or continue emitting light.

An output processor 123 configured for ambient light proximity detection turns the light emitting function of the display panel 119 on or off in response to an object's proximity to the display panel 119 by calculating an intensity of blocked ambient light. The output processor 123 may receive a bitmap or other representation of light intensities sensed by LEDs in the display panel 119 from the sense timing controller 121. As an object 1005 moves closer to the display panel 119, more ambient light is blocked. Accordingly, the LEDs may sense less ambient light as the object moves closer to the display panel 119. After receiving the bitmap, the output processor 123 may calculate the intensity of light sensed by the LEDs and compare the intensity of light to a control value. The control value may be an intensity of sensed light that represents a threshold distance 1003 to the display panel 119. In an embodiment, the control value is determined by an algorithm programmed by a designer. The algorithm may calculate the control value based upon a number of different variables established by the designer. If the intensity of sensed light is less than the control value (indicating, for instance, that the object 1005 is blocking more than a certain intensity of light), then the output processor 123 may compare the sensed light to a threshold region of the display pane 119. The threshold region of light may represent a certain portion of the display panel 119. For example, the threshold region of light may represent half of the display panel 119. As such, if a portion of the display panel 119 that is sensing an intensity of light less than the control value is greater than the threshold region of the display panel 119 (indicating that the object 1005 is blocking more than the threshold region of the display panel 119, such as half of the display panel), then the output processor 123 may send feedback data to the input processor 101 that includes a signal to turn the light emitting function of the display panel 119 off. In an alternative example, the threshold region of light can be determined by a specific location within the display panel 119. In an embodiment, the threshold region of light represents a portion of the display panel 119 near the top of the display panel 119 closest to a speaker used for talking on a phone. If, however, the intensity of sensed light is greater than the control value (indicating that the object 1005 is blocking less than the control value of light) or the area of a region of the display panel that is sensing an intensity of light less than the control value is less than a threshold region of the display panel, then the feedback data may include a signal to keep/turn the light emitting function of the display panel 119 on. In one embodiment, the output processor 123 is configured to turn the display panel 119 off when an object, such as a person's cheek or ear, is within a distance of 2 cm from a top quarter of the display panel 119 and turn back on when the cheek or ear is farther than 2 cm from the top quarter of the display panel 119. Accordingly, the display panel 119 may advantageously save battery power by not displaying an image when more than a threshold region of the display panel 119 is blocked.

On the other hand, an output processor 123 configured for reflected light proximity detection may turn the display panel 119 off in response to an object's proximity to the display panel 119 by calculating an intensity of reflected light. The output processor 123 may receive a bitmap or other representation of light intensities sensed by LEDs in the display panel 119 from the sense timing controller 121. In an embodiment, the light sensed by the LEDs includes light emitted from a source light that is reflected off the object's surface. For example, the source light may be one or more adjacent LEDs or one or more distant LEDs from within the display panel 119. After receiving the bitmap, the output processor 123 may calculate the total intensity of reflected light sensed by the LEDs and compare the total intensity of sensed light to a control value. The control value may be a certain intensity of sensed light that represents a threshold distance 1003 to the display panel 119. In an embodiment, the control value is determined by an algorithm programmed by a designer. The algorithm may calculate the control value based upon a number of different variables established by the designer. It is to be appreciated that the intensity of reflected light generally increases as the object 1005 gets closer to the display panel 119. Accordingly, if the total intensity of sensed light is greater than the control value, then the object 1005 is too close. Additionally, the output processor 123 may compare the sensed light to a threshold region of the display panel 119. The threshold region of the display panel 119 may represent a certain portion of the display panel that is being reflected by the object, such as half of the display panel 119. If more than the threshold region of the display panel 119 is reflected, then the output processor 123 may send feedback data to the input processor 101 that includes a signal to turn the light emitting function of the display panel 119 off. In an alternative example, the threshold region of the display panel 119 can be determined by a specific location within the display panel 119. In an embodiment, the threshold region of the display panel 119 represents a portion of the display panel 119 near the top of the display panel 119 closest to a speaker or an earpiece used for talking on a phone. In this manner, the display panel 119 detects proximity to a user's face. If, however, the total intensity of sensed light is less than the control value, or the portion of the display panel that his being reflected by the object is less than the threshold region of the display panel 119, then the feedback data may include a signal to turn the light emitting function of the display panel 119 on, if off, or continue emitting light with the display panel 119.

Figure 10C:
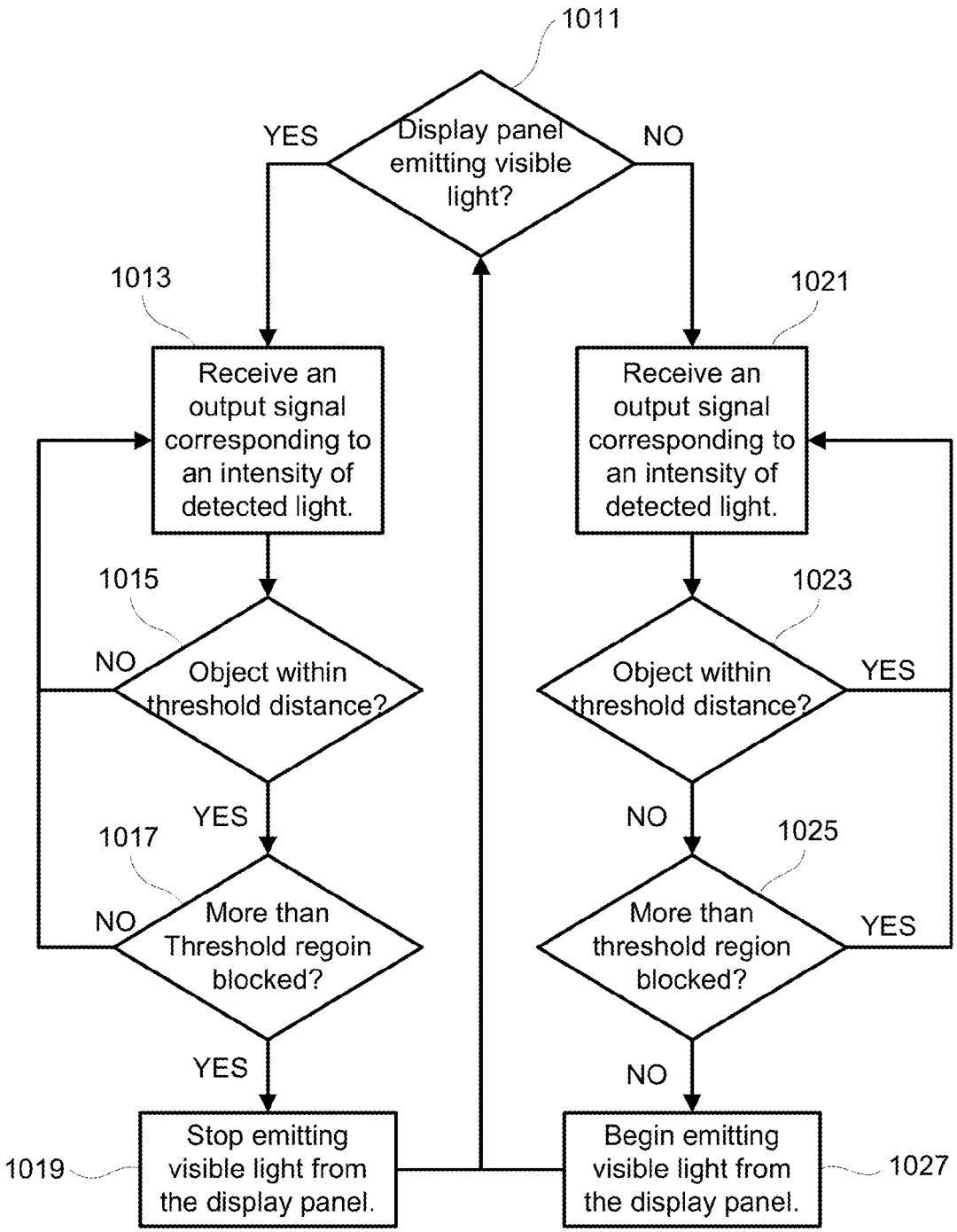
FIG. 10C is a flow chart of a method of performing proximity detection with an interactive display panel in accordance with an embodiment.

A method of performing proximity detection to control a light emitting function of the display panel 119 is illustrated in FIG. 10C according to an embodiment. At 1011, the output processor 123 determines whether or not the display panel 119 is emitting visible light. If the display panel 119 is emitting visible light, at 1013, the output processor 123 receives the display panel sensing data 125 in the form of a bitmap corresponding to an intensity of detected light (IR and/or visible).

In the case of ambient light proximity detection, at 1015, the output processor 123 determines whether the object is within a threshold distance to the display panel 119 by comparing the lowest intensity of light sensed with a control value, such as the control value disclosed above. In embodiments, ambient light proximity detection is used when ambient light exists, such as outdoors during the day or in a brightly lit room. Accordingly, ambient light proximity detection may be useful when the display is not emitting light. The control value represents a low intensity of light to indicate that an object is within the threshold distance to the display panel 119 due to a significant amount of blocked light. In an embodiment, the lowest intensity of light sensed may be an intensity of light sensed from any LED in the display panel or any group of LEDs in the display panel. For example, the lowest intensity of light sensed may be determined by one LED or the average of the lowest 10% of light sensed by all LEDs within the display panel. As such, if the lowest intensity of light sensed crosses the control value, then the object may be determined to be within the threshold distance. In an embodiment, the group of LEDs is located near the top of the display panel 119 closest to a speaker or earpiece used for talking on a phone. If the object does not block enough light, the output processor 123 determines that the object is not within the threshold distance and the output processor 123 will continue monitoring whether or not an object comes within the threshold distance to the display panel at 1013.

In the case of reflected light proximity detection, at 1015, the output processor 123 determines whether the object is within the threshold distance to the display panel by comparing the highest intensity of light sensed with a control value. In embodiments, reflected light proximity detection is used when ambient light does not exist, such as outdoors at night or in a dark room. Accordingly, reflected light proximity detection may be useful with the display is emitting light and is the only source of light in the surrounding environment. In this case, the control value represents a high intensity of light to indicate that an object is within the threshold distance to the display panel due to a significant amount of reflected light. In an embodiment, the high intensity of light is determined by light sensed by one LED or an average of the highest 10% of light sensed by all LEDs within the display panel. In an embodiment, the intensity of light is sensed by a group of LEDs located near the top of the display panel 119 closest to a speaker or earpiece used for talking on a phone. If an object does not reflect enough light, the output processor 123 may determine that the object is not within the threshold distance and the output processor 123 will continue monitoring whether or not an object comes within the threshold distance to the display panel at 1013.

Once the object comes within the threshold distance, the output processor 123, at 1017, will then determine whether or not the object blocks or reflects more than a threshold region of the display panel 119. The threshold region of the display panel 119 can be determined by a specific location within the display panel 119. In an embodiment, the threshold region of the display panel 119 is a portion of the display panel 119 near the top of the display panel 119 closest to a speaker or earpiece used for talking on a phone. Alternatively, in an embodiment, the threshold region of the display panel 119 is represented by a percentage of blocked or reflected LEDs in the display panel 119. For example, the threshold region may be 50% of the display panel 119. Accordingly, if less than 50% of the display panel 119 is blocked or reflected, the output processor will continue monitoring whether or not an object is within the threshold distance and has blocked or reflected more than the threshold region of the display panel to the display panel 119 by looping back to 1013. Alternatively, if more than the threshold region of the display panel 119 is blocked or reflected, the output processor 123 will cause the display panel 119 to stop emitting visible light at 1019. Thereafter, at 1011, the output processor will again determine whether the display panel is emitting light. In an embodiment, the threshold region of the display panel 119 is determined by a specific location within the display panel 119. In an embodiment, the threshold region of the display panel is a portion of the display panel 119 near the top of the display panel 119 closest to a speaker or earpiece used for talking on a phone.

Continuing with the example above, when the output processor determines that the display panel is not emitting visible light, at 1021, the output processor 123 receives an output signal corresponding to an intensity of detected light. In other words, the display panel 119 continues using LEDs to sense light while not emitting visible light.

Because the display panel 119 is not emitting visible light, reflected light proximity detection may not be useful. As such, ambient light proximity detection may be used instead. In the case of ambient light proximity detection, at 1023, the output processor 123 determines whether or not the object is within the threshold distance to the display panel 119 by comparing the lowest intensity of light sensed with the control value. As established above, in an embodiment, the lowest intensity of light sensed may be determined by the average of the lowest 10% of light sensed by all LEDs within the display panel 119. As such, if the lowest intensity of light sensed crosses the control value, the output processor 123 determines that an object is within the threshold distance. Thus, the output processor 123 will continue monitoring whether the object departs from within the threshold distance to the display panel at 1021.

Once the object departs from within the threshold distance from at least a portion of the display panel 119, the output processor 123, at 1025, determines whether the object blocks more than a threshold region of the display panel 119. For example, the threshold region of the display panel 119 may be half of the display panel 119. Accordingly, if more than the threshold region of the display panel 119 is blocked, then the output processor will continue monitoring whether or not an object is within the threshold distance and has blocked more than the threshold region of the display panel 119 by looping back to 1021. Alternatively, if less than the threshold region of the display panel 119 is blocked, then the output processor 123 will cause display panel 119 to begin emitting visible light from the display panel 119 at 1027. Again thereafter, the method returns to 1011.

Figure 11A:
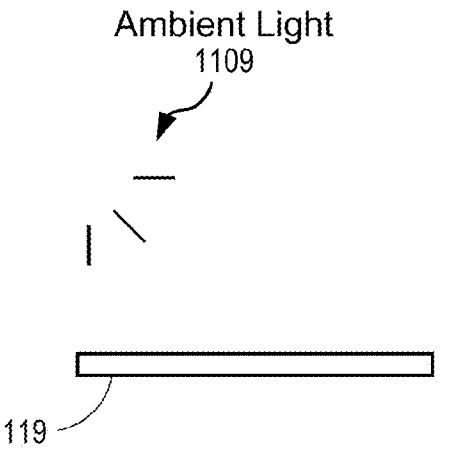
FIGS. 11A-11D illustrate an operation of an interactive display panel with a processor configured for object location determination in accordance with an embodiment.
Figure 11A:
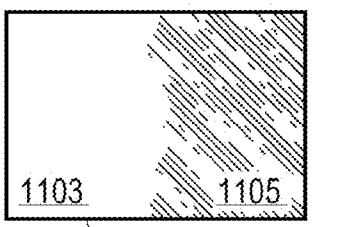
Figure 11B:
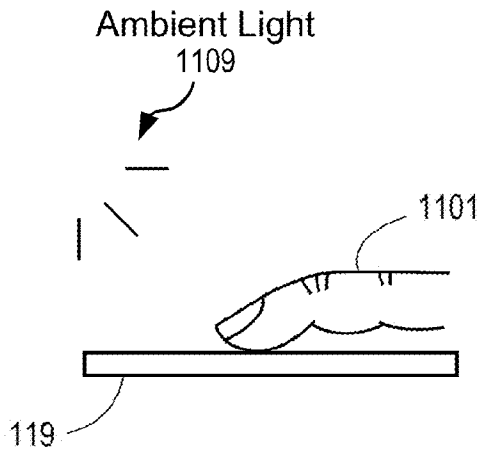
Figure 11B:
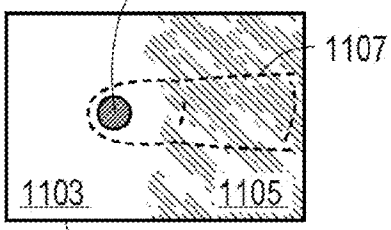
Figure 11C:
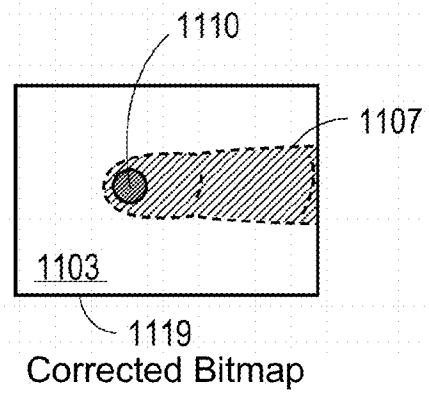

FIGS. 11A-11D illustrate exemplary operations performed by the interactive display panel system 100 with an output processor 123 configured for ambient light object location determination or reflected light object location determination. An output processor 123 configured for ambient light object location determination may determine a spatial location of an object 1101 by calculating a location of blocked light. The output processor 123 may receive a bitmap 1119 from the sense timing controller 121 that corresponds to light intensities sensed by LEDs within the display panel 119 (or other representation of sensed light intensities). In this embodiment, the light sensed by the LEDs originates from ambient light 1109. Referring to FIG. 11B, as an object 1101, such as a finger, moves close to the display panel 119, the object 1101 blocks ambient light from reaching an area of the display panel 119. As such, the bitmap 1119 from FIG. 11C represents an area of darkness 1107 surrounded by an area of light 1103. After receiving the bitmap 1119, the output processor 123 may determine the object's touch coordinates by calculating the horizontal and vertical locations of the darkest spot 1110. Accuracy may suffer, however, if ambient light is uneven and includes dark areas 1105 of ambient light among bright areas 1103 of ambient light as shown in the partially shaded bitmap 1117 in FIG. 11B (e.g., a shadow cast across a portion of the display panel 119). One way of increasing accuracy may be by correcting for the dark areas 1105 that do not correspond to the object's location. In an embodiment, the output processor 123 utilizes a frame buffer to store a control bitmap 1115 shown in FIG. 11A. The control bitmap 1115 may be a bitmap of ambient light before the object 1101 is close to the display panel 119. The control bitmap 1115 may be captured when the display panel 119 begins to sense light. Thereafter, the control bitmap 1115 may be captured periodically until an object moves close to (i.e., comes in contact with) the display panel 119 or when a triggering event occurs. In an embodiment, the control bitmap 1115 is captured every second when the display panel 119 is sensing light. In one embodiment, the triggering event is when a phone's accelerometer detects a movement, indicating that the display environment has changed. When an object moves close to the display panel (e.g., determined by output processor 123 as described above), the sensing bitmap 1117 may be captured and sent to the output processor 123. Once the sensing bitmap 1117 is received, the output processor 123 may compare the control bitmap 1115 to the sensing bitmap 1117 and generate a corrected bitmap 1119 as shown in FIG. 11C by removing the dark areas 1105 of the control bitmap 1115 from the sensing bitmap 1117. For example, the output processor 123 may remove the dark areas 1105 by subtracting values of the intensity of detected light represented by the control bitmap 1115 from corresponding values in the sensing bitmap 1117. As such, when the object's spatial location is calculated with the corrected bitmap 1119, the dark areas 1105 caused by variations in ambient light may be excluded from the calculation of the object's spatial location. Using the corrected bitmap 1119, the output processor 123 may determine and output the object's spatial location as described above.

Figure 11D:
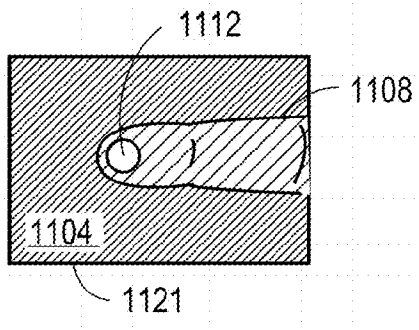

On the other hand, an output processor 123 configured for reflected light object location determination may determine an object's spatial location by calculating a location of reflected light. The output processor 123 may receive a bitmap 1121 (shown in FIG. 11D) from the sense timing controller 121 that corresponds to light intensities sensed by LEDs within the display panel 119. In this embodiment, the light sensed by the LEDs includes light emitted from a source light that is reflected off the object's surface. For example, the source light may be one or more adjacent LEDs or one or more distant LEDs from within the display panel 119. The amount of reflected light generally increases as the object gets closer to the display panel 119. Thus, as an object moves close to, i.e., comes in contact with, the display panel 119, the object reflects light in a corresponding area of the display panel 119. As such, in one embodiment, the resulting bitmap 1121 from FIG. 11D represents an area of light 1108 surrounded by an area of darkness 1104. After receiving the bitmap, the output processor 123 may determine the object's touch coordinates by calculating the horizontal and vertical locations of the brightest spot 1112.

Figure 11E:
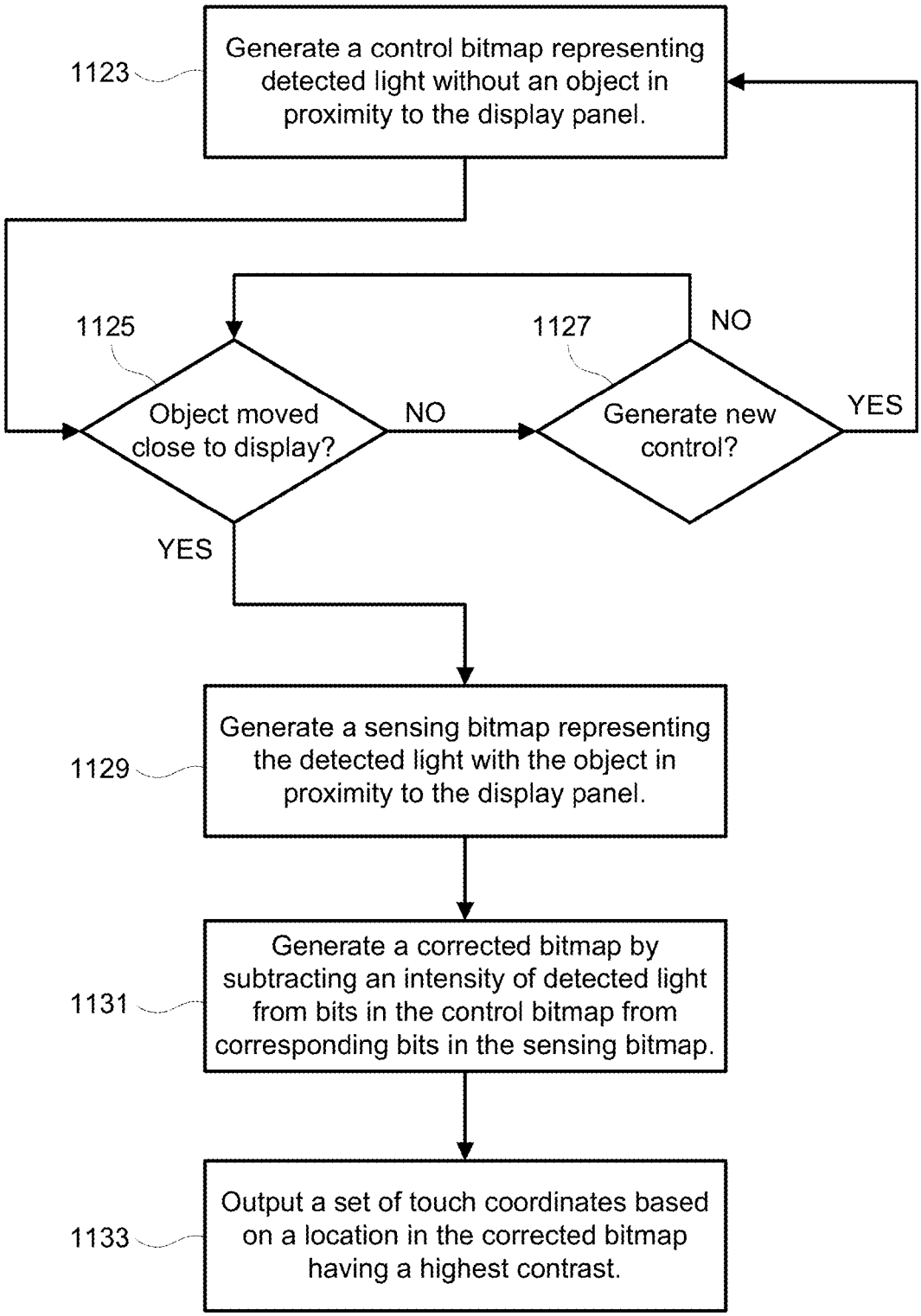
FIG. 11E is a flow chart of a method of performing object location determination with an interactive display panel in accordance with an embodiment.

A method of performing object location determination with the display panel 119 according to an embodiment is illustrated in FIG. 11E. At 1123, the output processor 123 generates a control bitmap, e.g., 1115 in FIG. 11A, representing detected light without an object in proximity to the display panel (e.g., when it receives display panel sensing data 125 from the sense timing controller 121). The control bitmap can be generated at various times of operation. For example, the control bitmap may be generated when the display is initially turned on to emit visible light. Furthermore, the control bitmap may be generated by or in response to a request from an application. For example, the control bitmap may be generated by a user when the user initiates execution of an application. The control bitmap may represent the environment's light profile before an object moves close to the display panel 119. As such, any deceptive light profiles that may be mistaken for the object's actual location (e.g., a partial shadow across display panel 119) may be recorded and later subtracted out of the calculation for a more accurate determination of the object's location.

At 1125, the output processor determines whether an object has moved close to the display panel. To make this determination, the output processor 123 compares an amount of sensed light with a control value. In this case, the control value may represent a complete blockage of ambient light (e.g., the darkest spot 1110 from FIG. 11C) or a complete reflection of source light (e.g., the brightest spot 1112 from FIG. 11D) to indicate that an object has made contact with the display panel 119. If the output processor 123 does not receive a bitmap with an area that crosses the control value, then, at 1127, the output processor 123 determines whether a new control bitmap should be generated. In making this determination, the output processor may consider an amount of time that has elapsed such that a new control bitmap is generated periodically. For instance, a new control bitmap may be generated every second where an object has not moved close to the display panel 119. In another example, a new control bitmap may be generated when a triggering event occurs. In an embodiment, the triggering event is when a separate sensor, such as an accelerometer, detects movement of the display panel, indicating that the environment from which the control bitmap is to be generated as changed. As such, if the set amount of time has not elapsed or no movement has been made, then the output processor 123 returns to 1125 to determine whether an object has moved close to the display panel. Alternatively, if it is determined that a new control is to be generated, the output processor 123 generates a control bitmap at 1123.

Once an object moves close to the display panel 119, at 1129, the output processor 123 generates a sensing bitmap representing the detected light with the object in proximity to the display panel, e.g., as illustrated in the sensing bitmap 1117 of FIG. 11B. At 1131, the output processor 123 may generate a corrected bitmap by subtracting a value of intensity of detected light represented by the control bitmap from corresponding values in the sensing bitmap and calculate a set of touch coordinates. The corrected bitmap may illustrate the profile of the object without any deceptive light profiles that may be been introduced by the environment, allowing for a more accurate calculation of the object's location. At 1133, the output processor outputs the set of touch coordinates based on adjacent locations within the corrected bitmap having a highest contrast. In an embodiment, for ambient light object location determination, the location having the highest contrast is the darkest spot 1110. For reflected light object location determination, the location having the highest contrast is the brightest spot 1112.

Figure 13:
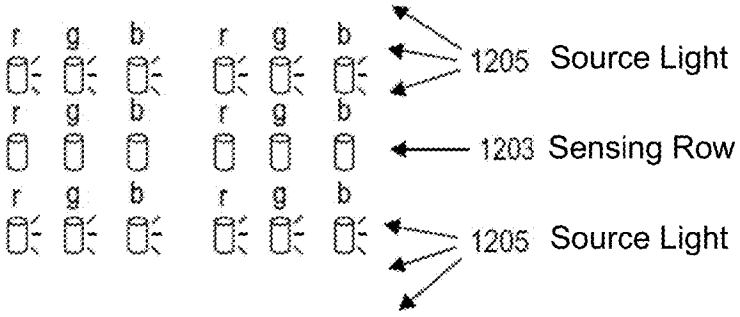
FIG. 13 illustrates a layout of subpixels in an interactive display panel for surface profile determination with visible light in accordance with an embodiment.
Figure 12:
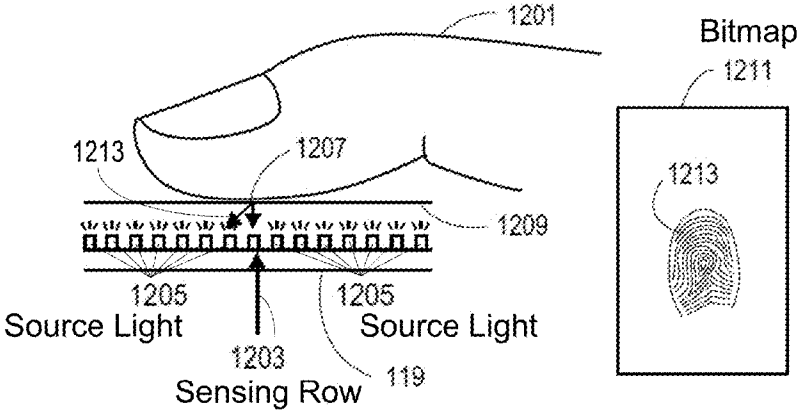
FIG. 12 illustrates an operation of an interactive display panel with a processor configured for surface profile determination with visible light in accordance with an embodiment.

FIG. 12 illustrates an exemplary operation performed by the interactive display panel system 100 with an output processor 123 configured for surface profile determination. An output processor 123 configured for surface profile determination may determine a surface profile of a target object. The output processor 123 may receive a bitmap 1211 from the sense timing controller 121 that corresponds to light intensities sensed by LEDs within the display panel 119 (or other representation of sensed light intensities). In this embodiment, the light sensed by the LEDs includes visible light emitted from a source light 1205 that is reflected off the target object's surface 1207. As shown in FIG. 13, the source light 1205 may be one or more adjacent LEDs or one or more distant LEDs from within the display panel 119.

Referring back to FIG. 12, when the target object is placed on a transparent substrate 1209 encapsulating the display panel 119, light may be reflected off the surface 1207 of the target object 1201 and sensed by LEDs, such as the LEDs in a sensing row 1203. During a typical sensing operation, the sensing row 1203 sequentially scrolls from row 1 to row N as described above in FIGS. 8A-8E. The target object's unique surface profile results in a corresponding reflection pattern 1213 that is sensed by the LEDs in the sensing row 1203. As such, the bitmap 1211 may represent patterned areas of brightness and darkness 1213 that correspond to the pattern of the target object's surface profile. After receiving the bitmap 1211, the output processor 123 may interpret the patterned areas of brightness and darkness 1213 and determine the target object's surface profile. In one example, the target object 1201 contains a fingerprint surface. When the fingerprint is placed upon the transparent substrate, the LEDs 1203 within the display panel 119 sense patterned light reflected off grooves of the fingerprint surface. This patterned light is relayed to the output processor 123 as a bitmap 1211 where it is processed to determine the fingerprint surface's unique pattern.

FIG. 13 illustrates a layout of a section of a display panel with sensing and emitting rows, according to embodiments of the invention. In an embodiment, the sensing row 1203 is sandwiched by two rows of source lights 1205, one above the sensing row 1203 and one below the sensing row 1203. In an embodiment, the source lights 1205 are LEDs. The sensing row 1203 may sense visible light emitted from the source lights 1205 in adjacent rows.

Figure 14:
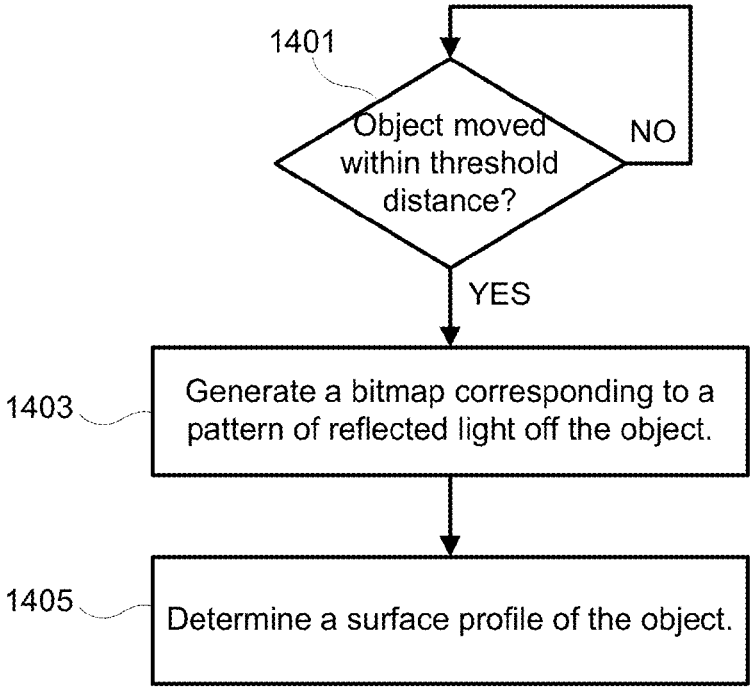
FIG. 14 is a flow chart of a method of performing surface profile determination with an interactive display panel in accordance with an embodiment.

An exemplary method of performing surface profile determination with the interactive display panel 119 is illustrated in FIG. 14. At 1401, the output processor 123 determines whether an object has moved within a threshold distance to the display panel. To make this determination, the output processor 123 compares an amount of sensed light with a control value. In this case, the control value may be an intensity of light that represents a complete reflection of source light to indicate that an object has made contact with the display panel 119. In an embodiment, the source light is light emitted from a red, green, or blue emitting LED that is sensed by a green, red, or an IR emitting LED. If the object does not move within the threshold distance to the display panel, then the output processor 123 returns to 1401 and continues to monitor for an object to come within the threshold distance to the display panel.

Once an object moves within the threshold distance, at 1403, the output processor 123 generates a bitmap by receiving display panel sensing data 125 in the form of a bitmap corresponding to a pattern of reflected light off the object. The pattern of reflected light is created by the reflection of light off the surface profile of the object. For example, the ridges and grooves of a fingerprint will reflect light in different amounts/angles. At 1405, the output processor 123 determines the surface profile of the target object by analyzing bright and dark patterns of the bitmap.

Figure 15B:
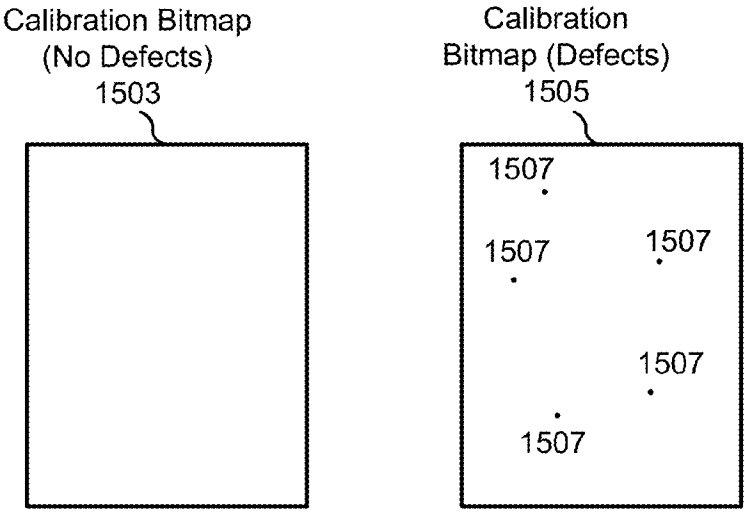
FIGS. 15A and 15B illustrate operations of an interactive display panel with a processor configured for display panel calibration in accordance with embodiments.
Figure 15A:
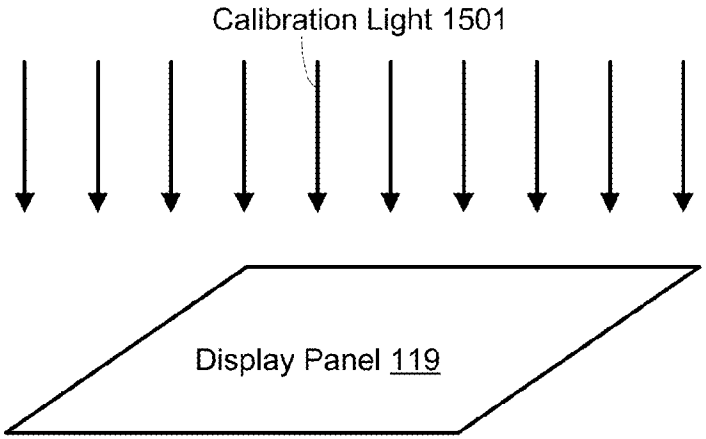

FIGS. 15A and 15B illustrate exemplary operations performed by the interactive display panel system 100 with an output processor 123 configured for display panel calibration. An output processor 123 configured for display panel calibration may receive a calibration bitmap 1503 or 1505 from the sense timing controller 121 that corresponds to light intensities sensed by LEDs within the display panel 119. In this embodiment, in FIG. 15A, the light sensed by the LEDs includes substantially uniform light 1501 emitted from a calibration light source that is capable of projecting a substantially uniform amount of light 1501 across the whole display panel 119. Accordingly, since each LED is exposed to the same amount of light, each LED should sense the same amount of light. As such, as shown in FIG. 15B, for a non-defective display panel 119, the calibration bitmap 1503 represents a consistent plane of brightness that is substantially even across the whole display panel 119. The output processor 123 may receive the calibration bitmap 1503 and determine whether the brightness is substantially consistent across the whole display panel 119. The output processor 123 may then store the calibration bitmap as an initial calibration result in the system memory 105 and send feedback data to the input processor 101 indicating a satisfactory calibration check. In some instances, the stored initial calibration is used in a subsequent calibration test to determine whether the LEDs are degrading and, if they are degrading, the speed of their degradation. A subsequent calibration test result may be stored in place of the initial calibration result and used in subsequent calibration tests. In some instances, however, instead of receiving the calibration bitmap 1503, the output processor 123 may receive the calibration bitmap 1505 with representations of non-uniform brightness 1507. As such, the output processor 123 may determine that one or more defective LEDs are sensing an insufficient amount of light. Such a determination generally indicates that the LED also emits light inefficiently. As a result, the output processor 123 may send feedback data to the input processor 101 to increase the driving voltage applied to that defective LED. That way, the defective LED may be driven at a higher voltage to compensate for its inefficiency.

Figure 15C:
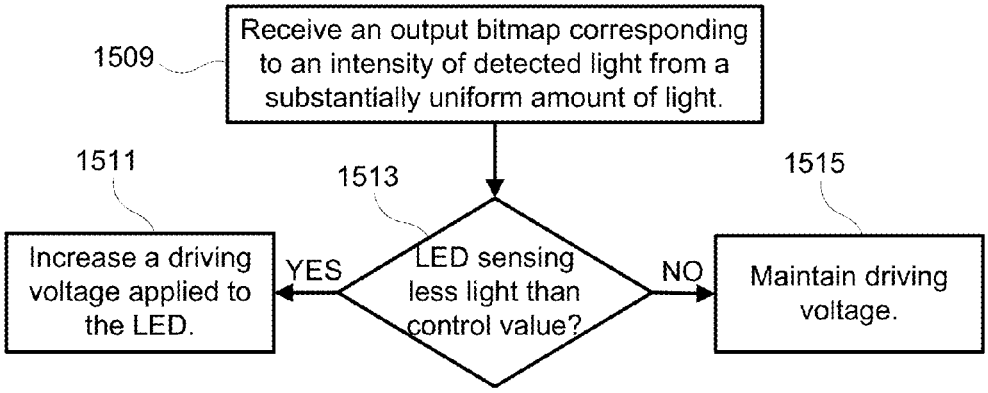
FIG. 15C is a flow chart of a method of performing display panel calibration with an interactive display panel in accordance with an embodiment.

An exemplary method of performing display panel calibration with the interactive display panel 119 is illustrated in FIG. 15C. At 1509, the output processor 123 receives an output bitmap corresponding to an intensity of detected light from a substantially uniform amount of light. In an embodiment, the substantially uniform amount of light is light emitted from a calibration light source that emits constant light at a predetermined intensity. At 1513, the output processor determines whether there are any LEDs that are sensing less than a control value by individually checking each LED (or each LED of a particular color/type) in the display panel. In one embodiment, one or more colors/types of LED have a different control value than another color/type of LED. In an embodiment, the control value is a predetermined intensity of light based upon the intensity of light emitted from the calibration light source. Alternatively, the control value is calculated by averaging intensities sensed by a group of LEDs. In an embodiment, the group of LEDs is all the LEDs in the entire display panel 119. Alternatively, the group of LEDs is the top 10, 20, 50, or even 90 percent of LEDs that are sensing the most amount of light. LEDs that sense less than the control value are determined to be defective in both the emitting and sensing of light. An LED that does not sense enough light indicates that it does not emit enough light. If the output processor 123 determines that an LED is sensing less than the control value, at 1511, the output processor 123 increases a driving voltage applied to that LED to compensate for the determined defect. The increase in driving voltage, in an embodiment, is proportional to the amount of decreased light sensed by the defected LED. For example, the output processor 123 may use a look up table for an increased value, additional value, or multiplier for the value to compensate for the defect. However, if the output processor determines that the LED is emitting at or greater than the control value, at 1515, the output processor maintains the driving voltage to that LED.

Figure 16B:
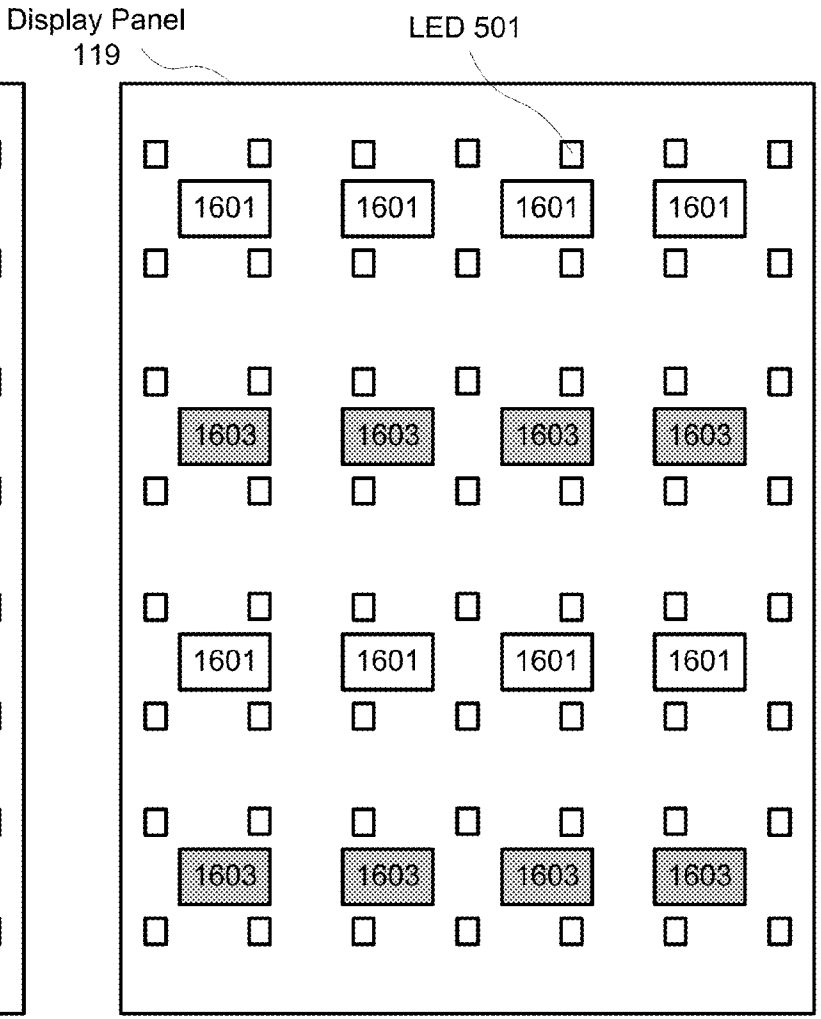
FIGS. 16A-16D illustrate interactive display panels with different microchip and LED arrangements according to embodiments.
Figure 16A:
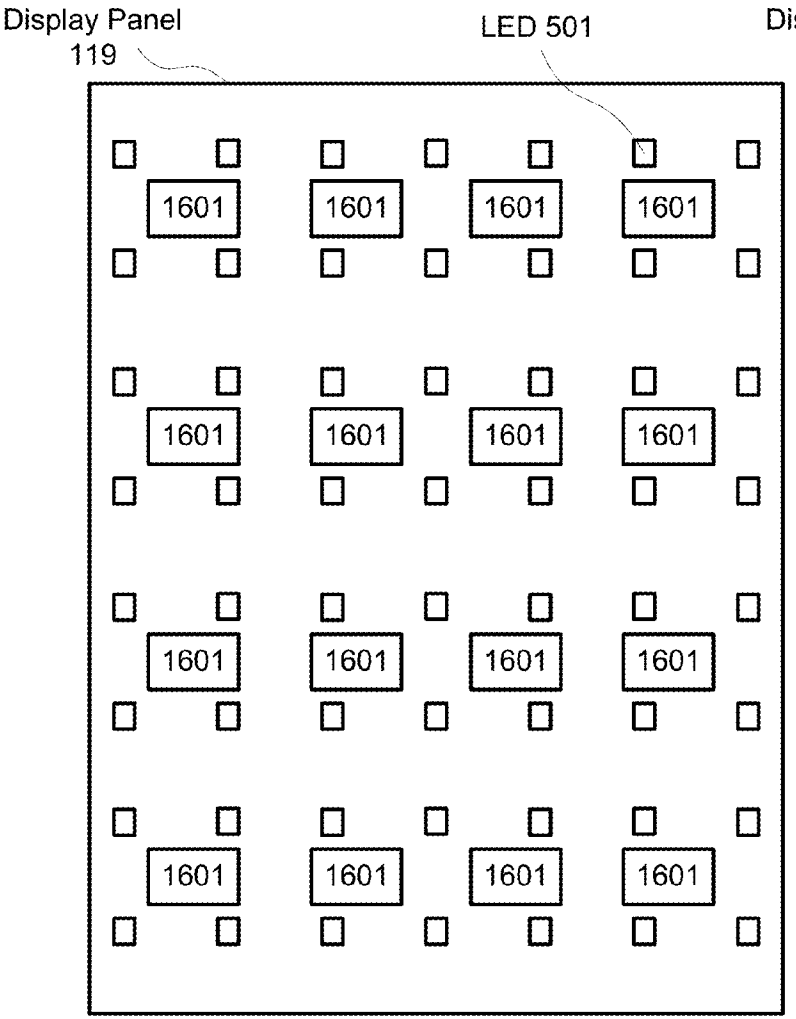
Figure 16D:
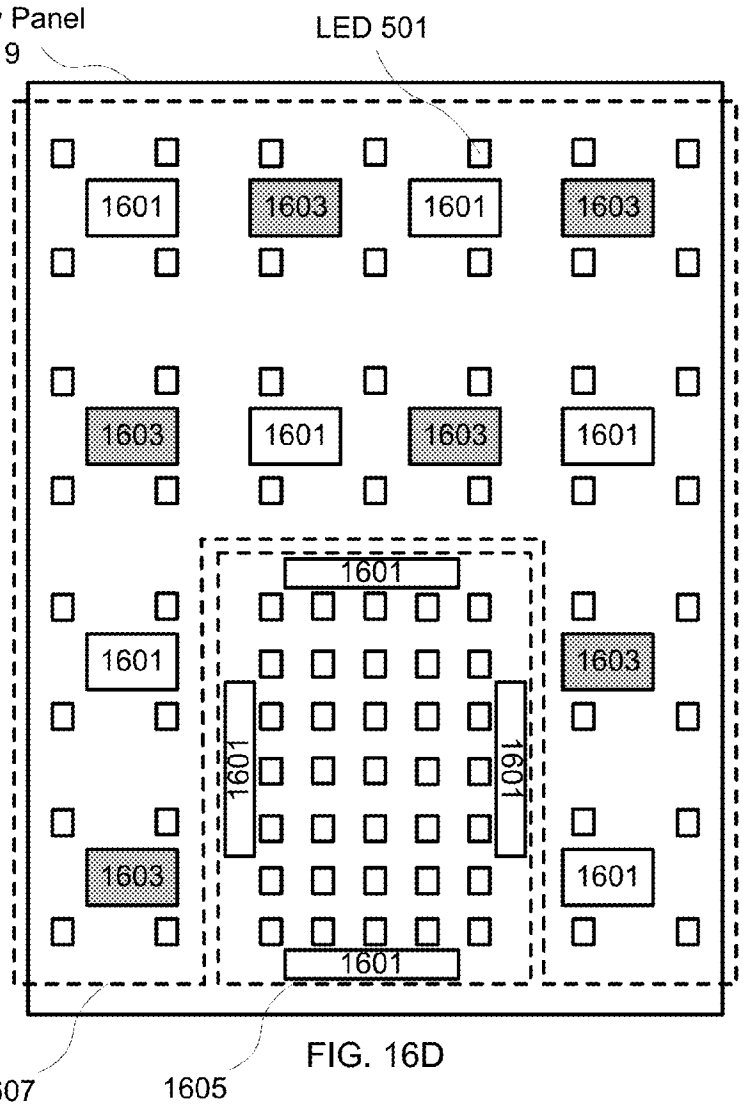
Figure 16C:
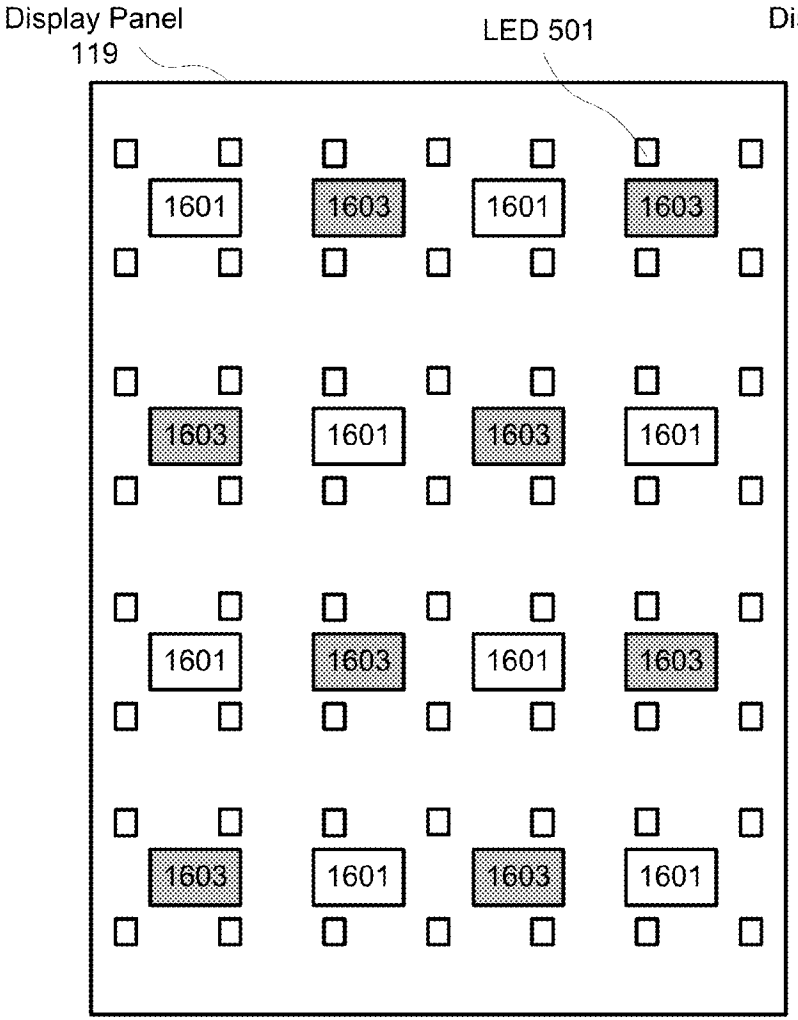

FIGS. 16A-16C illustrate interactive display panels 119 with different subpixel microchip and LED arrangements according to embodiments. While the embodiments illustrated and described with regard to FIGS. 16A-16D are made with regard to microchips, embodiments are not so limited and similar embedded subpixel circuit arrangements are contemplated. For example, subpixel circuits with driving circuits, and subpixel circuits with both driving circuits and selection devices can be embedded within the same substrate. In FIG. 16A, a display panel 119 having an array of LEDs 501 and driving-and-selecting subpixel microchips 1601 is illustrated. In an embodiment, the driving-and-selecting subpixel microchip 1601 is capable of performing the same operations as the subpixel microchip 513. That is, each driving-and-selecting subpixel microchip 1601 has a driving circuit 601 and a selection device 603 and is capable of driving an LED to emit light in a light emission mode and selecting a sensing circuit to non-forward bias the LED 501 and detect light in a light sensing mode. The arrangement of subpixel microchips in the display panel 119 is such that every subpixel microchip is a driving-and-selecting subpixel microchip 1601. Accordingly, LEDs 501 throughout the entire display panel 119 may emit and sense light. For example, every LED 501 in the display panel 119 may emit and sense light. In another example, only every red emitting LED 501 in the display panel 119 may emit and sense light while every green and blue LED 501 may only emit light. In yet another example, every red emitting LED may emit light, but not every LED may sense light. These examples, however, are not intended to limit embodiments of the present invention. In the particular embodiment illustrated in FIG. 16A, each driving-and-selecting subpixel microchip 1601 controls the LEDs 501 for two RGB pixels 207. However, such an embodiment is provided for illustrational purposes and a driving-and-selecting subpixel microchip 1601 can be connected to control a number of different combinations of subpixels or pixels.

Alternatively, in FIG. 16B, a display panel 119 having an array of LEDs 501 and a plurality of driving-and-selecting microchips 1601 and driving subpixel microchips 1603 in an alternating row arrangement is illustrated according to an embodiment. Driving subpixel microchips 1603 are different from driving-and-selecting subpixel microchips 1601 in that driving subpixel microchips 1603 are configured to forward bias the LED to operate the LED in a light emission mode and do not contain a selection device 603, such as a multiplexer. In FIG. 16B, the driving-and-selecting subpixel microchips 1601 and the driving subpixel microchips 1603 in display panel 119 are arranged in alternating rows. As shown in FIG. 16B, the first row of subpixel microchips includes driving-and-selecting subpixel microchips 1601. Immediately below the first row contains a row of driving subpixel microchips 1603. Thereafter, subsequent rows alternate between rows of driving-and-selecting subpixel microchips 1601 and rows of driving subpixel microchips 1603. In an embodiment, the alternating row pattern is not every other row as illustrated in FIG. 16B. Rather, more than one row may include driving-and-selecting subpixel microchips 1601 followed by more than one row of driving subpixel microchips 1603. As such, an alternating pattern of multiple rows of driving-and-selecting subpixel microchips 1601 and multiple rows of driving subpixel microchips 1603 may be formed. Additionally, in an embodiment, the alternating row pattern includes an alternating pattern of a single row of driving-and-selecting subpixel microchips 1601 followed by more than one row of driving subpixel microchips 1603. As such, the resulting subpixel microchip arrangement may be a plurality of single rows of driving-and-selecting subpixel microchips 1601 separated by more than one rows of driving subpixel microchips 1603.

In an embodiment, the driving-and-selecting subpixel microchips 1601 are electrically coupled with LEDs 501 to enable the LEDs to emit and sense light. Furthermore, the driving subpixel microchips 1603 are electrically coupled with LEDs 501 to enable the LEDs 501 to emit light but not sense light. In an embodiment, alternating rows of driving-and-selecting subpixel microchips 1601 and driving subpixel microchips 1603 enables an alternating pattern of one or more rows of LEDs that emit and sense light and one or more rows of LEDs that emit light but cannot sense light. As such, depending on the desired resolution for sensing LEDs, the arrangement of driving-and-selecting microchips 1601 and driving microchips 1603 may follow accordingly.

FIG. 16C illustrates a display panel 119 having an array of LEDs 501 and a plurality of driving-and-selecting subpixel microchips 1601 and driving microchips 1603 in a checkerboard subpixel microchip arrangement according to an embodiment. In an embodiment, the checkerboard subpixel microchip arrangement is an alternating arrangement of driving-and-selecting subpixel microchips 1601 and driving subpixel microchips 1603 in both the horizontal (i.e., row) direction and the vertical (i.e., column) direction. In other embodiments, the alternating arrangement can be in either just the row or column direction. In some embodiments, a single driving-and-selecting subpixel microchip 1601 alternates with a single driving subpixel microchip 1603 as illustrated in FIG. 16C. In some embodiments, a group of driving-and-selecting subpixel microchips 1601 alternates with a group of driving subpixel microchips 1603 throughout the display panel 119.

In an embodiment, the alternating pattern of driving-and-selecting subpixel microchips 1601 and driving subpixel microchips 1603 enables a checkerboard pattern of a group of LEDs that emit and sense light and a group of LEDs that emit light but not sense light. In other embodiments, the alternating pattern can form another grid pattern of microchips 1601, 1603. As such, depending on the desired arrangement of emitting and sensing LEDs and emitting LEDs, the arrangement of driving-and-selecting subpixel microchips 1601 and driving microchips 1603 may follow accordingly.

FIG. 16D illustrates a display panel 119 having an array of LEDs 501 and emitting-and-sensing sections 1605, 1607 with different densities of driving-and-selecting subpixel microchips 1601, driving subpixel microchips 1603, and/or LEDs 501. As illustrated, section 1605 has a higher density of LEDs 501 than section 1607. Additionally, the driving-and-selection subpixel microchips 1601 are located around the LEDs 501 within section 1605, whereas the driving-and-selection subpixel microchips 1601 are located scattered throughout section 1607, although embodiments are not so limited. In this manner, section 1605 may be used to sense a higher definition image than section 1607.

In utilizing the various aspects of this invention, it would become apparent to one skilled in the art that combinations or variations of the above embodiments are possible for emitting and sensing light with an interactive display panel. Although the present invention has been described in language specific to structural features and/or methodological acts, it is to be understood that the invention defined in the appended claims is not necessarily limited to the specific features or acts described. The specific features and acts disclosed are instead to be understood as particularly graceful implementations of the claimed invention useful for illustrating the present invention.

It will be apparent from this description that aspects of the invention may be embodied, at least in part, in software. That is, the methods described with reference to FIGS. 6R, 8E, 9D, 10C, 11E, 14, and 15C may be carried out in a computer system as illustrated in FIG. 1 or another data processing system in response to its processor(s) executing sequences of instructions contained in a memory or other non-transitory machine-readable storage medium. In various embodiments, hardwired circuitry may be used in combination with the software instructions to implement the present embodiments. Thus, the techniques are not limited to any specific combination of hardware circuitry and software, or to any particular source for the instructions executed by data processing system.

An article of manufacture may be used to store program code providing at least some of the functionality of the embodiments described above. Additionally, an article of manufacture may be used to store program code created using at least some of the functionality of the embodiments described above. An article of manufacture that stores program code may be embodied as, but is not limited to, one or more memories (e.g., one or more flash memories, random access memories—static, dynamic, or other), optical disks, CD-ROMs, DVD-ROMs, EPROMs, EEPROMs, magnetic or optical cards or other type of non-transitory machine-readable media suitable for storing electronic instructions. Additionally, embodiments may be implemented in, but not limited to, hardware or firmware utilizing an FPGA, ASIC, a processor, a computer, or a computer system including a network. Modules and components of hardware or software implementations can be divided or combined without significantly altering embodiments of the invention.

In an embodiment, a display panel includes a display substrate having a display region, and an array of light emitting diodes (LEDs) on the display substrate within the display region. The display panel also includes an array of subpixel circuits. Each subpixel circuit includes a driving circuit to operate a corresponding LED in a light emission mode and a selection device to select a sensing output data line to operate the corresponding LED in a light sensing mode. In an embodiment, each driving circuit and each selection device of the array of subpixel circuits is embedded within the display substrate. In an embodiment, the display system includes an array of driving-and-selecting microchips on the display substrate within the display region, where each driving-and-selecting microchip includes a subpixel circuit.

In an embodiment, the display panel further includes an array of driving-and-selecting microchip on the display substrate within the display region, where each driving-and-selecting microchips includes a subpixel circuit. Each driving-and-selecting microchip may be operably coupled to a plurality of LEDs within a plurality of pixels. In an embodiment, each driving-and-selecting microchip is coupled to more than one pixel within the display region. In an embodiment, each driving-and-selecting microchip has a maximum width of 1 μm to 300 μm. Each driving circuit may include a plurality of MOSFET transistors arranged to forward bias the first or second LED. The selection device may be a multiplexer, a single transistor, multiple transistors, or any other selection device capable of selecting one circuit over another.

In an embodiment, the display panel includes a second array of LEDs and an array of second subpixel circuits, each comprising a second driving circuit to operate a corresponding second LED in a light emission mode. In an embodiment, the display panel further includes a plurality of driving microchips on the display substrate within the display region, where each driving microchip contains a second subpixel circuit. In an embodiment, a first section of the display panel includes a first density of the driving-and-selecting microchips, and a second section of the display panel includes a second density of the driving-and-selecting microchips, with the second density being higher than the first density.

In an embodiment, a display system includes a sensing circuit and a display substrate having a display region. The display system may also include an array of light emitting diodes (LEDs) on the display substrate within the display region, and an array of subpixel circuits. Each subpixel circuit may include a driving circuit to operate a corresponding LED in a light emission mode and a selection device to select the sensing circuit to operate the corresponding LED in a light sensing mode.

In an embodiment, the display system further includes a processor and memory (e.g., a non-transitory machine-readable media) with instructions that, when executed, causes the processor to adjust an emission intensity of the first LED or a second LED within the display panel in response to a comparison of the detected light with a control value. The control value may be determined by an algorithm. Additionally, in an embodiment, the display system further includes a processor and memory with instructions that, when executed, causes the processor to alter a light emitting function of the display panel to stop an emission of visible light in response to comparing the detected light with a control value and determining that an object covers more than a threshold region of the display panel. The threshold region may be a portion of the display panel located at a top of the display panel. In an embodiment, the display system further includes a processor and memory with instructions that, when executed, causes the processor to determine a surface profile of a target object by detecting a pattern within the detected light, the detected light including light reflected off a surface of the target object. The light reflected off a surface of the target object may emit from a source LED located within the display panel.

Furthermore, in an embodiment, the sensing circuit generates a control bitmap representing light detected by the display panel without an object in proximity to the display panel and generates a sensing bitmap representing light detected by the display panel with the object in proximity to the display panel. The display system further includes a processor and memory with instructions that, when executed, causes the processor to compare the control bitmap with the sensing bitmap to find common variations in sensed light intensity, generate a corrected bitmap by masking out the common variations of light intensity found in both the control bitmap and the sensing bitmap, and output a set of touch coordinates based on a location in the corrected bitmap having a highest contrast. In an embodiment, the display system further includes a processor and memory with instructions that, when executed, causes the processor to adjust an amount of light emitted from a portion of the display panel in response to a comparison of the intensity of detected light sensed in the portion of the display panel with a control value.

Additionally, in an embodiment, the display system further includes a processor and memory with instructions that, when executed, causes the processor to increase a driving voltage applied to the first LED or a second LED within the display panel in response to determining that the intensity of detected light sensed by the first LED within the display panel is less than a control value. The display system may further include a master timing controller capable of synchronizing a write timing controller and a sense timing controller. The write timing controller may write image data to a storage capacitor within the display panel by operating a write controller and a write driver. In an embodiment, the sense timing controller gathers sensing output data form the display panel by operating a sense receiver and a sense controller. The sense receiver may include the sensing circuit. The write timing controller and the sense timing controller may be decoupled from one another. In an embodiment, the driving circuit and the selection device are located in a microchip. The microchip may be located on the display substrate within the display region. Additionally, in an embodiment, the sensing circuit is a sense receiver located outside of the display region. In one embodiment, the sensing circuit is integrated into a write driver located outside of the display region. The driving circuit and the selection device may be embedded within the display substrate within the display region.

In an embodiment, a method of operating a display panel includes operating a first light emitting diode (LED) in a light emission mode. Operating the first LED in a light emission mode may include forward biasing the first LED. Additionally, operating the display panel includes operating the first LED in a light sensing mode. Operating the first LED in a light sensing mode may be performed by selecting a sensing circuit in response to a sense signal and operating the first LED in a non-forward bias mode, such as a reverse or zero bias mode. An output signal corresponding to an intensity of detected light is then detected. Light emitting from the display panel is then altered in response to the output signal.

In an embodiment, the method includes emitting light with a second LED within the display panel while detecting light with the first LED. In an embodiment, detecting an intensity of light with the first LED includes detecting light emitted from the second LED of the display panel. In an embodiment, the method includes emitting light with the first LED while detecting light with a second LED within the display panel. The method may include generating a sense signal to select the sensing circuit, and generating a write signal from another driving circuit to cause the second LED to emit light, such that the sense signal and the write signal are sent at a same frequency. In an embodiment, the method includes generating the sense signal to select the sensing circuit, and generating a write signal from another driving circuit to cause the second LED to emit light, such that the sense signal is generated at a lower frequency than the write signal. The detected light may comprise light emitting from the second LED, such as a red, a green, and a blue emitting LED. In an embodiment, the detected light includes ambient light. Additionally, in an embodiment, the first LED is an emitting LED, such as a red, a green, a blue, and an infrared (IR) emitting LED. In an embodiment, the output signal is a current or voltage signal.

Altering the light emitted from the display panel in response to the output signal may include adjusting an emission intensity of the first LED and/or a second LED within the display panel in response to a comparison of the intensity of detected light with a control value. The second LED may include a group of LEDs in a subarea of the display panel. Additionally, in an embodiment, altering the light emitted from the display panel in response to the output includes altering a light emitting function of the display panel to stop an emission of visible light in response to comparing the detected light with a control value and determining that an object covers more than a threshold region of the display panel. In an embodiment, the method includes determining a surface profile of a target object by detecting a pattern within the detected light, the detected light comprising light reflected off a surface of the target object. Furthermore, in an embodiment, the method includes generating a control bitmap representing the detected light without an object in proximity to the display panel, generating a sensing bitmap representing the detected light with the object in proximity to the display panel when the object moves close to the display panel, then generating a corrected bitmap by subtracting values of intensity of detected light in the control bitmap from corresponding values in the sensing bitmap, and thereafter, outputting a set of touch coordinates based on a location in the corrected bitmap having a highest contrast.

In an embodiment, altering the light emitting from the display panel in response to the output signal includes adjusting an amount of light emitted from a portion of the display panel in response to a comparison of the intensity of detected light sensed in the portion of the display panel with a control value. Additionally, in an embodiment, altering the light emitted from the display panel in response to the output signal includes increasing a driving voltage applied to the first LED or a second LED within the display panel in response to determining that the intensity of detected light sensed by the first LED or the second LED within the display panel is less than a control value. In an embodiment, the output signal is detected from the first LED. Furthermore, in an embodiment, the output signal is detected from an exposure capacitor connected in parallel with the first LED. Moreover, in an embodiment, the sensing circuit stores charge on the exposure capacitor when operating the first LED in the reverse or zero bias mode. In an embodiment, the exposure capacitor leaks an amount of charge proportionate to an amount of light sensed by the first LED. Additionally, in an embodiment, detecting light with the first LED is performed at the same time a storage capacitor in the driving circuit for the first LED is being written with image data. Additionally, in an embodiment, the method further includes selecting the sensing circuit and deselecting the driving circuit. In an embodiment, the method further includes selecting the driving circuit and deselecting the sensing circuit. Furthermore, in an embodiment, the method further includes selecting both the driving circuit and the sensing circuit.

What is claimed is:

1. A display panel, comprising:

a display substrate having a display region;

a first array of light emitting diodes (LEDs) on the display substrate within the display region;

a first array of first subpixel circuits within the display region, each first subpixel circuit comprising:

a first driving circuit to operate a first corresponding LED in the first array of LEDs in a light emission mode; and a first selection device to select a sensing output data line to operate the first corresponding LED in a light sensing mode; and a second array of LEDs on the display substrate within the display region; and a second array of second subpixel circuits within the display region, each second subpixel circuit comprising a second driving circuit to operate a second corresponding LED in the second array of LEDs in a light emission mode, wherein each second subpixel circuit does not include a selection device to operate an LED in the second array of LEDs in a light sensing mode.

2. The display panel of claim 1, wherein the first array of first subpixel circuits is located in an array of driving-and-selecting microchips on the display substrate.

3. The display panel of claim 2, wherein each driving-and-selecting microchip is operably coupled to a plurality of LEDs of the first array of LEDs within a plurality of pixels.

4. The display panel of claim 3, further comprising a first section of the display panel including a first density of the driving-and-selecting microchips, and a second section of the display panel including a second density of the driving-and-selecting microchips, with the second density being higher than the first density.

5. The display panel of claim 2, wherein each driving-and-selecting microchip has a maximum width of 1 μm to 300 μm.

6. The display panel of claim 1, wherein each first driving circuit, each second driving circuit, and each first selection device of the first and second arrays of subpixel circuits is embedded within the display substrate.

7. The display panel of claim 1, wherein the first selection device is a multiplexer.

8. The display panel of claim 1, wherein the first selection device is a transistor.

9. A display system comprising:

a sensing circuit;

a display substrate having a display region;

a first array of light emitting diodes (LEDs) on the display substrate within the display region;

a first array of first subpixel circuits within the display region, each first subpixel circuit including:

a first driving circuit to operate a first corresponding LED in the first array of LEDs in a light emission mode; and a first selection device to select the sensing circuit to operate the first corresponding LED in a light sensing mode; and a second array of LEDs on the display substrate within the display region; and a second array of second subpixel circuits within the display region, each second subpixel circuit comprising a second driving circuit to operate a second corresponding LED in the second array of LEDs in a light emission mode, wherein each second subpixel circuit does not include a selection device to operate an LED in the second array of LEDs in a light sensing mode.

10. The display system of claim 9, wherein the sensing circuit is a sense receiver located outside of the display region.

11. The display system of claim 10, wherein the sensing circuit is integrated into a write driver located outside of the display region.

12. The display system of claim 9, wherein the first array of first subpixel circuits is located in an array of driving-and-selecting microchips on the display substrate.

13. The display system of claim 9, wherein each first driving circuit, each second driving circuit, and each first selection device of the first and second arrays of subpixel circuits is embedded within the display substrate.

14. A method of operating a display panel comprising:

operating a first array of light emitting diodes (LEDs) in a display region of the display panel in a light emission mode;

operating a second array of LEDs in the display region of the display panel in a light emission mode;

operating the first array of LEDs in a light sensing mode while operating the second array of LEDs in the light emission mode; and detecting an intensity of light with the first array of LEDs in the light sensing mode;

wherein the first array of LEDs is connect to a first array of first subpixel circuits within the display region of the display panel, each first subpixel circuit includes:

a first driving circuit to operate a first corresponding LED in the light emission mode; and a first selection device to select a sensing output data line to operate the first corresponding LED in the light sensing mode; and wherein the second array of LEDs is connected to a second array of second subpixel circuits within the display region of the display panel, each second subpixel circuit including a second driving circuit to operate a second corresponding LED in the light emission mode, wherein each second subpixel circuit does not include a selection device to operate an LED in the light sensing mode.

15. The method of claim 14, wherein operating the first array of LEDs in the light emission mode comprises forward biasing the first array of LEDs, and operating the first array of LED in the light sensing mode comprises reverse biasing or zero biasing the first array of LEDs.

16. The method of claim 15, wherein detecting an intensity of light with the first array of LEDs comprises detecting light emitted from the second array of LEDs of the display panel.

17. The method of claim 15, wherein detecting an intensity of light with the first array of LEDs comprises detecting ambient light.

18. The method of claim 15, further comprising, adjusting an emission intensity of the first array of LEDs or the second array of LEDs of the display panel in response to a comparing the detected intensity of light with a control value.

* * * * *